US008741520B2

(12) United States Patent
Sawada et al.

(10) Patent No.: US 8,741,520 B2
(45) Date of Patent: Jun. 3, 2014

(54) IMAGE FORMING TONER, IMAGE FORMING APPARATUS, IMAGE FORMING METHOD, AND PROCESS CARTRIDGE

(75) Inventors: Toyoshi Sawada, Kanagawa (JP); Akihiro Kotsugai, Shizuoka (JP); Akiyoshi Sabu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 431 days.

(21) Appl. No.: 13/000,185

(22) PCT Filed: Jun. 17, 2009

(86) PCT No.: PCT/JP2009/061436

§ 371 (c)(1),
(2), (4) Date: Dec. 20, 2010

(87) PCT Pub. No.: WO2010/001770

PCT Pub. Date: Jan. 7, 2010

(65) Prior Publication Data

US 2011/0129775 A1 Jun. 2, 2011

(30) Foreign Application Priority Data

Jul. 1, 2008 (JP) ..... 2008-171943
Jul. 1, 2008 (JP) ..... 2008-171944

(51) Int. Cl.
*G03G 9/00* (2006.01)

(52) U.S. Cl.
USPC ..... 430/109.4; 430/109.1

(58) Field of Classification Search
USPC ..... 430/109.1, 109.4
See application file for complete search history.

(56) References Cited

U.S. PATENT DOCUMENTS

| | | | | |
|---|---|---|---|---|
| 6,323,115 | B1 | 11/2001 | Tanabe et al. | |
| 2003/0165760 | A1 | 9/2003 | Higuchi et al. | |
| 2003/0219670 | A1 | 11/2003 | Sawada et al. | |
| 2007/0015077 | A1* | 1/2007 | Yamashita et al. | 430/109.4 |
| 2007/0125266 | A1* | 6/2007 | Ito | 106/162.1 |
| 2008/0069616 | A1 | 3/2008 | Kojima et al. | |
| 2008/0227002 | A1* | 9/2008 | Moriya et al. | 430/48 |
| 2008/0280218 | A1 | 11/2008 | Sabu et al. | |
| 2008/0280219 | A1 | 11/2008 | Nakayama et al. | |
| 2008/0318143 | A1 | 12/2008 | Nakayama et al. | |
| 2009/0003885 | A1 | 1/2009 | Sabu et al. | |

(Continued)

FOREIGN PATENT DOCUMENTS

| | | | |
|---|---|---|---|
| CN | 1314619 | A | 9/2001 |
| CN | 101098907 | A | 1/2008 |

(Continued)

OTHER PUBLICATIONS

International Search Report issued Jul. 28, 2009 in PCT/JP09/61436 filed Jun. 17, 2009.

(Continued)

*Primary Examiner* — Stewart Fraser
(74) *Attorney, Agent, or Firm* — Oblon, Spivak, McClelland, Maier & Neustadt, L.L.P.

(57) ABSTRACT

The present invention provides an image forming toner including at least a linear polyester resin (b1) as a binder resin, wherein the linear polyester resin (b1) is obtained by reacting a polyester diol (b11) having a polyhydroxycarboxylic acid skeleton, with a polyester diol (b12) other than the polyester diol (b11) in the presence of a chain extending agent.

15 Claims, 1 Drawing Sheet

(56) References Cited

U.S. PATENT DOCUMENTS

| | | | | |
|---|---|---|---|---|
| 2009/0103950 | A1 | 4/2009 | Nakayama et al. | |
| 2011/0065036 | A1* | 3/2011 | Inoue et al. | 430/108.2 |
| 2011/0104608 | A1* | 5/2011 | Nakajima et al. | 430/109.31 |

FOREIGN PATENT DOCUMENTS

| | | | |
|---|---|---|---|
| EP | 1 744 222 | A2 | 1/2007 |
| EP | 1 744 222 | A3 | 1/2007 |
| JP | 59 96123 | | 6/1984 |
| JP | 4 340970 | | 11/1992 |
| JP | 6 502926 | | 3/1994 |
| JP | 7 33861 | | 2/1995 |
| JP | 9 274335 | | 10/1997 |
| JP | 9 281746 | | 10/1997 |
| JP | 9 319144 | | 12/1997 |
| JP | 2909873 | | 4/1999 |
| JP | 11 149181 | | 6/1999 |
| JP | 2001 83739 | | 3/2001 |
| JP | 2001 166537 | | 6/2001 |
| JP | 2002 284881 | | 10/2002 |
| JP | 2002 328491 | | 11/2002 |
| JP | 2003 255588 | | 9/2003 |
| JP | 2004 46095 | | 2/2004 |
| JP | 2004 151315 | | 5/2004 |
| JP | 2004 151316 | | 5/2004 |
| JP | 2004 151457 | | 5/2004 |
| JP | 2004 177554 | | 6/2004 |
| JP | 2004-271573 | | 9/2004 |
| JP | 3640918 | | 1/2005 |
| JP | 2006 91278 | | 4/2006 |
| JP | 3788608 | | 4/2006 |
| JP | 2006 208455 | | 8/2006 |
| JP | 2006 307195 | | 11/2006 |
| JP | 2007 199655 | | 8/2007 |
| JP | 2007 233030 | | 9/2007 |
| JP | 2008 51873 | | 3/2008 |
| JP | 2008 102503 | | 5/2008 |
| JP | 2008 262179 | | 10/2008 |
| JP | 2009-37206 | | 2/2009 |
| JP | 2009 75544 | | 4/2009 |
| JP | 2009 116320 | | 5/2009 |
| WO | WO 2006/063908 | A1 | 6/2006 |

OTHER PUBLICATIONS

Chinese Office Action issued Jun. 25, 2012, in Patent Application No. 200980133768.3 (with partial English-language translation).

Office Action issued Apr. 2, 2013, in Chinese Patent Application No. 200980133768.3 (with English-language translation).

Office Action issued Jul. 27, 2012 in Japanese Patent Application No. 2008-171943.

Office Action issued Jul. 27, 2012 in Japanese Patent Application No. 2008-171944.

Extended European Search Report issued Aug. 14, 2013, in European Patent Application No. 09773348.9.

* cited by examiner

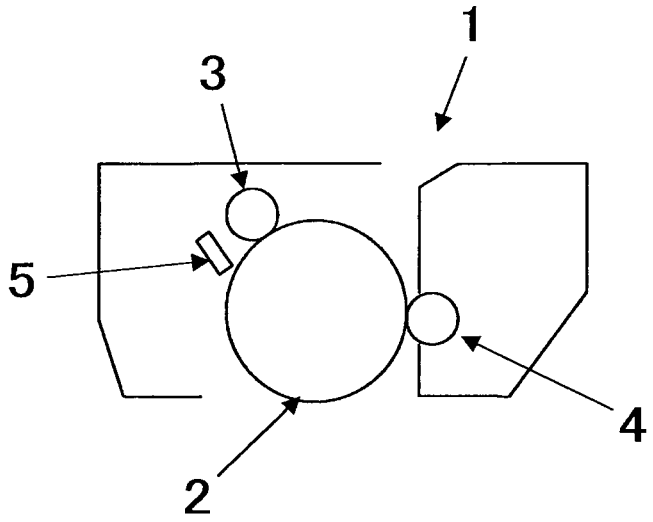
1
3
5
4
2

IMAGE FORMING TONER, IMAGE FORMING APPARATUS, IMAGE FORMING METHOD, AND PROCESS CARTRIDGE

CROSS-REFERENCE TO RELATED APPLICATIONS

This application is a US National Stage Application of PCT/JP2009/061436, filed on Jun. 17, 2009, the text of which is incorporated by reference, and claims priority to Japanese Patent Applications 2008-171943 and 2008-171944, filed on Jul. 1, 2008, the text of which is also incorporated by reference.

TECHNICAL FIELD

The present invention relates to a toner used in electrophotographic image formation, such as copiers, electrostatic printing, printers, facsimiles, and electrostatic recording; an image forming apparatus, an image forming method and a process cartridge each using the toner.

BACKGROUND ART

Conventionally, latent images which are electrically or magnetically formed in electrophotographic image forming apparatuses are formed into visible images by means of toner for image formation (hereinafter, it may be simply referred to as "toner"). For instance, in an electrophotographic process, an electrostatic image (latent image) is formed on a surface of a photoconductor, and the latent image is developed using a toner to thereby form a toner image. The toner image is usually transferred onto a transfer material (recording medium) such as paper, and then fixed on the transfer material such as paper by heating or other method. In the step of fixing a toner image on a transfer paper, generally, thermal fixing methods, such as a heating roller fixing method and a heating belt fixing method, are widely and commonly used for their superior energy conversion efficiency.

Recently, market demands for higher-speed performance and energy saving in image forming apparatuses are more and more increasing. In response to this, a toner which is superior in low-temperature fixability and transparency and enables to provide a high-quality image is desired. In order to achieve the low-temperature fixability of toner, however, there is a need to lower the softening point of a binder resin used in the toner. When a binder resin having a low softening point is used, a part of the toner forming a toner image is attached onto a surface of a fixing member and then transferred onto sheets of copy paper, this is, so-called offset (otherwise, referred to as "hot-offset") occurs. Furthermore, particularly under high temperature environments, the heat resistance of the toner degrades, and toner particles are fused to each other, that is, so-called blocking occurs. Besides the above-mentioned, there have been the following problems: a toner is fused on the inside of a developing device and a carrier in the developing device to cause smear; and toner filming easily occurs on a photoconductor surface. As one of measures to solve the above-mentioned problems, there has been proposed a toner which is improved in the physical properties: a toner using a polyester resin containing a polylactic acid has been proposed, which is said to be superior in storage stability, low-temperature fixability, offset resistance, environmental stability, and environmental conservation. However, the thermal properties of the polyester resin containing a polylactic acid are not sufficiently controlled as compared to polyester resins conventionally used for toner. Therefore, there are many constraints in formulation amount of the resin and production technique, and sufficient storage stability, low-temperature fixability and offset resistance have not yet obtained (see Patent Literature 1 and Patent Literature 2).

Generally, a toner used in developing of electrostatic images is composed of colored particles containing a colorant, a charge controlling agent, and the like in a binder resin. The production methods thereof are broadly classified into pulverization method and suspension polymerization method.

In the pulverization method, a colorant, a charge controlling agent, an anti-offset agent are uniformly dispersed in a thermoplastic resin to obtain a toner composition, the toner composition is pulverized and classified to thereby produce a toner. According to the pulverization method, a toner having somewhat superior physical properties can be produced, but there is a limit to selection of materials. For example, a toner composition obtainable by melt-mixing is necessarily pulverized and classified by using an economically usable device. In view of this requirement, as for a toner composition obtainable by melt-mixing, there is no choice but to make it sufficiently brittle to crush. When such a toner composition is pulverized, particles having wider particle size distribution tend to be formed. On that occasion, if an attempt is made to obtain a reproduced image with high resolution and high tone level, fine powder particles having a particle size of 5 μm or smaller and coarse powder particles having a particle size of 20 μm or greater must be removed by classification, resulting in a very poor yield. In addition, in the pulverization method, it is difficult to uniformly disperse a colorant, a charge controlling agent and the like in a thermoplastic resin, which may adversely affect the flowability, developing property, durability, image quality and the like of the resulting toner.

To solve the problems, Patent Literature 3 and Patent Literature 4 propose a dissolution suspension method using a dissolved resin, in which a resin solution in which a previously synthesized resin by polymerization reaction is dissolved is dispersed in an aqueous medium in presence of a dispersant (dispersion aid) such as a surfactant or a water-soluble resin, and a dispersion stabilizer such as resin fine particles, and the solvent is removed from the dispersion liquid by heating, reducing pressure, or the like to thereby obtain a toner. According to the dissolution suspension method, a toner having uniform particle diameter can be obtained without performing classification.

In an electrophotographic image forming appartus, in a fixing step employing a contact heating method in which a heating member such as a heating roller is used, it has been desired for toner to have releasing property (hereinafter, it may be referred to as offset resistance) to the heating member. In the dissolution suspension method using a dissolved resin, the offset resistance of toner is improved by using a modified polyester resin (see Patent Literature 5).

In the meanwhile, most of binder resins occupying 70% or more of the total amounts of toner components are derived from petroleum resources. There are concerns about exhaustion of petroleum resources and concerns that a large amount of petroleum resources is consumed and a large quantity of carbon dioxide is released into the atmosphere, leading to global-warming. Then, when resins derived from plants taking in carbon dioxide in the atmosphere to grow up are used as binder resins, carbon dioxide generated in use of the toners only circulates in the environments, and the use of plant-derived resins may make it possible to solve the global-warming problem and the problem with exhaustion of petroleum resources at a time. A variety of toners using such plant-derived resins as binder resins have been proposed. For example, Patent Literature 6 proposes to use a polylactic acid as a binder resin. However, when a polylactic acid is directly used as a binder resin according to the proposal, the concentration of ester linkage of the binder resin is higher than that of a polyester resin, and thus, the effect as a thermoplastic resin becomes weak in fixing step of toner image. Moreover, the toner becomes very hard, laking in pulverizability, and resulting in degradation of productivity.

An electrostatic image developing toner is proposed in Patent Literature 7, which contains a polyester resin obtained by dehydration polycondensation of a composition containing a lactic acid, and a trifunctional or higher-functional oxycarboxylic acid, and a colorant. However, in this proposal, the polyester resin is formed by a dehydration polycondensation reaction between a hydroxyl group of lactic acid and a carboxyl group of oxycarboxylic acid, and thus the molecular weight is increased to impair the sharp-melt property and low-temperature fixability.

In order to improve thermal properties of toner, Patent Literature 8 discloses an electrophotographic toner containing a polylactic acid-based biodegradable resin and a terpene-phenol copolymer, which however, cannot satisfy both the low-temperature fixability and the hot-offset property simultaneously.

Since the toners relating to the prior art are obtainable by a pulverization method, it involves problems of toner loss caused by classification, and toner waste accompanied therewith. In addition, because the energy quantity required for pulverization method is relatively large, it is necessary to further reduce environmental load.

Polylactic acids, which are generally used and easily available, are synthesized by dehydration condensation of a lactic acid, as described in Patent Literature 9 and Patent Literature 10, or by ring-opening polymerization of a cyclic lactide of lactic acid. For this reason, when a toner is produced using a polylactic acid, the dissolution suspension method using a dissolved resin, as disclosed in Patent Literature 3 to Patent Literature 5 can be used. However, since a polylactic acid having only L body or D body has high crystallinity, the solubility in organic solvents is extremely low, and thus it is difficult to use dissolution suspension method using dissolved resin. Then, the solubility of lactic acid in organic solvents can be improved by mixing L body of a polylactic acid and D body of a polylactic acid to decrease the crystallinity.

In the meanwhile, since polylactic acids are difficult to control their molecular weights, and ester linkages are present via only carbon atoms, it is difficult to impart necessary physical properties to toner by using polylactic acid along. In contrast, as used in conventional methods, it can be considered to provide necessary physical properties and thermal properties to toner by using a mixture of a polylactic acid and other resin or resins. However, polylactic acids are extremely poor in solubility and dispersibility in polyester resins and styrene-acryl copolymers which are generally used for toner, and thus it is very difficult to produce a toner in such a manner.

Furthermore, since the rate of crystallization of polylactic acids is rather slow, a toner produced by dissolution suspension method using a dissolved resin is difficult to control the crystallized state of polylactic acid, and in a toner produced by the method, a polylactic acid having high-crystallinity and a polylactic acid having low-crystallinity are present in a mixed manner. Therefore, portions having the high-crystalline polylactic acid are grown into crystals with a lapse of time, causing changes in charged amount and image density of the resulting toner as time goes by.

Accordingly, a toner which are superior in image density, fixability, and heat-resistant storage stability, causes less changes in fixability with a lapse of time and which contains a polylactic acid, and the related techniques have not yet been obtained, and further improvements and developments are still desired.

CITATION LIST

Patent Literature

[PTL 1] Japanese Patent Application Laid-Open (JP-A) No. 2006-208455

[PTL 2] Japanese Patent Application Laid-Open (JP-A) No. 2006-091278

[PTL 3] Japanese Patent Application Laid-Open (JP-A) No. 9-319144

[PTL 4] Japanese Patent Application Laid-Open (JP-A) No. 2002-284881

[PTL 5] Japanese Patent (JP-B) No. 3640918

[PTL 6] Japanese Patent (JP-B) No. 2909873

[PTL 7] Japanese Patent Application Laid-Open (JP-A) No. 9-274335

[PTL 8] Japanese Patent Application Laid-Open (JP-A) No. 2001-166537

[PTL 9] Japanese Patent Application Laid-Open (JP-A) No. 7-33861

[PTL 10] Japanese Patent Application Laid-Open (JP-A) No. 59-96123

SUMMARY OF INVENTION

Solution to Problem

The present invention aims to solve the problems in related art and achieve an object described below. Specifically, an object of the present invention is to provide a toner for image formation, which is superior in thermal properties, heat-resistant storage stability, and transparency; an image forming apparatus, an image forming method, and a process cartridge.

Another object of the present invention is to provide a toner which is superior in thermal properties, heat-resistant storage stability, and transparency even with use of a polylactic acid, and which is composed of resin particles having uniform particle diameter; an image forming apparatus, an image forming method, and a process cartridge.

Means for solving the above problems are as follows:

<1> An image forming toner including: a linear polyester resin (b1) as a binder resin, wherein the linear polyester resin (b1) is obtained by reacting a polyester diol (b11) having a polyhydroxycarboxylic acid skeleton, with a polyester diol (b12) other than the polyester diol (b11) in the presence of a chain extending agent.

<2> The image forming toner according to <1>, wherein a monomer forming the polyhydroxycarboxylic acid skeleton of the polyester diol (b11) is an optically active monomer, wherein the monomer has an optical purity X, in terms of a monomer converted amount, of 80% or less, where X represents an optical purity (%) at an optically active monomer conversion, which is determined from Optical Purity X (%)=|X (L-body)−X (D-body)| otherwise, a relationship between Y and X satisfies the following expression, where Y represents a linear polyester resin (b1) content (% by mass) in all binder resins used, and X represents an optical purity (mole %) in terms of a monomer converted amount, which is determined from $$\text{Optical Purity } X(\text{mole \%})=|X(L\text{-body})-X(D\text{-body})|,$$

$$Y\leq -1.5X+220\ (80<X\leq 100);\ \text{and}$$

wherein "X (L-body)" represents an L-body content ratio (mole %) at an optically active monomer conversion, and "X (D-body)" represents a D-body content ratio (mole %) at an optically active monomer conversion.

<3> The image forming toner according to one of <1> and <2>, wherein in the polyester resin (b1), a mass ratio of the polyester diol (b11) having a polyhydroxycarboxylic acid skeleton to the polyester diol (b12) is 31:69 to 90:10.

<4> The image forming toner according to any one of <1> to <3>, wherein the polyhydroxycarboxylic acid skeleton of the polyester diol (b11) is polymerized or copolymerized with a hydroxycarboxylic acid having 2 to 6 carbon atoms.

<5> The image forming toner according to any one of <1> to <4>, wherein the polyhydroxycarboxylic acid skeleton of the polyester diol (b11) is a polymer or copolymer obtained by ring-opening polymerization of cyclic ester.

<6> The image forming toner according to any one of <1> to <4>, wherein the polyhydroxycarboxylic acid skeleton of the polyester diol (b11) is a polymer or copolymer obtained by direct dehydration condensation of a hydroxy carboxylic acid.

<7> The image forming toner according to any one of <1> to <6>, further including, as a binder resin other than the polyester resin (b1), at least one selected from a group consisting of vinyl resins, polyurethane resins, epoxy resins, and polyester resins.

<8> The image forming toner according to any one of <1> to <7>, further including a wax (c) and a modified wax (d) which is modified so that vinyl polymer chains are grafted onto the wax (c).

<9> The image forming toner according to any one of <1> to <8>, wherein the toner contains particles obtained by melt kneading of toner components containing at least a binder resin and a colorant to form a melt-kneaded product, and pulverizing the melt-kneaded product, wherein the binder resin contains at least the polyester resin (b1).

<10> The image forming toner according to any one of <1> to <9>, wherein the toner is formed of resin particles (C) having a structure where one of resin particles (A) containing a first resin (a), and a coating layer (P) containing the first resin (a) are attached on surfaces of resin particles (B) containing a second resin (b), and the second resin (b) contains the polyester resin (b1).

<11> The image forming toner according to <10>, wherein the first resin (a) is at least one selected from a vinyl resin, a polyester resin, a polyurethane resin, and an epoxy resin.

<12> The image forming toner according to any one of <1> to <11>, wherein the binder resin contains the linear polyester resin (b1) and a resin (b2) which is obtained by reacting with a precursor (b0) in the formation of toner particles.

<13> The image forming toner according to any one of <1> to <12>, further including a charge controlling agent.

<14> The image forming toner according to <13>, wherein the charge controlling agent is a fluorine-containing quaternary ammonium salt.

<15> The image forming toner according to any one of <1> to <14>, further including a colorant.

<16> The image forming toner according to any one of <1> to <15>, further including a releasing agent.

<17> The image forming toner according to any one of <1> to <16>, further including, as a toner component, a layered inorganic mineral in which interlayer ions are partially modified with organic ions.

<18> An image forming apparatus including at least: a latent electrostatic image bearing member; a charging unit configured to charge a surface of the latent electrostatic image bearing member; an exposing unit configured to expose the charged surface of the latent electrostatic image bearing member to form a latent electrostatic image; a developing unit configured to develop the latent electrostatic image using a toner to form a visible image; a transfer unit configured to transfer the visible image onto a recording medium; and a fixing unit configured to fix the transferred image on the recording medium, wherein the toner is the image forming toner according to any one of <1> to <17>.

<19> An image forming method including at least: charging a surface of a latent electrostatic image bearing member; exposing the charged surface of the latent electrostatic image bearing member to form a latent electrostatic image; developing the latent electrostatic image using a toner to form a visible image; transferring the visible image onto a recording medium, and fixing the transferred image on the recording medium, wherein the toner is the image forming toner according to any one of <1> to <17>.

<20> A process cartridge detachably mounted on a main body of an image forming apparatus, the process cartridge including at least: a latent electrostatic image bearing member, and a developing unit configured to develop a latent electrostatic image, which has been formed on a surface of the latent electrostatic image bearing member, using a toner to form a visible image, wherein the toner is the image forming toner according to any one of <1> to <17>.

According to the present invention, it is possible to provide a toner for image formation, which is superior in thermal properties (in particular, low-temperature fixability), heat-resistant storage stability, and transparency; an image forming apparatus; an image forming method; and a process cartridge.

Furthermore, since the toner of the present invention has uniform particle diameter and can be obtained by dispersion in water, it can be produced with low costs.

BRIEF DESCRIPTION OF DRAWINGS

FIG. 1 is a schematic diagram showing a configuration of a process cartridge.

DESCRIPTION OF EMBODIMENTS

In order to obtain a linear polyester of a linear polyester resin (b1) which can be obtained by reaction of a polyester diol (b11) having a polyhydroxycarboxylic acid skeleton with a polyester diol (b12) other than the polyester diol (b11) together with an elongating agent, it is required that each of the polyester diol (b11), the polyester diol (b12) and the elongating agent be bifunctional. If any one of them is trifunctional or higher, the crosslinking reaction proceeds, resulting in an inability to obtain a linear polyester.

In an embodiment of a toner structure of the present invention, that is, resin particles (C) having a structure where resin particles (A) containing a first resin (a) or a coating layer (P) containing the first resin (a) are or is attached to a surface of resin particles (B) containing a second resin (b), the second resin (b) contains a linear polyester resin (b1) which can be obtained by reaction of a polyester diol (b11) having a polyhydroxycarboxylic acid skeleton with a polyester diol (b12) other than the polyester diol (b11) together with an elongating agent Linear polyesters have advantages in that they have higher solubility to solvents for their large molecular weight than branched or netted polyesters, and are suitably used for toner in terms of viscoelasticity and superior in productivity.

A linear polyester has a simple structure, and the molecular weight and physical properties (thermal properties, solubility with other resins, etc.) generated in accordance with the molecular weight can be easily controlled. Further, the linear polyester resin (b1) of the present invention is composed of a unit of (b11) and a unit of (b12). The linear polyester resin (b1) has an advantage in that the physical properties thereof can be controlled by the type of polyester used in the unit (b12), the molecular weight and the structure thereof, and is characterized by being definitely provided with physical property-controllability as compared to conventional compositions containing lactic acid(s).

The polyhydroxycarboxylic acid skeleton constituting the polyester diol (b11) is a skeleton obtained by polymerization of a hydroxycarboxylic acid and can be formed by direct dehydration condensation of a hydroxycarboxylic acid or by ring-opening polymerizing a corresponding cyclic ester. From the perspective that hydrolysis that could competitively arise in the polymerization reaction hardly occurs, and the molecular weight can be easily controlled, it is preferred to employ the ring-opening polymerization. Examples of the hydroxycarboxylic acid include aliphatic to hydroxycarboxylic acids (glycolic acid, lactic acid, hydroxy butanoic acid, etc.); aromatic hydroxycarboxylic acids (salicylic acid, creosote acid, mandelic acid, valine acid, etc.); or mixtures thereof. Examples of the corresponding cyclic ester include glycolide, lactide, γ-butyrolactone, and 6-valerolactone. Among these, from the perspective of transparency and thermal properties, as a monomer forming a polyhydroxycarboxylic acid skeleton, preferred are aliphatic hydroxycarboxylic acids and cyclic esters; still more preferred are hydroxycarboxylic acids having 2 to 6 carbon atoms (more preferably having 3 to 5 carbon atoms) (including corresponding cyclic esters); even more preferred are glycolic acids, lactic acids, glycolides, and lactides; and most preferred are glycolic acids and lactic acids.

When the monomer forming a polyhydroxycarboxylic acid skeleton is an optically active monomer like a lactic acid, and in particular, as a resin (b) in the resin particles (C), the linear polyester resin (b1) is alone used, an optical purity X (%), i.e., a value obtained by subtracting X (D-body) from X (L-body), when expressed in terms of mole percents of monomer components, is preferably 80% or less, and more preferably 60% or less, with the proviso that X (L-body) represents a ratio of L-body (%), expressed in terms of an optically active monomer converted amount, and X (D-body) represents a ratio of D-body (%), expressed in terms of an optically active monomer converted amount. When the optical purity X (%) is within the above range, the crystallinity of the polyester resin (b1) decreases, so that a dispersion failure of the polyester resin (b1) can be prevented in a toner composition containing other toner components derived from crystallization, the solubility to solvents can be improved, and a preferred toner production method (I) described below is easily usable.

In formation of the polyhydroxy carboxylic acid skeleton, the after-mentioned diol (11) is added for copolymerization, thereby the polyester diol (b11) having a polyhydroxycarboxylic acid skeleton can be obtained. Preferred diols are 1,2-propylene glycol, 1,3-propylene glycol, 1,4-butane diol, 1,6-hexane diol, alkylene oxide adducts (the added mole number: 2 to 30) of bisphenols (bisphenol A, bisphenol F, bisphenol S, etc.) (hereinbelow, "alkylene oxide" is simply abbreviated as "AO"; specific examples thereof are ethylene oxide (hereinbelow, abbreviated as "EO"), propylene oxide (hereinbelow, abbreviated as "PO"), butylene oxide (hereinbelow, abbreviated as "BO"), etc.) and combinations thereof. More preferred diols are 1,2-propylene glycol, 1,3-propylene glycol, 1,4-butane diol, and AO adducts of bisphenol A. Even more preferred diol is 1,3-propylene glycol.

As the polyester diol (b12) other than the polyester diol (b11), it is possible to use, from among the after-mentioned polyester resins, a polyester resin equivalent to a reaction product between a diol (11) and a dicarboxylic acid (13), and the reaction product can be obtained by adjusting the charging ratio of the diol and the dicarboxylic acid in the polymerization process so as to increase the number of hydroxyl groups. Preferred polyester diol (b12) are 1,2-propylene glycol, 1,3-propylene glycol, 1,4-butane diol, 1,6-hexane diol, AO (EO, PO, BO, etc.) adducts (the added mole number: 2 to 30) of bisphenols (bisphenol A, bisphenol F, bisphenol S, etc.), and reaction products between one or more types of diols selected from the combinations thereof and one or more types of dicarboxylic acids selected from terephthalic acids, isophthalic acids, adipic acids, succinic acids and combinations thereof.

The hydroxyl value of the polyester diol (b11) and the polyester diol (b12) is preferably 3 to 224, more preferably 5 to 112, and most preferably 10 to 56, from the viewpoint of adjustment of physical properties of the linear polyester resin (b1).

It is advisable to suitably adjust the number average molecular weight (abbreviated as "Mn") of the resin (b) (which is measured by Gel Permeation Chromatography, details of the measurement method will be described below), the melting point (which is measured by DSC) and the glass transition temperature (Tg) of the resin (b) within favorable ranges depending on the application.

In the present invention, the glass transition temperature (Tg) is a value determined by DSC measurement or flow tester measurement (if it cannot be measured by DSC).

In the DSC measurement, the glass transition temperature (Tg) is measured by the DSC method specified in ASTM D 3418-82, using a DSC measuring instrument, DSC 20, SSC/580 manufactured by Seiko Instruments Inc.

In the flow tester measurement, an elevated type flow tester, Model CFT 500 manufactured by Shimadzu Corporation, is used. Conditions for the flow tester measurement are as follows. In the present invention, every flow tester measurements are carried out under the following conditions.

(Conditions for Flow Tester Measurement)

Load applied: 30 kg/cm$^2$

Temperature increase rate: 3.0° C./min

Die aperture diameter: 0.50 mm

Die length: 10.0 mm

The number average molecular weight (Mn) of the polyester diol (b11) and the polyester diol (b12) is preferably 500 to 30,000, more preferably 1,000 to 20,000, and most preferably 2,000 to 5,000, from the viewpoint of adjustment of physical properties of the linear polyester resin (b1).

The Mn of the linear polyester resin (b1) is preferably 1,000 to 5,000,000, and more preferably 2,000 to 500,000. The melting point of the linear polyester (b1) is preferably 20° C. to 200° C., and more preferably 80° C. to 180° C. The glass transition temperature (Tg) of the linear polyester resin (b1) is preferably 20° C. to 100° C., and more preferably 40° C. to 800° C.

A chain extending agent used for chain extension of the polyester diol (b11) and the polyester diol (b12) is not particularly limited, as long as it has two functional groups which are reactable with hydroxyl groups contained in the polyester diol (b11) and the polyester diol (b12). For example, two functional groups of the after-mentioned dicarboxylic acids (13), anhydrides thereof, polyisocyanates (15) and polyepoxides (19) are exemplified. Of these, from the viewpoint of mutual solubility between the polyester diol (b11) and the polyester diol (b12), preferred are diisocyanate compounds, and dicarboxylic acid compounds. More preferred are diisocyanate compounds. Specific examples of the chain extending agent include succinic acid, adipic acid, maleic acid and anhydrides thereof, fumaric acid and anhydrides thereof, phthalic acid, isophthalic acid, terephthalic acid, 1,3- and/or 1,4-phenylene diisocyanate, 2,4- and/or 2,6-tolylene diisocyanate (TDI), 2,4'- and/or 4,4'-diphenylmethane diisocyanate (MDI), hexamethylene diisocyanate (HDI), dicyclohexyl methane-4,4'-diisocyanate (hydrogenerated MDI), isophorone diisocyanate (IPDI), and diglycidyl ether of bisphenol A. Among these, preferred are succinic acid, adipic acid, isophthalic acid, terephthalic acid, maleic acid (anhydrides thereof), fumaric acid (anhydrides thereof), HDI, and IPDI. Most preferred are maleic acid (anhydride thereof), fumaric acid (anhydride thereof), and IPDI.

The amount of the chain extending agent in the linear polyester resin (b1) is preferably 0.1% by mass to 30% by mass, and more preferably 1% by mass to 20% by mass, from the viewpoint of the transparency and thermal properties.

The amount of the linear polyester resin (b1) contained in the total amount of binder resin (the resin (b) in the resin particles (C)) may be suitably adjusted within a preferred range depending on the application, however, it is preferably 40% by mass to 100% by mass, more preferably 60% by mass to 100% by mass, and still more preferably 60% by mass to 90% by mass relative to the total amount of binder resin from the viewpoint of the transparency and thermal properties. Even when the hydroxycarboxylic acid contained in the liner polyester resin (b1) is an optically active monomer like lactic acid, if the optical purity is 80% or less, expressed in terms of a monomer converted amount, the amount described above is preferable from the viewpoint of solubility to solvents. When the optical purity is more than 80%, expressed in terms of a monomer converted amount, it is preferable that the amount of the linear polyester resin (b1) relative to the total amount of binder resin satisfy a relationship between a resin (b1) content Y (%) to the total amount of binder resin and X, of $Y \leq -1.5X + 220$, from the viewpoint of the dispersibility and solubility to solvents.

The mass ratio of the polyester diol (b11) having a polyhydroxycarboxylic acid skeleton to the polyester diol (b12) other than the polyester diol (b11) each constituting the linear polyester is preferably 31:69 to 90:10, and from the viewpoint of the transparency and thermal properties of the resin particles (C), more preferably 40:60 to 80:20.

The toner of the present invention contains at least the above-mentioned linear polyester (b1) as a binder resin (resin (b) in the resin particles (C)), and other resin can be used in combination with the linear polyester (b1). As the other binder resin that can be used in combination with the linear polyester (b1), any of conventionally known resins may be used, and it may be a thermoplastic or thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins, and polycarbonate resins. The above-mentioned resins may be used in combination. Among these resins, from the viewpoint that an aqueous dispersion of spherically-shaped fine resin particles can be easily obtained, in particular in the case of water-granulated toner, preferred are vinyl resins, polyester resins, polyurethane resins, epoxy resins, and combinations thereof; more preferred are vinyl resins, polyurethane resins; and most preferred are polyester resins and polyurethane resins each containing 1,2-propylene glycol as a component unit. As the resin other than (b1), it is also possible to use a non-linear polyester resin obtained by chain-extending a polyester diol (b11) containing a poly-α-hydroxycarboxylic acid skeleton and the after-mentioned trivalent to octavalent or more polyvalent polyol (12) by means of a chain extending agent.

The resin used in combination with the linear polyester (b1) may be a resin (b2) obtained by a reaction of a precursor (b0) in formation of the resin particles. From the perspective that particles are easily formed, a method is preferable in which an additionally used resin is added to the linear polyester (b1) using the precursor (b0). The precursor (b0) and the reaction method to obtain the resin (b2) from the precursor (b0) will be described below.

Each of the above-mentioned resins that can be additionally used with the linear polyester (b1) can be also used as a resin (a) in the resin particles (C).

The following explains in detail vinyl resins, polyester resins, polyurethane resins and epoxy resins, which are preferably used in the present invention. The vinyl resins are polymers obtained by homopolymerization or copolymerization of a vinyl monomer. As the vinyl monomer, the following vinyl monomers (1) to (10) are exemplified.

(1) Vinyl Hydrocarbon:

Aliphatic (1-1) vinyl hydrocarbon:

Alkenes such as ethylene, propylene, butene, isobutylene, pentene, heptene, diisobutylene, octane, dodecene, octadecene, α-olefins other than those described above; and alkadienes such as butadiene, isoprene, 1,4-pentadiene, 1,6-hexadiene, and 1,7-octadiene.

Alicyclic (1-2) vinyl hydrocarbon: mono- or di-cycloalkenes and alkadienes such as cyclohexene, (di)cyclopentadiene, vinyl cyclohexene, vinyl cyclohexene, ethylidene bicycloheptene; and terpenes such as pinene, limonene, and indene.

Aromatic (1-3) vinyl hydrocarbon: styrene and its hydrocarbyl (alkyl, cycloalkyl, aralkyl and/or alkenyl) substituents, for example, α-methylstyrene, vinyltoluene, 2,4-dimethylstyrene, ethylstyrene, isopropyl styrene, butyl styrene, phenyl styrene, cyclohexyl styrene, benzyl styrene, crotyl benzene, divinyl benzene, divinyl toluene, divinyl xylene, and trivinyl benzene; and vinyl naphthalene.

(2) Carboxyl Group-Containing Vinyl Monomers and Metal Salts Thereof:

Unsaturated mono-carboxylic acids having 3 to 30 carbon atoms, unsaturated dicarboxylic acids, their anhydrides, and their monoalkyl esters (having 1 to 24 carbon atoms), for example, carboxyl group-containing vinyl monomers such as (meth)acrylic acid, maleic anhydride, maleic acid monoalkyl ester, fumaric acid, fumaric acid monoalkyl ester, crotonic acid, itaconic acid, itaconic acid monoalkyl ester, itaconic acid glycol monoether, citraconic acid, citraconic acid monoalkyl ester, and cinnamic acid. Note that the term "(meth)acrylic acid" described above means an acrylic acid and/or a methacrylic acid, which will be described hereinafter in the same meaning.

(3) Sulfonic Group-Containing Vinyl Monomer, Vinyl Sulfuric Acid Monoester Compounds, and Salts Thereof:

Alkene sulfonic acids having 2 to 14 carbon atoms, for example, vinylsulfonic acid, (meth)allylsulfonic acid, methylvinylsulfonic acid, and styrene sulfonic acid; and their alkyl derivatives having 2 to 24 carbon atoms such as α-methylstyrene sulfonic acid; sulfo(hydroxy)alkyl-(meth)acrylate or (meth)acrylamide such as sulfopropyl (meth)acrylate, 2-hydroxy-3-(meth)acryloxy propyl sulfonic acid, 2-(meth)acryloylamino-2,2-dimethylethane sulfonic acid, 2-(meth)acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, C3-C18 alkylallylsulfosuccinic acid, sulfuric acid esters of poly(n=2 to 30) oxyalkylene mono(meth)acrylate (the oxyalkylene may be ethylene, propylene, or butylene; may be singularly, random or blocked) [e.g. sulfuric acid ester of poly(n=5 to 15) oxypropylene monomethacrylate], sulfuric acid ester of polyoxyethylene polycyclic phenyl ether, and sulfuric acid ester represented by any of the following General Formulas (1-1) to (1-3), or sulfonic acid group-containing monomers; salts thereof, and the like.

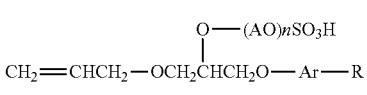

(1-1)

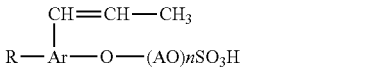

(1-2)

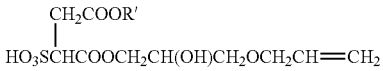

(1-3)

(In the above General Formulas, R represents an alkyl group having 1 to 15 carbon atoms; A represents an alkylene group having 2 to 4 carbon atoms, when n is a plural number, plural As may be identical to or different from each other, and when plural As are different from each other, they may be random or blocked; Ar represents a benzene ring; n is an integer of 1 to 50; and R' represents an alkyl group (having 1 to 15 carbon atoms) that may be substituted with a fluorine atom.)

(4) Phosphoric Acid Group-Containing Vinyl Monomer and Salts Thereof:

(Meth)acryloyloxyalkyl (1 to 24 carbon atoms) phosphoric acid monoesters (such as 2-hydroxyethyl (meth)acryloyl phosphate; phenyl-2-acryloyloxyethyl phosphate); (meth) acryloyloxyalkyl (1 to 24 carbon atoms) phosphonic acids (such as 2-acryloyloxyethyl phosphonic acid).

Examples of the salts described above in (2) to (4) include metal salts, ammonium salts, and amine salts (including quaternary ammonium salts). As metals forming the metal salts, Al, Ti, Cr, Mn, Fe, Zn, Ba, Zr, Ca, Mg, Na and K are exemplified.

Preferred metal salts are alkali salts, and amine salts. More preferred metal salts are sodium wax, and tertiary monoamine salts having 3 to 20 carbon atoms.

(5) Hydroxyl Group-Containing Vinyl Monomer:

Hydroxy styrene, N-methylol (meth)acrylamide, hydroxyethyl (meth)acrylate, hydroxypropyl (meth)acrylate, polyethylene glycol mono(meth)acrylate, (meth)allyl alcohol, crotyl alcohol, isocrotyl alcohol, 1-butene-3-ol, 2-butene-1-ol, 2-butene-1, 4-diol, propargyl alcohol, 2-hydroxyethyl propenyl ether, and saccharose allyl ether, and the like.

(6) Nitrogen-Containing Vinyl Monomer:

(6-1) amino group-containing vinyl monomer: aminoethyl (meth)acrylate, dimethyl aminoethyl (meth)acrylate, diethyl aminoethyl (meth)acrylate, t-butyl aminoethyl methacrylate, N-aminoethyl (meth)acrylamide, (meth)allylamine, morpholinoethyl (meth)acrylate, 4-vinylpyridine, 2-vinylpyridine, crotylamine, N,N-dimethylaminostyrene, methyl-α-acetoaminoacrylate, vinylimidazole, N-vinylpyrrole, N-vinylthiopyrrolidone, N-arylphenylenediamine, aminocarbazole, aminothiazole, aminoindole, aminopyrrole, aminoimidazole, aminomercaptothiazole, and salts thereof.

(6-2) amide group-containing vinyl monomer: (meth)acrylamide, N-methyl (meth)acrylamide, N-butyl acrylamide, diacetone acrylamide, N-methylol (meth)acrylamide, N,N'-methylene-bis(meth)acrylamide, cinnamic acid amide, N,N-dimethylacrylamide, N,N-dibenzylacrylamide, methacryl formamide, N-methyl N-vinylacetoamide, N-vinylpyrrolidone, etc.

(6-3) nitryl group-containing vinyl monomer: (meth)acrylonitrile, cyanostyrene, cyanoacrylate, and the like.

(6-4) quaternary ammonium cation group-containing vinyl monomer: quaternarized compounds (quaternarized by using a quaternarizing agent such as methylchloride, dimethylsulfuric acid, benzyl chloride, and dimethyl carbonate) of tertiary amine group-containing vinyl monomers such as dimethylaminoethyl (meth)acrylate, diethylaminoethyl (meth) acrylate, dimethylaminoethyl (meth)acrylamide, diethylaminoethyl (meth)acrylamide, and diallylamine.

(6-5) nitro group-containing vinyl monomer: nitrostyrene, and the like.

(7) Epoxy Group-Containing Vinyl Monomer:

Glycidyl (meth)acrylate, tetrahydrofurfuryl (meth)acrylate, p-vinylphenyl phenyloxide, and the like.

(8) Halogen-Containing Vinyl Monomer:

Vinyl chloride, vinyl bromide, vinylidene chloride, allyl chloride chlorostyrene, VI brom-styrene, dichlorstyrene, chloromethylstyrene, tetrafluorostyrene, chloroprene and the like.

(9) Vinyl Esters, Vinyl (thio)ethers, Vinyl Ketones, and Vinyl Sulfones:

(9-1) vinyl esters such as vinyl acetate, vinyl butylate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl α-ethoxyacrylate; alkyl (meth)acrylate having 1 to 50 carbon atoms [such as methyl (meth)acrylate, ethyl (meth)acrylate, propyl (meth)acrylate, butyl (meth)acrylate, 2-ethylhexyl (meth)acrylate, dodecyl (meth)acrylate, hexadecyl (meth) acrylate, heptadecyl (meth)acrylate, eicosyl (meth)acrylate, etc.]; dialkyl fumarate (fumaric acid dialkyl ester) (dialkyl maleates whose two alkyl groups are linear or branched chain or alicyclic group having 2 to 8 carbon atoms) (maleic acid dialkyl ester whose two alkyl groups are linear or branched chain or alicyclic group having 2 to 8 carbon atoms), poly (meth)allyloxy alkane [such as diallyloxy-ethane, triallyloxy-ethane, tetraallyloxy-ethane, tetraallyloxy-propane, tetraallyloxy-butane, tetramethallyloxy-ethane, etc.]; vinyl monomers having a polyalkylene glycol chain [such as mono (meth)acrylate (molecular weight: 300), polypropylene glycol (molecular weight: 500) monoacrylate, (meth)acrylate methyl alcohol EO 10 mole adducts of methyl alcohol (meth) acrylate, EO 30 mole adducts of lauryl alcohol (meth)acrylate, etc.], poly(meth)acrylates [such as poly(meth)acrylates of polyvalent alcohols: ethylene glycol di(meth)acrylate, propylene glycol di (meth)acrylate, neopentyl glycol di(meth) acrylate, trimethylolpropane tri(meth)acrylate, polyethylene glycol di(meth)acrylate, etc.].

(9-2) vinyl(thio) ethers such as vinylmethyl ether, vinylethyl ether, vinylpropyl ether, vinylbutyl ether, vinyl 2-ethylhexyl ether, vinylphenyl ether, vinyl 2-methoxyethyl ether, methoxybutadiene, vinyl 2-butoxyethyl ether, 3,4-dihydro-2 pyran, 2-butoxy-2'-vinyloxydiethyl ether, vinyl 2-ethylmercaptoethyl ether, acetoxy styrene, phenoxy styrene, and the like.

(9-3) vinyl ketones such as vinyl methyl ketone, vinyl ethyl ketone, vinyl phenyl ketone; vinyl sulfones such as divinyl sulfide, p-vinyl diphenyl sulfide, vinyl ethyl sulfide, vinyl ethyl sulfone, divinyl sulfone, divinyl sulfooxide, and the like.

(10) Other Vinyl Monomers:

Isocyanatoethyl (meth)acrylate, m-isopropenyl-α,α-dimethylbenzyl isocyanate, and the like.

As the vinyl resins, polymers produced by copolymerization of arbitrarily selected two or more different monomers from the above-mentioned monomers (1) to (10) are exemplified, and more preferably exemplified are those produced by copolymerization with a predetermined ratio so that the amount of carboxyl groups in the resin particles (A) is 1% to 50%. Examples of the polymers include styrene-(meth) acrylic acid ester-(meth)acrylic acid copolymers, styrene-butadiene-(meth)acrylic acid copolymers, (meth)acrylic acid-acrylic acid ester copolymers, styrene-acrylonitrile-(meth)acrylic acid-divinylbenzene copolymers, styrene-styrene sulfonic acid-(meth)acrylic acid ester copolymers, and salts of these copolymers. Among these polymers, preferred are copolymers containing, as a component unit, 20% to 80% acrylic acid ester.

Note that when a vinyl resin is used as a resin (a) which forms resin particles in an aqueous dispersion, it is necessary that the vinyl resin be not completely dissolved in water at least under the conditions of forming an aqueous dispersion. Therefore, as to the mixing ratio between a hydrophobic monomer and a hydrophilic monomer which constitute the vinyl resin, generally, the ratio of the hydrophobic monomer to be mixed with the hydrophilic monomer is preferably 10% or more, and more preferably 30% or more, although it depends on the types of monomers selected. When the ratio of the hydrophobic monomer is less than 10%, the resulting vinyl resin becomes water-soluble, which may impart the particle diameter uniformity of the resin particles (C). Note that the hydrophilic monomer means a monomer to be dissolved in a predetermined amount in water, and the hydrophobic monomer means a monomer which is not essentially miscible with water.

Examples of the polyester resin include polycondensates of polyol and a polycarboxylic acid, an anhydride of the polycarboxylic acid or a lower alkyl ester thereof; and metal salts of these polycondensates. As the polyol, a diol (11) and a trivalent to octavalent or more polyvalent polyol (12) are exemplified. As the polycarboxylic acid, the anhydride of the polycarboxylic acid or the lower alkyl ester thereof, a dicarboxylic acid (13), a trivalent to hexavalent or more polyvalent polycarboxylic acid (14), anhydrides of these acids or lower alkyl esters thereof are exemplified.

The mixing ratio of the polyol to the polycarboxylic acid, as an equivalent ratio [OH]/[COOH] of hydroxyl group [OH] content relative to carboxyl group [COOH] content in the polyester resin, is preferably 2/1 to 1/5, more preferably 1.5/1 to 1/4, and still more preferably 1/1.3 to 1/3.

To set the carboxyl group [COOH] content within the preferable range, a polyester substantially containing hydroxyl groups may be used to blend with a polycarboxylic acid.

Examples of the diol (11) include alkylene glycols having 2 to 36 carbon atoms (such as ethylene glycol, 1,2-propylene glycol, 1,3-propylene glycol, 1,4-butanediol, 1,6-hexanediol, octanediol, decandiol, dodecanediol, tetradecanediol, neopentyl glycol, 2,2-diethyl-1,3-propanediol, etc); alkylene ester glycols having 4 to 36 carbon atoms (such as diethylene glycol, triethylene glycol, dipropylene glycol, polyethylene glycol, polypropylene glycol, polytetramethylene ether glycol, etc.); alicyclic diols having 4 to 36 carbon atoms (such as 1,4-cyclohexane dimethanol, hydrogenated bisphenol A, etc.); AO [EO, PO, BO, etc.] adducts (the added mole number: 1 to 120) of the alkylene glycols or alicyclic diols described above, for example, bisphenols (AO (AO, PO, BO, etc.) adducts (the added mole number: 2 to 30) of bisphenol A, bisphenol F, bisphenol S, etc.); polylactonediols (such as poly E-caprolactonediol, etc.); and polybutadienediols.

As the diols, besides the above-mentioned diols having only hydroxyl group, a diol (11a) having a functional group other than hydroxyl group may also be used. Examples of the diol (11a) include diols having a carboxyl group, diols having a sulfonic acid group or sulfamic acid group, and salts thereof.

Examples of the diols having a carboxyl group include dialkylolalkanoic acids having 6 to 24 carbon atoms [such as 2,2-dimethylolpropyonic acid (DMPA), 2,2-dimethylolbutanoic acid, 2,2-dimethylolheptanoic acid, and 2,2-dimethyloloctanoic acid.

Examples of the diols having a sulfonic acid group or sulfamic acid group include sulfamic acid diols [such as N N-bis(2-hydroxyalkyl) sulfamic acids (whose alkyl group has 1 to 6 carbon atom(s)) or AO adducts thereof (AO includes E, PO or the like, the added mole number: 1 to 6): for example, N,N-bis(2-hydroxyethyl) sulfamic acid, PO-2 mole adducts of N,N-bis(2-hydroxyethyl) sulfamic acids; and bis(2-hydroxyethyl) phosphates.

Examples of neutralized bases of these diols include the tertiary amines having 3 to 30 carbon atoms (such as triethylamine) and/or alkali metals (such as sodium salt).

Among these, preferred are alkylene glycols having 2 to 12 carbon atoms, diols having a carboxyl group, AO adducts of bisphenols, and combinations thereof.

Examples of the trivalent to octavalent or more polyvalent polyol (12) include trivalent to octavalent or more aliphatic polyvalent alcohols having 3 to 36 carbon atoms (alkane polyols, and intermolecular or intramolecular dehydration products thereof such as glycerine, trimethylolpropane, pentaerythritol, sorbitol, sorbitan, and polyglycerine; saccharides and derivatives thereof such as saccharose, and methyl glucosides); AO adducts of aliphatic polyvalent alcohols (the added mole number: 2 to 120); AO adducts (the added mole number: 2 to 30) of trisphenols (trisphenol PA, etc.); AO adducts (the added mole number: 2 to 30) of novolak resins (phenol novolak resins, cresol novolak resins, etc.); and acryl polyols [copolymers between hydroxyethyl (meth)acrylate and other vinyl monomers]. Among these, preferred are trivalent to octavalent or more polyvalent aliphatic alcohols, and AO adducts of novolak resins, and more preferred are AO adducts of novolak resins.

Examples of the dicarboxylic acid (13) include alkane dicarboxylic acids having 4 to 36 carbon atoms (succinic acid, adipic acid, sebacic acid, azelaic acid, dodecanedicarboxylic acid, octadecanedicarboxylic acid, decylsuccinic acid, etc.) and alkenylsuccinic acids (dodecenylsuccinic acid, pentadecenylsuccinic acid, octadecenylsuccinic acid, etc.); alicyclic dicarboxylic acids having 6 to 40 carbon atoms [dimer acids (dimerized linoleic acids) etc.], alkenedicarboxylic acids having 4 to 36 carbon atoms (maleic acid, fumaric acid, citraconic acid, etc.); and aromatic dicarboxylic acids having 8 to 36 carbon atoms (phthalic acid, isophthalic acid, terephthalic acid, naphthalene dicarboxylic acid, etc.).

Among these, preferred are alkenedicarboxylic acids having 4 to 20 carbon atoms, and aromatic dicarboxylic acids having 8 to 20 carbon atoms.

Examples of the trivalent to hexavalent or more polyvalent polycarboxylic acid (14) include aromatic polycarboxylic acids having 9 to 20 carbon atoms (trimellitic acid, pyromellitic acid, etc.).

It should be noted that as for the dicarboxylic acid (13) or trivalent to hexavalent or more polyvalent polycarboxylic acid (14), an acid anhydride thereof or a lower alkyl ester having 1 to 4 carbon atoms (methyl ester, ethyl ester, isopropyl ester, etc.) may be used.

Examples of the polyurethane resins include polyadducts between polyisocyanate (15) and an active-hydrogen-containing compound {water, polyol [diol (11) [including diol (11a) having a functional group other than hydroxyl groups), and trivalent to octavalent or more polyvalent polyol (12)]; polycarboxylic acids [dicarboxylic acid (13), and trivalent to hexavalent or more polyvalent polycarboxylic acid (14)], polyester polyol obtained by polycondensation of polyol with a polycarboxylic acid, ring-opening polymers of lactone having 6 to 12 carbon atoms, polyamine (16), polythiol (17), and combination thereof, etc.}, and amino group-containing polyurethane resins obtained by reaction of an isocyanate group terminated prepolymer obtained by reaction between polyisocyanate (15) and an active hydrogen-containing compound with primary and/or secondary monoamine (18) in an equivalent amount to that of isocyanate groups of the prepolymer.

The amount of carboxyl groups contained in the polyurethane resin is preferably 0.1% to 10%.

As for the diol (11), trivalent to octavalent or more polyvalent polyol (12), dicarboxylic acid (13) and trivalent to hexavalent or more polyvalent polycarboxylic acid (14), those described above are exemplified, and preferred ones are also the same as described as above.

Examples of the polyisocyanate (15) include aromatic polyisocyanates having 6 to 20 carbon atoms (excluding carbon atoms in NCO groups, hereinafter, the same unless otherwise specified), aromatic polyisocyanates having 6 to 20, aliphatic polyisocyanates having 2 to 18, alicyclic polyisocyanates having 4 to 15 carbon atoms, aromatic-aliphatic polyisocyanates having 8 to 15 carbon atoms, and modified products of these polyisocyanates (such as urethane group-, carbodiimide group-, allophanate group-, urea group-, biuret group-, urethodione group-, urethoimine group-, isocyanurate group- or oxazolidine group-containing modified products, etc.), and mixtures of two or more of them.

Specific examples of the aromatic polyisocyanates include 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [crude diaminophenyl methane [condensation products of formaldehyde and aromatic amine (aniline) or a mixture thereof; mixtures of diaminodiphenyl methane and a small amount (for example, 5% to 20%) of trifunctional or higher polyamine]: polyallyl polyisocyanate (PAPI)], 1,5-naphthylene diisocyanate, 4,4',4"-triphenylmethane triisocyanate, and m-and-p-isocyanatophenyl-sulfonyl-isocyanate. Specific examples of the aliphatic polyisocyanate include aliphatic polyisocyanates such as ethylene diisocyanate, tetramethylene diisocyanate, hexamethylene diisocyanate (HDI), dodecamethylene diisocyanate, 1,6,11-undecane triisocyanate, 2,2'4-trimethyl hexamethylene diisocyanate, lysine diisocyanate, 2,6-diisocyanato methylcaproate, bis(2-isocyanatoethyl) fumarate, bis (2-isocyanatoethyl) carbonate, and 2-isocyanatoethyl-2,6-diisocyanato hexanoate. Examples of the alicyclic polyisocyanate include isophoronediisocyanate (IPDI), dicyclohexylmethane-4,4'-diisocyanate (hydrogenated MDI), cyclohexylene diisocyanate, methylcyclohexylaene diisocyanate (hydrogenated TDI), bis(2-isocyanatoethyl)-4-cyclohexane-1,2-dicarboxylate, and 2,5- and/or 2,6-norbornane diisocyanate. Examples of the aromatic-aliphatic polyisocyanate include m- and/or p-xylylene diisocyanate (XDI),α,α,α,α-tetramethylxylylene diisocyanate (TMXDI). As to the modified products of the polyisocyanates, urethane group-, carbodiimide group-, allophanate group-, urea group-, biuret group-, urethodione group-, urethoimine group-, isocyanurate group- or oxazolidine group-containing modified products are exemplified. Specific examples thereof include modified MDI (such as urethane-modified MDI, carbodiimide-modified MDI, and trihydrocarbylphosphate-modified MDI), and modified products of polyisocyanates, such as urethane-modified TDI, and mixtures of two or more of them [for example, a combination of modified MDI and urethane-modified TDI (isocyanate-containing prepolymer). Among these, preferred are aromatic polyisocyanates having 6 to 15 carbon atoms, aliphatic polyisocyanates having 4 to 12 carbon atoms, and alicyclic polyisocyanates having 4 to 15 carbon atoms. Particularly preferred are TDI, MDI, HDI, hydrogenated MDI, and IPDI.

Examples of the polyamine (16) include aliphatic polyamines (C2-C18):[1] aliphatic polyamine {C2-C6 alkylene diamine (such as ethylene diamine, propylene diamine, trimethylene diamine, tetramethylene diamine, hexamethylene diamine), polyalkylene (C2-C6) polyamine [such as diethylene triamine, iminobis-propylamine, bis(hexamethylene) triamine, triethylene tetramine, tetraethylene pentamine, and pentaethylene hexamine]}; [2] alkyl-(C1-C4) or hydroxyalkyl (C2-C4)-substituted compounds thereof [such as dialkyl (C1-C3) aminopropyl amine, trimethyl hexamethylene diamine, aminoethyl ethanol amine, 2,5-dimethyl-2,5-hexamethylene diamine, and methyliminobispropyl amine]; [3] alicyclic or heterocyclic ring-containing aliphatic polyamine [such as 3,9-bis(3-aminopropyl)-2,4,8,10-tetraoxaspiro[5,5] etc.]; [4] aromatic ring-containing aliphatic amines (C8-C15) (xylylene diamine, and tetrachloro-p-xylylene diamine), alicyclic polyamine (C4-C15): 1,3-diaminocyclohexane isophorone diamine, mensenediamine, 4,4'-methylene dicyclohexane diamine (such as hydrogenated methylene dianiline), heterocyclic polyamine (C4-C15): piperazine, N-aminoethyl piperazine, 1,4-diaminoethyl piperazine, and 1,4-bis(2-amino-2-methylpropyl)piperazine or the like; aromatic polyamines (C6-C20): [1] unsubstituted aromatic polyamine [1,2-, 1,3- and 1,4-phenylene diamine, 2,4'- and 4,4'-diphenylmethane diamine, crude diphenylmethane diamine (polyphenylpolymethylene polyamine), diaminodiphenyl sulfone, benzidine, thiodianiline, bis(3,4-diaminophenyl)sulfone, 2,6-diaminopyridine, m-aminobenzylamine, triphenylmethane-4,4',4"-triamine, naphthylene diamine, etc.; [2] aromatic polyamine having a nucleus-substituted alkyl group [C1-C4 alkyl group such as methyl, ethyl, n- and i-propyl, butyl, or the like], for example, 2,4- and 2,6-tolylene diamine, crude tolylene diamine, diethyltolylene diamine, 4,4'-diamino-3,3'-dimethyldiphenyl methane, 4,4'-bis(O-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3,5,5-tetramethylbenzidine, 3,3,5,5-tetramethyl-4,4'-diaminophenyl methane, 3,5-diethyl-3'-methyl-2',4-diaminodiphenyl methane, 3,3'-diethyl-2,2'-diaminodiphenyl methane, 4,4-diamino-3,3'- dimethyldiphenyl methane, 3,3,5,5-tetraethyl-4,4-diaminobenzophenone, 3,3,5,5-tetraethyl-4,4'-diaminodiphenyl ether, 3,3,5,5-tetrapropyl-4,4'-diaminodiphenyl sulfone, etc.], and mixtures of isomers containing them in various amount: [3] aromatic polyamine having a nucleus-substituted electron-attractive group (halogen such as Cl, Br, I, F or the like); alkoxy group such as methoxy and ethoxy: nitro group, or the like) [methylene-bis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3-dichlorobenzidine, 3,3-dimethoxybenzidine, bis(4-amino-3-chlorophenyl)oxide, bis(4-amino-2-chlorophenyl)propane, bis(4-amino-2-chlorophenyl)sulfone, bis-4-amino-3-methoxyphenyl) decane, bis(4-aminophenyl)sulfide, bis(4-aminophenyl) telluride, bis(4-aminophenyl)selenide, bis(4-amino-3-methoxyphenyl)disulfide, 4,4-methylene bis(2-iodoaniline), 4,4-methylene bis(2-bromoaniline), 4,4-methylene bis(2-fluoroaniline), 4-aminophenyl-2-chloroaniline, etc.]; [4] aromatic polyamine having a secondary amino group [those in which a part of or all of —$NH_2$ groups of the aromatic polyamines described above in [1] to [3] are substituted with —NH—R' (R' represents an alkyl group, for example, lower alkyl groups such as methyl, and ethyl)][4,4-di(methylamino)diphenylmethane, 1-methyl-2-methylamino-4-aminobenzene, etc.], polyamide polyamine: a low-molecular weight polyamide polyamine obtained by polycondensation of a dicarboxylic acid (dimer acid, etc.) with an excessive amount (2 moles or more per 1 mole acid) of polyamines (the above-mentioned alkylene diamine, polyalkylene polyamine, etc.), and polyether polyamine such as hydrogenerated products of cyanoethylated compounds (polyalkylene glycol, etc.)

Examples of the polythiol (17) include alkanedithiols having 2 to 36 carbon atoms (ethylenedithiol, 1,4-butanethiol, 1,6-hexanedithiol, etc.)

Examples of the primary and/or secondary monoamine (18) include alkylamines having 2 to 24 carbon atoms (ethylamine, butylamine, isobutylamine, etc.).

Examples of the epoxy resins include ring-opening polymers of polyepoxides (19) and polyadducts between the polyepoxide (19) and an active-hydrogen-containing compound {water, polyol [the diol (11), and trivalent to octavalent or more polyvalent polyol (12)]; polycarboxylic acids [the dicarboxylic acid (13), and the trivalent to hexavalent or more polyvalent polycarboxylic acid (14), the polyamine (16), the polythiol (17) etc.}, and hardened resins obtained using the polyepoxide (19) and an acid anhydride of the dicarboxylic acid (13) or the trivalent to hexavalent or more polyvalent polycarboxylic acid (14).

The polyepoxide (19) used in the present invention is not particularly limited as long as it has two or more epoxy groups in its molecule. Preferred polyepoxides (19) are those having 2 to 6 epoxy groups in each of their molecules, from the perspective of mechanical properties of the resulting hardened resins. The epoxy molar equivalent of the polyepoxide (19) (molecular weight per one epoxy group) is preferably 65 to 1,000, and more preferably 90 to 500. When the epoxy molar equivalent is more than 1,000, the crosslinked structure becomes loosened, resulting in degradation of physical properties, such as the water resistance, agent resistance, mechanical strength, of the resulting hardened resin. In contrast, it is difficult to synthesize a hardened resin with an epoxy molar equivalent of less than 65.

As the polyepoxide (19), aromatic polyepoxy compounds, heterocyclic polyepoxy compounds, alicyclic polyepoxy compounds, and aliphatic polyepoxy compounds are exemplified. Examples of the aromatic polyepoxy compounds include glycidyl ethers and/or glycidyl esters of polyvalent phenol, glycidyl aromatic polyamines, and glycidylized compounds of aminophenol. Examples of the glycidyl ethers of polyvalent phenol include glycidyl ether of bisphenol F, glycidyl ether of bisphenol A, glycidyl ether of bisphenol B, glycidyl ether of bisphenol AD, glycidyl ether of bisphenol S, halogenated bisphenol A, diglycidyl tetrachloro bisphenol A glycidyl ether, catechin glycidyl ether, resorcinol diglycidyl ether, hydroquinone diglycidyl ether, pyrogallol triglycidyl ether, 1,5-dihydroxynaphthaline diglycidyl ether, dihydroxybiphenyl diglycidyl ether, octachloro-4,4'-dihydroxybiphenyl diglycidyl ether, tetramethylbiphenyl diglycidyl ether, dihydroxynaphthylcresol triglycidyl ether, tris(hydroxyphenyl)methanetriglycidyl ether, dinaphthyl triol triglycidyl ether, tetrakis(4-hydroxyphenyl)ethane tetraglycidyl ether, p-glycidylphenyl dimethyl triol bisphenol A glycidyl ether, trismethyl-tert-butyl-butylhydroxymethane triglycidyl ether, 9,9'-bis(4-hydroxyphenyl)fluorene diglycidyl ether, 4,4'-oxybis(1,4-phenylethyl)tetracresol glycidyl ether, 4,4'-oxybis(1,4-phenylethyl)phenylglycidyl ether, bis(dihydroxynaphthalene)tetraglycidyl ether, phenol or cresol novolak resin glycidyl ether, limonene phenol novolak resin glycidyl ether, diglycidyl ether obtained by the reaction between 2 moles of bisphenol A and 3 moles of epichlorohydrin, polyphenol polyglycidyl ether obtained by a condensation reaction of phenol with glyoxazal, glutaraldehyde or formaldehyde, polyphenol polyglycidyl ether obtained from a condensation reaction of resorcin and acetone. As the glycidyl ester of polyvalent phenol, diglycidyl phthalate, diglycidyl isophthalate, and diglycidyl terephthalate are exemplified. As the aromatic glycidyl polyamine, N,N-diglycidylaniline, N,N,N',N'-tetraglycidyl xylylene diamine and N,N,N',N'-tetraglycidyldiphenylmethane diamine are exemplified. Further, examples of the aromatic polyepoxy compound, in the present invention, also include a p-aminophenol triglycidyl ether, a diglycidylurethane compound obtained by an addition reaction of tolylene diisocyanate or diphenylmethanediisocyanate with glycidol, a glycidyl group-containing polyurethane (pre)polymer obtained by a reaction of one of the above reaction products with polyol, and diglycidyl ether of a bisphenol A alkylene oxide (ethylene oxide or propylene oxide) adduct. Examples of the heterocyclic polyepoxy compounds include trisglycidyl melamine: Examples of the alicyclic polyepoxy compounds include vinylcyclohexane dioxide, limonene dioxide, dicyclopentadiene dioxide, bis(2,3-epoxycyclopentyl) ether, bis-epoxy dicyclopentyl ether of ethylene glycol, 3,4-epoxy-6-methylcyclohexyl-methyl-3',4'-epoxy-6-methyl cyclohexane carboxylate, bis(3,4-epoxy-6-methylcyclohexylmethyl)adipate, bis(3,4-epoxy-6-methylcyclohexylmethyl)butylamine, and diglycidyl ester of dimer acid. Further, examples of the alicyclic polyepoxy compounds also include nucleus-hydrogenated products of the above-mentioned aromatic polyepoxy compounds. Examples of the aliphatic polyepoxy compounds include polyglycidyl ethers of aliphatic polyvalent alcohol, polyglycidyl esters of polyvalent fatty acid, and glycidyl aliphatic amine. Examples of the aliphatic polyvalent alcohol include ethylene glycol glycidyl ether, propylene glycol glycidyl ether, tetramethylene glycol glycidyl ether, 1,6-hexanediol glycidyl ether, polyethylene glycol glycidyl ether, polypropylene glycol glycidyl ether, polytetramethylene glycol glycidyl ether, neopentyl glycol glycidyl ether, trimethylolpropane glycidyl ether, glycerol polyglycidyl ether, pentaerythritol polyglycidyl ether, sorbitol polyglycidyl ether, and polyglycerol polyglycidyl ether. Examples of the polyglycidyl ester of polyvalent fatty acid include diglycidyl oxalate diglycidyl malate, diglycidyl maleate, diglycidyl succinate, diglycidyl glutarate, diglycidyl adipate, and diglycidyl pimelate. Examples of the glycidyl aliphatic amine include N,N,N',N'-tetraglycidyl hexamethylenediamine. Further, examples of the polyglycidyl ethers of polyvalent aliphatic alcohol also include glycidyl ether, and (co)polymers of glycidyl (meth)acrylate. Among these, preferred are aliphatic polyepoxy compounds and aromatic polyepoxy compounds. As for the polyepoxide of the present invention, two or more of these polyepoxy compounds may be compounded.

The use amount of the binder resins other than the above-mentioned linear polyester resins (b1) may be suitably adjusted, depending on the application, so that it falls within a preferred range, however, from the viewpoint of the transparency and thermal properties, it is preferably 0% by mass to 60% by mass, and more preferably 10% by mass to 40% by mass relative to the total amount of the binder resins used.

In the present invention, the number average molecular weight (abbreviated as "Mn", which is determined by gel permeation chromatography, detailed description of the measurement method will be described below) of binder resins, such as polyester resins, other than polyurethane resins may be suitably adjusted, depending on the application, so that it falls within a preferred range. The melting point (measured by DSC), the glass transition temperature Tg (the measurement method is described above), the sp value (the calculation of sp value is according to the method described in "Polymer Engineering and Science, February, 1974, Vol. 14, No. 2 pp. 147-154) of the binder resins may also be suitably adjusted, depending on the application, so that each falls in a preferred range.

The Mn of a binder resin additionally used is preferably 1,000 to 5,000,000, and more preferably 2,000 to 500,000. The melting point of the binder resin is preferably 20° C. to 300° C., and more preferably 80° C. to 250° C. The Tg of the binder resin is preferably 20° C. to 200° C., and more preferably 40° C. to 200° C. Further, the sp value of the binder resin is preferably 8 to 16, and more preferably 9 to 14.

The number average molecular weight (Mn) and the weight average molecular weight (hereinbelow, abbreviated as "Mw") of a binder resin are measured for a tetrahydrofuran (THF) soluble fraction for the tetrahydrofuran (THF)-soluble fraction by Gel permeation Chromatography (GPC), under the following conditions:

Apparatus (e.g.): HLC-8120, manufactured by Tosoh Corporation

Column (e.g.): TSK-GEL GMHXL (two columns)

:TSK-GEL MULTIPORE HXL-M (one column)

Sample solution: 0.25% THF solution

Injected amount of sample solution: 100 μL

Flow rate: 1 mL/min

Measurement temperature: 40° C.

Detection device: refractive index detector

Reference material: standard polystyrene, produced by Tosoh Corporation (TSK Standard POLYSTYRENE) 12 types (molecular weight: 500, 1,050, 2,800, 5,970, 9,100, 18,100, 37,900, 96,400, 190,000, 355,000, 1090,000, 2,890, 000)

The Mn and Mw of a polyurethane resin are measured by GPC, under the following conditions:

Apparatus (e.g.): HLC-8220GPC, manufactured by Tosoh Corporation

Column (e.g.): Guard column αTSK-GELα-M

Sample solution: 0.125% dimethyl formaldehyde solution

Injected amount of sample solution: 100 μL

Flow rate: 1 mL/min

Measurement temperature: 40° C.

Detection device: refractive index detector

Reference material: standard polystyrene, produced by Tosoh Corporation (TSK Standard POLYSTYRENE) 12 types (molecular weight: 500, 1,050, 2,800, 5,970, 9,100, 18,100, 37,900, 96,400, 190,000, 355,000, 1090,000, 2,890, 000)

The toner of the present invention optionally contains a wax (c). As the wax (c), polyolefin wax, paraffin wax, carbonyl group-containing wax, and mixtures thereof are exemplified. Among these waxes, paraffin wax is particularly preferred, and a petroleum wax mainly containing a saturated linear hydrocarbon having a melting point of 50° C. to 90° C. and 20 to 36 carbon atoms is exemplified. From the viewpoint of releasing property, the Mn of the wax (c) is preferably 400 to 5,000, more preferably 1,000 to 3,000, and particularly preferably 1,500 to 2,000. Note that in the description described above and below, the Mn of wax is measured by GPC (solvent: orthodichloro-benzene, reference material: polystyrene).

It is preferable that the wax (c) be dispersed in the binder resin after being melt-kneaded together with a modified wax (d) onto which vinyl polymer chains are grafted, in absence of solvent and/or being heated, dissolved and mixed in presence of an organic solvent (u). With this method, wax groups of the modified wax (d) efficiently adsorb to the surface of the wax (c), or a part of the wax groups entangle mutually in the matrix structure of the wax (c), so that the affinity between the surface of the wax (c) and the polyester resin (b1) is improved, thereby the wax (c) is more uniformly incorporated into the polyester resin (b1), making it possible to easily control the dispersion state.

The modified wax (d) is a wax onto which vinyl polymer chains are grafted. As a wax used for the wax (d), those same as the wax (c) are exemplified, and preferred ones are also the same as described above for he wax (c). As a vinyl monomer constituting the vinyl polymer chains of the wax (d), the same monomers as the above-mentioned monomers (1) to (10) which constitute the vinyl resin are exemplified. Among these monomers, particularly preferred are the monomers described in (1), (2) and (6). The vinyl polymer chains may form a monopolymer or copolymer structure.

The amount of wax components (including unreacted wax components) in the modified wax (d) is preferably 0.5% to 99.5%, more preferably. 1% to 80%, still more preferably 5% to 50%, and most preferably 10% to 30%. Also, from the viewpoint of heat resistant-storable stability of the resin particles (C), the glass transition temperature (Tg) of the modified wax (d) is preferably 40° C. to 90° C., and more preferably 50° C. to 80° C. The Mn of the modified wax (d) is preferably 1,500 to 10,000, and still more preferably 1,800 to 9,000. When the Mn is within the range of from 1,500 to 10,000, the resulting toner will have sufficient mechanical strength.

The modified wax (d) can be obtained, for example, by the method described below. That is, the wax (c) is dissolved or dispersed in an organic solvent (e.g. toluene or xylene) to prepare a solution or dispersion liquid, and the solution or dispersion liquid is heated at 100° C. to 200° C., and then a vinyl monomer is delivered by drops, along with a peroxide initiator (such as benzoyl peroxide, ditertiary butyl peroxide, tertiary butyl peroxide benzoate), into the solution or dispersion so as to be polymerized, and the solvent is distilled away to thereby obtain a modified wax. The amount of the peroxide initiator used in the synthesis for the modified wax (d) is based on the total mass of starting materials of the modified wax (d) and is preferably 0.2% to 10%, and more preferably 0.5% to 5%.

As the peroxide polymerization initiator, an oil-soluble peroxide polymerization initiator, a water-soluble peroxide polymerization initiator, or the like is used. Specific examples of these initiators are those described above.

As a method of mixing the wax (c) and the modified wax (d), the following methods are exemplified: [1] the wax (c) and the modified wax (d) are melt-kneaded at a temperature higher than their individual melting points; [2] the wax (c) and the modified wax (d) are dissolved or suspended in an organic solvent (u), and then precipitated in a liquid by cooling crystallization, solvent crystallization, etc., or precipitated in a gaseous medium by spray-drying or the like; and [3] the wax (c) and the modified wax (d) are dissolved or suspended in an organic solvent (u) and then wet pulverized by a dispersing device. As a method of dispersing the wax (c) and the modified wax (d) in the polyester resin (b1), the following method is exemplified: the wax (c), modified wax (d) and polyester resin (b1) are respectively melt-kneaded, or respectively dissolved and/or dispersed in a solvent to prepare individual solutions and/or dispersion liquids, and then these individual solutions and/or dispersion liquids are mixed with each other.

It is preferred to add, as additives, into resin particles (B), the wax (c) and the modified wax (d) whose vinyl polymer chains are grafted with the wax (c) along with the resin (b), in terms that the heat-resistant storage stability is further improved. The amount of the wax (c) added relative to the total amount of binder resins is preferably 20% by mass or less, and more preferably 1% by mass to 15% by mass. The amount of the modified wax (d) added relative to the total amount of binder resins is preferably 10% by mass or less, and more preferably 0.5% by mass to 8% by mass. The total additive amount of the wax (c) and modified wax (d) is preferably 25% by mass or less, and more preferably 1% by mass to 20% by mass.

As the waxes (releasing agents), any of conventionally known waxes can be used. In particular, a de-free fatty acid carnauba wax, polyethylene wax, montan wax and oxidized rice wax can be used alone or in combination. As the carnauba wax, it is preferred to use a wax in the form of microscopic crystalline particles, which has an acid value of 5 or less and particle diameters of 1 or smaller when dispersed in a toner binder. The montan wax generally means a montan wax purified from minerals, and the montan wax is preferably in the form of microscopic crystalline particles similarly to the carnauba wax, and has an acid value of 5 to 14. The oxidized rice wax is produced by oxidizing a rice bran wax in the air, and preferably has an acid value of 10 to 30. The reason of use of these waxes is that they can be moderately finely dispersed in the toner binder resin of the present invention, thereby making it possible to readily obtain a toner which is superior in anti-offset property, transferability and durability. These waxes may be used alone or in combination.

As releasing agents other than described above, any of conventionally known releasing agents, such as solid silicone wax, higher fatty acid alcohol, montan ester wax, polyethylene wax and polypropylene wax, can be used in the form of a mixture.

The glass transition temperature (Tg) of the releasing agent(s) used in the toner of the present invention is preferably 70° C. to 90° C. When the Tg is lower than 70° C., the heat-resistant storage property of the resulting toner degrades, and when it is higher than 90° C., the releasability cannot be sufficiently exhibited in low temperature conditions, causing degradation of anti-cold offset property and paper-winding to a fixing device. The amount of these releasing agents used relative to the toner resin components is preferably 1% by mass to 20% by mass, and more preferably 3% by mass to 10% by mass. When the amount is less than 1% by mass, the effect of anti-offset property of the resulting toner is insufficient, and when it is more than 20% by mass, the transferability and durability of the resulting toner degrade.

(Colorant)

The colorant used in the present invention is not particularly limited and may be suitably selected from among commonly used resins. Examples of the colorant include carbon black; azine pigments, metal salt azo pigments, metal oxides and metal complex oxides such as oil furnace black, channel black, lamp black, acetylene black, aniline black; Nigrosine dyes, black iron oxide, Naphthol Yellow 5, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, mineral fast yellow, nickel titan yellow, navel yellow, colcothar, red lead oxide, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, lithol red, watching red calcium salt, Lake Red D, Brilliant Carmine 6B, Brilliant Carmine 3B, Chrome Vermilion, Benzidine Orange, perynone orange, Oil Orange, molybdenum orange, Permanent Orange GTR, pyrazolone orange, Vulcan Orange, Indanthrene Brilliant Orange RK, Benzidine Orange G, Indanthrene Brilliant Orange GK, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, partially chlorinated pigments of alkali blue and phthalocyanine blue; Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, lithopone, and mixtures thereof.

The amount of the colorant contained in the toner is preferably 1 part by mass to 15 parts by mass, and more preferably 3 parts by mass to 10 parts by mass.

The colorant used in the present invention may also be used as a masterbatch obtained by combining with a resin. As the binder resin to be kneaded along with a masterbatch, it is possible to use various resins usable for the binder resins in the present invention described above.

The masterbatch can be obtained by mixing and kneading the resin for masterbatch and the colorant under application of high shear force. On that occasion, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used. To mix and knead the resin for masterbatch and the colorant, for example, a high-shearing force type dispersing machine such as a two-roll, three-roll mill or the like is preferably used.

The amount of the masterbatch used is preferably 0.1 parts by mass to 20 parts by mass relative to 100 parts by mass of the binder resin.

It is preferred that the resin used for the masterbatch be dispersed in the state of the acid value being 30 mgKOH/g or less and the colorant being dispersed. More preferably, the acid value is 20 mgKOH/g or less. When the acid value is more than 30 mgKOH/g, the chargeability may degrade under high-humidity conditions and the pigment-dispersibility may become insufficient. Note that the acid value can be measured by the method specified in JIS K 0070.

Also, a pigment dispersant may be used along with the resin for masterbatch and the colorant. From the perspective of the pigment dispersibility, the pigment dispersant preferably has high solubility with the binder resin. Specific examples of commercially available pigment dispersant products include "AJISPER PB 821". "AJISPER PB 822" (produced by Ajinomoto Fine-Techno Co., Inc.); "DISPER BYK-2001" (produced by BykChemie Co.); and "EFKA-4010" (produced by EFKA Co.).

The pigment dispersant is preferably mixed in an amount of 0.1% by mass to 10% by mass to the colorant in the toner. When the mixing amount of the pigment dispersant is less than 0.1% by mass, the pigment dispersibility may become insufficient. When the mixing amount is more than 10% by mass, the chargeability of the resulting toner may degrade under high-humidity conditions.

(Magnetic Material)

In the present invention, the toner may contain a magnetic material along with the binder resin and the colorant.

The following are examples of magnetic materials usable in the present invention: (1) magnetic iron oxides such as magnetite, maghemite, and ferrite, and iron oxides containing other metal oxides; (2) metals such as iron, cobalt, and nickel, or metal alloys of these metals with other metals such as copper, lead, magnesium, tin, zinc, antimony, beryllium, bismuth, cadmium, calcium, manganese, selenium, titanium, tungsten, and vanadium; and (3) mixtures thereof.

Specific examples of the magnetic material include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. These magnetic materials may be used alone or in combination. Among these, fine powders of ferrosoferric oxide and $\gamma$-iron sesquioxide.

It is also possible to use magnetic iron oxides of magnetite, maghemite, ferrite etc. each containing different types of elements, or mixtures thereof. Examples of the different types of elements include lithium, beryllium, boron, magnesium, aluminum, silicon, phosphorus, germanium, zirconium, tin, sulfur, calcium, scandium, titanium, vanadium, chrome, manganese, cobalt, nickel, copper, zinc, and gallium. Preferred different types of elements are selected from magnesium, aluminum, silicon, phosphorous, and zirconium. The different types of elements may be incorporated into an iron oxide crystal lattice, or may be incorporated in an iron oxide as an oxide, or may be present as an oxide or a hydroxide on a surface of an iron oxide, however, is preferably contained in an iron oxide.

Each of the different types of elements may be mixed with its individual salt thereof in the form of a mixture at the time of production of a magnetic material and incorporated into particles by pH adjustment. Alternatively, each of the different types of elements may be precipitated on the surface of magnetic particles after production of the magnetic particles by subjecting to pH adjustment or by subjecting to pH adjustment after adding its salt thereto.

The amount of the magnetic material used is preferably 10 parts by mass to 200 parts by mass, and more preferably 20 parts by mass to 150 parts by mass relative to 100 parts by mass of the binder resin. The number average particle diameter of these magnetic materials is preferably 0.1 μm to 2 μm, and more preferably 0.1 μm to 0.5 μm. The number average particle diameter can be determined by using a digitizer after observation of a magnified image via an electron transmission microscope.

As to magnetic properties of the magnetic material under application of a magnetic field of 10 K oersteds, it is preferable that its coercive force be within the range of 20 oersteds to 150 oersteds, its saturated magnetization force be within the range of 50 emu/g to 200 emu/g and its residual magnetization force be within the range of 2 emu/g to 20 emu/g.

The magnetic material can also be used as a colorant.

(Charge Controlling Agent)

The toner of the present invention optionally contains a charge controlling agent (CCA) as necessary.

As the charge controlling agent, any of conventionally known charge controlling agents can be used. Examples thereof include nigrosine dyes, chrome-containing metal complex dyes, molybdic acid chelate pigments, rhodamine dyes, alkoxy-based amines, quaternary ammonium salts (including fluorine-modified quaternary ammonium salt), alkylamides, single body of phosphorus or compound thereof, single body of tungsten or compound thereof, fluorochemical surfactants, salicylic acid metal salts, and metal salts of salicylic acid derivative. Specific examples thereof include BONTRON 03 of nigrosine dye, BONTRON P-51 of ternary ammonium salt, BONTRON S-34 of metal-containing azo dye, E-82 of oxy naphthoatic acid-based metal complex, E-84 of salicylic acid-based metal complex, and E-89 of phenolic condensate (produced by ORIENT CHEMICAL); TP-302 and TP-415 of ternary ammonium salt molybdenum complex (produced by HODOGAYA CHEMICAL); COPY CHARGE PSY VP2038 of ternary ammonium salt, COPY BLUE PR of triphenyl methane derivative, COPY CHARGE NEG VP2036 of ternary ammonium salt, COPY CHARGE NX, and VP434 (produced by Hoechst AG); LRA-901 and LR-147 of boron complex (produced by NIPPON CARLIT); copper phthalocyanine, perylene, quinacridone, and azo pigments; and other polymer compounds having a functional group such as sulfonic group, carboxyl group, quaternary ammonium salt or the like.

In the present invention, the amount of the charge controlling agent used cannot be unequivocally defined, as it is determined depending on the type of binder resin and the presence or absence of additives used in accordance with the necessity, however, it is used within the range of 0.1 parts by mass to 10 parts by mass, and more preferably used within the range of 0.2 parts by mass to 5 parts by mass relative to 100 parts by mass of the binder resin. When the amount of the charge controlling agent is more than 10 parts by mass, the effect of the primary charge controlling agent is impaired due to excessively high chargeability of the toner to increase, the electrostatic attraction force to a developing roller, leading to degradation in flowability of the developer and degradation in image density. Each of these charge controlling agents may be dissolved and/or dispersed after being melt-kneaded along with the masterbatch and resin, or may be directly added in an organic solvent when dispersed. Alternatively, the charge controlling agent may be solidified on the surfaces of toner base particles after preparation of the toner base particles.

As other charge controlling agents (CCA), azine-based dyes (Japanese Patent Application Publication (JP-B) No. 42-1627), and basic dyes are exemplified. Examples thereof include C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), to C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), C.I. Basic Green 4 (C.I. 42000) and lake pigments of these basic dyes; C.I. Solvent Black 8 (C.I. 26150), quaternary ammonium salts such as benzoyl methyl hexadecyl ammonium chloride and decyl trimethyl chloride, or dialkyl tin compounds such as dibutyl or dioctyl tin compounds, dialkyl tin borate compounds, guanidine derivatives; polyamine resins such as amino group-containing vinyl polymers, and amino group-containing condensation polymers; metal complex salts of monoazo dyes described in Japanese Patent Publication Nos. 41-20153, 43-27596, 44-6397, and 45-26478, metal complexes such as Zn, Al, Co, Cr and Fe complexes of salicylic acid, dialkyl salicylic acid, naphthoic acid and dicarboxylic acid described in Japanese Patent Publication Nos. 55-42752 and 59-7385; sulfonated copper phthalocyanine pigments; organic boron salts, fluorine-containing quaternary ammonium salts, and calixarene-based compounds. As for color toners other than black toners, charge controlling agents which impede obtaining intended toner color should not be used, and metal salts of salicylic acid derivative in white color are suitably used.

(External Additive)

The external additive is not particularly limited and may be suitably selected from conventionally known external additive in accordance with the intended use. Examples thereof include silica fine particles, hydrophobized silica fine particles, fatty acid metal salts (such as zinc stearate and aluminum stearate); metal oxides (such as titania, alumina, tin oxide, and antimony oxide) or hydrophobized products thereof, and fluoropolymers. Among these, preferred are silica fine particles, titania fine particles, hydrophobized titania fine particles.

Examples of the silica fine particles include HDK H 2000, HDK H2000/4, HDK H2050EP, HVK21, and HDK H1303 (all produced by Hoechst AG); and R972, R974, RX200, RY200, R202, R805, and R812 (all produced by Japan AEROSIL Inc.). Examples of the titania fine particles include P-25 (produced by Japan AEROSIL Inc.); STT-30 and STT-65C-S (both produced by Titan Kogyo Ltd.); TAF-140 (produced by Fuji Titanium Industry Co., Ltd.); and MT-150W, MT-500B, MT-600B, and MT-150A (all produced by TAYCA CORPORATION). Examples of the hydrophobized titanium oxide fine particles include T-805 (produced by Japan AEROSIL Inc.); STT-30A and STT-65S-S (both produced by Titan Kogyo Ltd.); TAF-500T and TAF-1500T (both produced by Fuji Titanium Industry Co., Ltd.); MT-100S and MT-100T (both produced by TAYCA CORPORATION); and IT-S (produced by ISHIHARA SANGYO KAISHA LTD.).

The hydrophobized silica fine particles, hydrophobized titania fine particles, and hydrophobized alumina fine particles can be obtained by subjecting hydrophilic fine particles to a surface treatment with a silane coupling agent such as methyl trimethoxy silane, methyl triethoxy silane, octyl trimethoxy silane or the like.

Examples of hydrophobizing agent include silane coupling agents such as dialkyl-dihaloganated silane, trialkyl halogenated silane, alkyl trihalogenated silane, and hexaalkyl disilazane coupling agents; silylation agents, silane coupling agents having a fluoride alkyl group, organic titanate-based coupling agents, aluminum-based coupling agents, silicone oils and varnishes.

A silicone oil-treated inorganic fine particle is also suitably used, which is obtained by treating an inorganic fine particle with silicone oil, if necessary, under application of heat.

Examples of the inorganic fine particle include particles of silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride. Of these, silica and titanium dioxide are particularly preferred.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl or methacryl-modified silicone oil, and $\alpha$-methylstyrene-modified silicone oil.

The average primary particle diameter of the inorganic fine particles is preferably 1 nm to 100 nm, and more preferably 3 nm to 70 nm. When the average primary particle diameter is smaller than 1 nm, the inorganic fine particles are embedded in the toner, and the function of the inorganic fine particles sometimes cannot be sufficiently exhibited. When it is larger than 100 nm, the surface of an electrostatic image bearing member may be unevenly damaged with the organic fine particles. As the external additive, an inorganic fine particle and a hydrophobized inorganic fine particle can be used in combination. In this case, the average particle diameter of primary particles that have been hydrophobized is preferably 1 nm to 100 nm, and more preferably 5 nm to 70 nm. It is preferable that the toner contain at least two different types of inorganic fine particles of which the average particle diameter of primary particles that have been hydrophobized is 20 nm or smaller and at least one type of inorganic fine particle whose particle diameter is 30 nm or larger. The specific surface area of the inorganic fine particle determined by BET method is preferably 20 $m^2/g$ to 500 $m^2/g$.

The amount of the external additive added to the toner is preferably 0.1% by mass to 5% by mass, and more preferably 0.3% by mass to 3% by mass.

As the external additive, resin fine particles may also be added. Examples thereof include polystyrene obtained by soap-free emulsification polymerization, suspension polymerization, or dispersion polymerization; copolymers of methacrylic acid ester or acrylic acid ester; polycondensates of silicone, benzoguanamine, nylon or the like; and polymer particles obtained from thermosetting resins. Use of such resin fine particles in combination makes it possible to enhance the chargeability of the resulting toner and to reduce the amount of inversely charged toner, thereby reducing background smear. The amount of the resin fine particles added to the toner is preferably 0.01% by mass to 5% by mass, and more preferably 0.1% by mass to 2% by mass.

(Toner Production Method)

As a toner production method, conventionally known methods can be used, such as kneading-pulverization method, polymerization method, dissolution suspension method, and spray granulation method. In terms of the dispersibility of the releasing agent and colorant, productivity and broad selectability of materials, kneading-pulverization method and polymerization method are preferably employed.

In the kneading-pulverization method, for instance, toner materials are melt kneaded, the resulting product is subjected to pulverization and classification so as to produce toner base particles for the toner.

In the melt kneading, the toner materials are mixed, and the resulting mixture is charged into a melt-kneader so as to be melt-kneaded. As the melt-kneader, for example, a uniaxial- or biaxial-consecutive kneader or a batch-type kneader using a roll mill can be employed. For example, KTK type biaxial extruder manufactured by KOBE STEEL., LTD.; a TEM type biaxial extruder manufactured by TOSHIBA MACHINE CO., LTD.; a biaxial extruder manufactured by KCK; a PCM type biaxial extruder manufactured by IKEGAI, LTD.; and a co-kneader manufactured by BUSS are preferably used. It is preferred that these melt kneaders be used under appropriate conditions where no breakage of the molecular chains of the binder resin occurs. Specifically, the melt-kneading temperature is adjusted referring to the softening point of the binder resin. When the melt-kneading temperature is much higher than the softening point, extensive molecular chain breakage occurs. When the melt-kneading temperature is much lower than the softening point, it may result in poor dispersing.

In the pulverization, the kneaded product obtained in the kneading is pulverized. Specifically, in the pulverization, it is preferable that the obtained kneaded product be coarsely crushed and then finely pulverized. Preferred examples of the pulverizing method include a method in which a kneaded product is made collide with a collision plate in a jet stream, a method in which particles are made collided with each other, and a method in which a kneaded product is pulverized in a gap between a mechanically rotating roller and a stirrer.

In the classification, the pulverized product obtained in the pulverization is classified so that the particles have predetermined particle diameters. The classification can be effected by removing fine particles using, for example, a cyclone, a decanter, or a centrifugal separator.

When the pulverization and classification are completed, the pulverized product is classified by an airflow centrifugal force to produce toner base particles having predetermined particle diameters.

Subsequently, an external additive is added to the toner base particles. The toner base and the external additive are mixed and stirred using a mixer, whereby the external additive is pulverized so that surfaces of the toner base particles are coated with it. At this time, it is important that the external additive such as inorganic particles or resin fine particles be uniformly and firmly secured to the toner base particles in order to ensure durability.

As the polymerization method, any of conventionally known methods, such as dissolution suspension method, suspension polymerization method, and emulsification aggregation method, can be employed, and the method is not particularly limited. The following explains details of an example of production method for a toner composed of resin particles (C), as one embodiment of the toner of the present invention described above.

As described above, the toner composed of resin particles (C) has such a structure that surfaces of resin particles (B) are coated with resin particles (A) containing a first resin (a) or a coating layer (P) containing the first resin (a). The toner can be produced, for example, by the following methods (I), (II) or the like.

(I): A method in which an aqueous dispersion (W) of resin particles (A) containing a first resin (a) and [a second resin (b) or an organic solvent solution and/or dispersion liquid thereof] (hereinafter, referred to as "(O1)"), or [a precursor of the second resin (b) or an organic solvent solution and/or dispersion liquid thereof] (hereinafter, referred to as "(O2)") are mixed, so that (O1) or (O2) is dispersed in (W), to thereby forming, in the aqueous dispersion (W), resin particles (B) containing the second resin (b). In this case, the resin particles (A) or the coating layer (P) are/is secured on surfaces of the resin particles (B) at the same time as the granulation of the resin particles (B) to yield an aqueous dispersion (X) of the resin particles (C), followed by removal of the aqueous medium from the aqueous dispersion (X).

(II): A method in which surfaces of resin particles (B) containing a resin (b), which has been prepared beforehand, are coated with a coating agent (W') containing a first resin (a), thereby producing resin particles (C). In this case, the coating agent may be any form such as liquid and solid; further, the resin particles (B) are coated with a precursor (a') of the first resin (a) so as to react with (a') so as to be secured with the first resin (a). The resin particles (B) used may be resin particles produced by emulsification aggregation method or pulverization method, or any other production method. The coating method is not particularly limited. For instance, the following methods are exemplified: a method of dispersing preliminarily produced resin particles (B) or a dispersion of (B) in an aqueous dispersion liquid (W) of resin particles (A) containing the first resin (a); and a method of spraying the resin particles (B) with a solution liquid of (a) as a coating agent. Of these methods, the production method (I) is preferably employed.

It is more preferable that the resin particles (C) be obtained by the following production method, in terms that the resulting resin particles will have uniform particle size. When the aqueous dispersion liquid (W) of the resin particles (A) and (O1) [the second resin (b) or an organic solvent solution and/or dispersion liquid thereof] or (O2) [a precursor (b0) of the second resin (b) or an organic solvent solution and/or dispersion liquid thereof] so that (O1) or (O2) is dispersed in the aqueous dispersion liquid (W), to form resin particles (B) containing the second resin (b), the resin particles (A) are made adsorbed on the surfaces of the resin particles (B), whereby preventing mutual coalescence of the resin particles (C) and making it difficult for the resin particles (C) to split up under application of high shearing force. With this, the particle diameters of the resin particles (C) converge on a constant value, making it possible to enhance the uniformity of their particle diameters. Therefore, the resin particles (A) preferably have, for example, the following physical properties: the particles have a strength so as not to be split up by shearing force applied at temperatures when dispersed; the particles are hardly dissolved and/or swollen in water; and the particles are hardly dissolved in the resin (b) or an organic solvent solution and/or dispersion liquid thereof, or (b0) [a precursor of the resin (b) or an organic solvent solution and/or dispersion liquid thereof].

In the meantime, the colorant, releasing agent and modified layered inorganic mineral, which are toner components, are incorporated into the resin particles (B). Therefore, before mixing of (W) and (O) (O1 or O2), these toner components are preliminarily dispersed in the solution of (O). The charge controlling agent may be incorporated in the resin particles (B) or externally added thereinto. When the charge controlling agent is incorporated thereinto, it is dispersed in the solution of (O). When the charge controlled agent is externally added thereto, it is externally added after formation of the resin particles (C).

From the perspective of reducing the effect of resin particles (A) being dissolved or swolled in water or a solvent used in dispersion treatment, it is preferable to suitably adjust the molecular weight and a sp value (calculation of sp value, calculated based on the method described in "Polymer Engineering and Science, February", 1974, VoL. 14, No. 2, pp-147-154), the crystallinity, molecular weight at its crosslinking point and the like of the resin (a).

The number average molecular weight of the resin (a) (measured by Gel Permeation Chromatography, hereinbelow, occasionally abbreviated as "Mn") is preferably 100 to 5,000,000, still more preferably 200 to 5,000,000, and particularly preferably 500 to 500,000; the sp value is preferably 7 to 18, and more preferably 8 to 14; the melting point of the resin (a) (measured by DSC as described above) is preferably 50° C. or higher, and still more preferably 80° C. to 200° C.

The glass transition temperature (Tg) of the resin (a), from the persepective of particle size uniformity of resin particles (C), powder flowability, heat resistant-storage stability, and anti-stress property of the resin particles (C), is preferably 50° C. to 100° C., more preferably 51° C. to 90° C., and particularly preferably 52° C. to 75° C. When the Tg is lower than a temperature employed when the aqueous resin dispersion is prepared, the effect of preventing coalescence and cleavage is reduced, resulting in a reduction of effect of enhancing the particle size uniformity. The Tg of the resin particles (A) containing the resin (a) and Tg of the coating layer (P) containing the resin (a) is, for the same reason, preferably 20° C. to 200° C., more preferably 30° C. to 100° C., and particularly preferably 40° C. to 85° C. Note that in the present invention, Tg is a value determined from the DSC measurement or flow tester measurement (when it is impossible to measure Tg by DSC) as described above.

The resin (a) is, as described above, selected from conventionally known resins, however, when the glass transition temperature (Tg) of the resin (a) is adjusted, it can be easily adjusted by changing the molecular weight of the resin (a) and/or composition of monomer(s) constituting the resin (a). The molecular weight of the resin (a) (the greater the molecular weight, the higher the temperature becomes) may be adjusted by a known method, for example, when the resin (a) is polymerized by successive reaction, like polyurethane resin and polyester resin, adjustment of the addition rate of the monomer used is exemplified. When the resin (a) is polymerized by chain reaction, like vinyl resin, adjustment of the amount of polymerization initiator and chain transfer agent, and adjustments of reaction temperature and reaction concentration, are exemplified.

In the aqueous dispersion liquid (W) of the resin particles (A), among from the after-mentioned organic solvents (u) except for water, an organic solvent miscible with water (acetone, methylethylketone, etc.) may be contained. The type and the amount of the organic solvent to be used on this occasion may be arbitrarily determined, as long as it does not cause aggregation of resin particles (A), does not dissolve resin particles (A) and does not prevent granulation of resin particles (A), preferred is an organic solvent that will not remain in resin particles (C) after dried when it is used with water in an amount of 40% by mass or less.

Use of the resin (a) in the aqueous dispersion liquid (W) of resin particles (A) is not particularly limited, however, the following methods [1] to [8] are exemplified:

[1] in the case of vinyl resin, a method in which monomer is used as a starting material and polymerized by a polymerization reaction such as suspension polymerization, emulsification polymerization, seed polymerization or dispersion polymerization to directly produce an aquous dispersion liquid of resin particles (A): [2] in the case of polyaddition or condensation resin, such as polyester resin, a method in which a precursor (monomer, oligomer, etc.) or its organic solvent solution and/or dispersion liquid is dispersed in an aqueous medium, if necessary, in the present of a proper dispersant, and then heated, and a curing agent is added thereto for curing, to thereby produce an aqueous dispersion of resin particles (A); [3] in the case of polyaddition or condensation resin, such as polyester resin, a method in which an appropriate emulsifier is dissolved in a precursor (monomer, oligomer, etc.) or its organic solvent solution and/or dispersion liquid (which is preferably in the form of a liquid, and may be liquidized by heating) and water is added so as to be emulsified by emulsification of phase reversal, and then a curing agent or the like is added thereto, to thereby produce an aqueous dispersion of resin particles (A); [4] a method in which a resin which has been preliminarily prepared by a polymerization reaction (any of addition polymerization, ring-opening polymerization, polyaddition, addition condensation, polycondensation may be employed. The same applies to the polymerization reaction desribed hereinafter.) is pulverized using a mechanically rotation type or jet air type pulverizer, followed by classification to obtain resin particles, and then dispersed in water in the presence of an appropriate dispersant; [5] in which a resin which has been preliminarily prepared by a polymerization reaction is dissolved in an organic solvent to prepare a resin solution, and the resin solution is sprayed to obtain resin particles, and then the resin particles is dispersed in water in an appropriate dispersant; [6] a method in which a resin which has been preliminarily prepared by a polymerization reaction is dissolved in an organic solvent to prepare a resin solution, a poor solvent is added to the resin solution or a resin which has been preliminarily prepared by a polymerization reaction is heated and dissolved in an organic solvent to prepare a resin solution, and the resin solution is cooled to precipitate resin particles, subsequently, the organic solvent is removed to yield resin particles, and the resin particles are dispersed in water in the presence of an appropriate dispersant; [7] a method a resin which has been preliminarily prepared by a polymerization reaction is dissolved in an organic solvent to prepare a resin solution, the resin solution is dispersed in an aqueous medium in the presence of an appropriate dispersant, and the organic solvent is removed from the resulting product by heating or depressurization; and [8] a method a resin which has been preliminarily prepared by a polymerization reaction is dissolved in an organic solvent to prepare a resin solution, an appropriate emulsifier is dissolved in the resin solution, and water is added to the resin solution to subject it to phase reversal of emulsification.

In the methods [1] to [8] described above, as the emulsifier or dispersant to be used in combination, a conventionally known surfactant (s), a water-soluble polymer (t) or the like can be used. As an aid for the emulsification or dispersion treatment, an organic solvent (u), a plasticizer (V) or the like can be additionally used.

Examples of the surfactant (s) include an anionic surfactant (s-1), a cationic surfactant (s-2), an amphoteric surfactant (s-3) and a nonionic surfactant (s-4) are exemplified. The surfactant (s) may be a mixture of two or more different types of surfactants. Specific examples of the surfactant (s) are those described in Japanese Patent Application Laid-Open (JP-A) No. 2002-284881, besides the surfactants described below.

As the anionic surfactant (s-1), carboxylic acid or its salt, sulfate salt, salt of carboxymethylated product, sulfonic acid salt, phosphonic acid salt, or the like is used.

As the carboxylic acid or its salt, a saturated or unsaturated fatty acid having 8 to 22 carbon atoms or its salt can be used. Examples thereof include capric acid, lauric acid, myristic acid, palmitic acid, stearic acid, arachidic acid, behenic acid, oleic acid, linoleic acid, and ricinoleic acid; and mixtures of higher fatty acids obtained by saponification of coconut oil, palm kernel oil, rice bran oil, and beef tallow. Examples of the salt of carboxylic acid include sodium salts, potassium salts, amine salts, ammonium salts, quaternary ammonium salts and alkanol amine salts (such as monoethanolamine salt, dimethanolamine salt, and triethanolamine salt) of these carboxylic acids.

As the sulfate ester salt, it is possible to use higher alcohol sulfate ester salts (sulfate ester salts of aliphatic alcohols having 8 to 18 carbon atoms), higher alkyl ether sulfate ester salts (sulfate ester salts of EO or PO 1 to 10 mol adducts of aliphatic alcohols having 8 to 18 carbon atoms), sulfated oils (which are obtained by directly sulfating natural unsaturated oil or unsaturated wax having 12 to 50 carbon atoms so as to be neutralized), persulfated fatty acid esters (which are obtained by sulfating unsaturated fatty acid (having 6 to 40 carbon atoms) of lower alcohol (having carbon atoms 1 to 8) ester so as to be neutralized) and sulfated olefin (which are obtained by sulfating olefin having 12 to 18 carbon atoms). Specific examples thereof include sodium salts, potassium salts, amine salts, ammonium salts, quaternary ammonium salts and alkanol amine salts (such as monoethanolamine salt, dimethanolamine salt, and triethanolamine salt) of these carboxylic acids.

Examples of the higher alcohol sulfate ester salt are octyl alcohol sulfate ester salts, decyl alcohol sulfate ester salts, lauryl alcohol sulfate ester salts, stearyl alcohol sulfate ester salts, sulfate ester salts of alcohols (e.g. ALFOL 1214 produced by CONDEA) synthesized by using a Ziegler catalyst and sulfate ester salts of alcohols (e.g. DOBANOL 23, 25 and 45; and DIADOL 115, 115H and 135: produced by Mitsubishi Petrochemical; TRIDECANOL: produced by Kyowa Hakko Kogyo; and OXOCOL 1213, 1215 and 1415: produced by Nissan Chemical Industries) synthesized by the oxo process, etc.

Specific examples of the higher alkyl ether sulfate ester salts are lauryl alcohol-EO (2 moles) adduct sulfate ester salts and octyl alcohol-EO (3 moles) adduct sulfate ester salts, etc. Examples of the sulfated oil are salts of sulfides of castor oil, peanut oil, olive oil, rapeseed oil, beef tallow, mutton tallow and the like. Specific examples of the sulfated fatty acid ester are salts of sulfides of butyl oleate, butyl ricinolate and the like. Specific examples of the sulfated olefin are TEEPOL (produced by Shell) and the like.

As the salts of carboxymethylated products, there may be used salts of carboxymethylated products of aliphatic alcohols (C8-16) carbon atoms, and salts of carboxymethylated products of aliphatic alcohol (C8-16)-EO and/or -PO (1 to 10 moles) adducts.

Specific examples of the salts of carboxymethylated products of aliphatic alcohols are carboxymethylated octyl alcohol sodium salt, carboxymethylated lauryl alcohol sodium salt, carboxymethylated DOBANOL 23 sodium salt, carboxymethylated TRIDECANOL sodium salt, etc.

Specific examples of the salts of carboxymethylated products of aliphatic alcohol EO (1 to 10 moles) adduct are carboxymethylated octyl alcohol-EO (3 moles) adduct sodium salt, carboxymethylated lauryl alcohol-EO (4 moles) adduct sodium salt, and carboxymethylated tridecanol-EO (5 moles) adduct sodium salt, etc.

As the sulfonic acid salts, there may be used alkylbenzene sulfonic acid salts, alkylnaphthalene sulfonic acid salts, sulfosuccinic acid diester salts, α-olefin sulfonic acid salts and Igepon T type, and sulfonic acid salts of other aromatic ring-containing compounds. Examples of the alkylbenzene sulfonic acid salts include sodium salts of dodecylbenzene sulfonic acid.

Specific examples of the alkylnaphthalene sulfonic acid salts are sodium dodecylnaphthalene sulfonate and the like. Specific examples of the sulfosuccinic acid diester salts are di-2-ethylhexyl sulfosuccinate sodium salt and the like. Specific examples of the sulfonic acid salts of aromatic ring-containing compounds are mono- or di-sulfonates of alkylated diphenyl ether, styrenated phenol sulfonate and the like.

As the phosphate ester salts, there may be used phosphate esters of higher alcohol EO adduct, and the like. Specific examples of the higher alcohol phosphate ester salts are disodium monolauryl alcohol phosphate, sodium dilauryl phosphate, etc. Specific examples of the phosphate esters of higher alcohol EO adduct are disodium oleyl alcohol-EO (5 moles) adduct phosphate, and the like.

As the cationic surfactant (s-2), there may be used quaternary ammonium salt type surfactants, and amine salt type surfactants. The quaternary ammonium salt type surfactants can be obtained by a reaction of a tertiary amine having 3 to 40 carbon atoms with a quaternalized agent (e.g. methylchloride methylbromide, ethylchloride, benzylchloride, and alkylated agent such as dimethyl sulfate, and EO adduct thereof). Specific examples thereof include lauryltrimethyl ammonium chloride, didecyldimethyl ammonium chloride, dioctyldimethyl ammonium brodie, stearyltrimethyl ammonium bromide, lauryldimethylbenzyl ammonium chloride (benzalkonium chloride), cetylpyridinium chloride, polyoxyethylenetrimethyl ammonium chloride, and stearamide ethyldiethylmethyl ammonium methosulfate.

The amine salt-type surfactants can be obtained by neutralization of a primary to tertiary amine with an inorganic acid (e.g. hydrochloric acid, nitric acid, sulfuric acid, hydriodic acid, phosphoric acid and perchloric acid) or an organic acid (e.g. acetic acid, formic acid, oxalic acid, lactic acid, gluconic acid, adipic acid, alkylphosphoric acid having 2 to 24 carbon atoms, malic acid and citric acid, and the like). Specific examples of the primary amine salt type surfactants include inorganic acid salts or organic acid salts of aliphatic higher amines having 8 to 40 carbon atoms (e.g. higher amines such as laurylamine, stearylamine, cetylamine, cured beef tallow amine, rosin amine, and the like), and higher fatty acids (acids having 8 to 40 carbon atoms, such as stearic acid, and oleic acid), and salts of lower amines having 2 to 6 carbon atoms.

Examples of the secondary amine salt type surfactant include inorganic acid salts or organic acid salts of aliphatic amide EO adduct having 4 to 40 carbon atoms. Examples of the tertiary amine salt type surfactant include aliphatic amines having 4 to 40 carbon atoms (e.g. triethylamine, ethyldimethylamine, N,N,N',N'-tetramethylethylene diamine), EO (2 moles or higher moles) adducts of aliphatic amine (C2-C40), alicyclic amines having 6 to 40 carbon atoms (e.g. N-methylpylidine, N-methylpyperidine, N-methylhexamethyleneimine, N-methylmorphorine, and 1,8-diazabicyclo (5,4,0)-7-undecene), nitrogen-containing heterocyclic aromatic amine having 5 to 30 carbon atoms (e.g. 4-dimethylaminopylidine, N-methylimidazole, and 4,4'-pyridyl), and inorganic acid salts or organic acid salts of tertiary amines such as triethanolamine monostearate, and stearamide ethyldiethylmethyl ethanol amine.

As the amphoteric surfactant (s-3), there may be used a carboxylic acid type amphoteric surfactant, a sulfuric acid ester salt type amphoteric surfactant, a sulfonic acid salt type amphoteric surfactant and a phosphoric acid ester salt type amphoteric surfactant, and the like.

As the carboxylic acid salt type amphoteric to surfactant, there may be used an amino acid type amphoteric surfactant, a betaine type amphoteric surfactant and an imidazoline type amphoteric surfactant, and the like. An amino acid type amphoteric surfactant has an amino group and a carboxyl group in its molecule. For example, compounds represented by General Formula (2) are exemplified.

$$[R—NH—(CH_2)n\text{-}COO]mM \qquad \text{General Formula (2)}$$

In General Formula (2), R represents a monovalent hydrocarbon group; n is an integer of 1 or 2; m is an integer of 1 or 2; and M represents a hydrogen ion, an alkali metal ion, an alkali earth metal ion, an ammonium cation, an amine cation, an alkanolamine cation, etc.

Examples of the amphoteric surfactant represented by General Formula (2) are alkyl (C6-C40) aminopropionic acid type amphoteric surfactants (sodium stearylaminopropionate, sodium lauryl aminopropionate, etc.); and alkyl (C4-C24) aminoacetic acid type amphoteric surfactants (sodium laurylaminoacetate, etc.)

A betaine type amphoteric surfactant has a quaternary ammonium salt type cationic portion and a carboxylic acid type anionic portion in its molecule. Examples thereof are alkyl (C6-C40) dimethylbetaine (stearyl dimethylaminoacetate betaine, lauryldimethyl aminoacetate betaine, etc.), amide betaines having 6 to 40 carbon atoms (coconut oil fatty acid amidopropyl betaine, etc.), alkyl (C6-C40) betaine, and dihydroxyalkyl (C6-C40) betaines (lauryl dihydroxy ethyl betaine, etc.)

An imidazoline type amphoteric surfactant has a cationic portion having an imidazoline ring and a carboxylic acid type anionic portion in its molecule. For example, 2-undecyl-N-carboxymethyl-N-hydroxyethyl imidazolinium betaine is exemplified.

Examples of other amphoteric surfactants are glycine type amphoteric surfactants such as sodium lauloyl glycine, sodium lauryl diaminoethyl glycine, lauryldiaminoethyl glycine hydrochloride, and dioctyldiaminoethyl glycine hydrochloride; sulfobetaine type amphoteric surfactants such as pentadecylsulfotaurine, sulfonate type amphoteric surfactants, and phosphate type amphoteric surfactants.

As the nonionic surfactant (s-4), there may be used AO-adduct type nonionic surfactants, and polyhydric alcohol type nonionic surfactants. The AO adduct type nonionic surfactant can be obtained by directly adding AO (having 2 to 20 carbon atoms) to higher alcohols having 8 to 40 carbon atoms, higher fatty acids having 8 to 40 carbon atoms, alkylamines having 8 to 40 carbon atoms, etc., or by reacting polyalkylene glycol obtained by adding AO to glycol, with higher fatty acids etc.; or by adding AO to an esterified product obtained by reacting polyhydric alcohol with higher fatty acids.

As the AO, for example, EO, PO and BO are exemplified. Among these, preferred are EO, and random or block adducts of EO and PO. The AO addition number of moles is preferably 10 moles to 50 moles, and it is also preferred that 50% to 100% of these AO adducts be EO adducts.

As an AO addition type nonionic surfactant, the following are exemplified: oxyalkylene alkyl ethers (Number of carbon atoms of alkylene: 2 to 24; Number of carbon atoms of alkyl: 8 to 40) (e.g. octylalcohol EO (20 moles) adduct, lauryl alcohol EO (20 moles) adduct, stearyl alcohol EO (10 moles) adduct, oleyl alcohol EO (5 moles) adduct, and lauryl alcohol EO (10 moles)/PO (20 moles) block adduct, etc.); polyoxyalkylene higher fatty acid esters (Number of carbon atoms of alkylene: 2 to 24; Number of carbon atoms of higher fatty acid: 8 to 40) (e.g. stearyl acid EO (10 moles) adduct, lauryl acid EO (10 moles) adduct, etc.); polyoxyalkylene polyhydric alcohol higher fatty acid esters (Number of carbon atoms of alkylene: 2 to 24; Number of carbon atoms of polyhydric alcohol: 3 to 40; Number of carbon atoms of higher fatty acid: 8 to 40) (e.g. dilauric acid ester of polyethylene glycol (polymerization degree: 20), dioleic acid esters of polyethylene glycol (polymerization degree: 20); polyoxyalkylene alkylphenyl ethers (Number of carbon atoms of alkylene: 2 to 24; Number of carbon atoms of alkyl: 8 to 40) (e.g. nonylphenol EO (4 moles) adduct, nonylphenol EO (8 moles)/PO (20 moles) block adduct, octylphenol EO (10 moles) adduct, bisphenol A-EO (10 moles) adduct, styrenated phenol EO (20 moles) adduct, etc.); polyoxyalkylene alkylamino ethers (Number of carbon atoms of alkylene: 2 to 24; Number of carbon atoms of alkyl: 8 to 40) (e.g. laurylamine EO (10 moles) adduct, stearylamine EO (10 moles) adduct, etc.); polyoxyalkylene alkanolamide (Number of carbon atoms of alkylene: 2 to 24; Number of carbon atoms of amide (acrylic portion): 8 to 24) (e.g. hydroxyethyl amide laurate EO (10 moles) adduct, and hydroxypropyl amide oleate EO (20 moles) adduct, etc.).

As the polyhydric alcohol type nonionic surfactant, there may be used polyhydric alcohol fatty acid ester, polyhydric alcohol fatty acid ester AO adduct, polyhydric alcohol alkyl ether, and polyhydric alcohol alkyl ether AO adduct, and the like. The number of carbon atoms of the above-mentioned polyhydric alcohol is 3 to 24; the number of carbon atoms of the above-mentioned fatty acid is 8 to 40; and the number of carbon atoms of AO is 2 to 24.

Specific examples of the polyhydric alcohol fatty acid ester are pentaerythritol monolaurate, pentaerythritol monooleate, sorbitan monolaurate, sorbitan monostearate, sorbitan dilaurate, sorbitan dioleate, and saccharose monostearate.

Specific examples of the polyhydric alcohol fatty acid ester AO adduct are ethylene glycol monooleate EO (10 moles) adduct, ethylene glycol monostearate EO (20 moles) adduct, trimethylolpropane monostearate EO (20 moles) PO (10 moles) random adduct, sorbitan monolaurate EO (10 moles) adduct, sorbitan distearate EO (20 moles) adduct, and sorbitan dilaurate EO (12 moles) PO (24 moles) random adduct.

Specific examples of the polyhydric alcohol alkyl ethers are pentaerythritol monobutyl ether, pentaerythritol monolauryl ether, sorbitan monomethyl ether, sorbitan monostearyl ether, methylglycoside, and laurylglycoside.

Specific examples of the polyhydric alcohol alkyl ether AO adduct are sorbitan monostearyl ether EO (10 moles) adduct, methylglycoside EO (20 moles) PO (10 moles) random adduct, lauryl glycoside EO (10 moles) adduct, and stearylglycoside EO (20 moles) PO (20 moles) random adduct.

Examples of the water-soluble polymer (t) include cellulose compounds (e.g. methyl cellulose, ethyl cellulose, hydroxyethyl cellulose, ethylhydroxyethyl cellulose, carboxymethyl cellulose, hydroxypropyl cellulose, etc.); gelatin, starch, dextrin, gum Arabic, chitin, chitosan, polyvinyl alcohol, polyvinyl pyrollidone, polyethylene glycol, polyethylene imine, polyacrylamide, acrylic acid (acrylate)-containing polymers (sodium hydroxide-partial neutralization products of sodium polyacrylate, sodium polypotassium, ammonium polyacrylate and polyacrylate; and sodium acrylate-acrylic acid ester copolymers); sodium hydroxide-(partial) neutralization products of styrene-maleic anhydride copolymer; and water-soluble polyurethanes (reaction products of polyethylene glycol, polycaptrolactonediol, etc. with polyisocyante, etc.)

The organic solvent (u) used in the present invention may be added into an aqueous medium or an emulsified dispersion [an oil phase (O1) or (O2) containing the resin (b) or (b0)] at the time of emulsification dispersion, as necessary. Specific examples of the organic solvent (u) are aromatic hydrocarbon solvents such as toluene, xylene, ethylbenzene, and tetralin; aliphatic or alicyclic hydrocarbon solvents such as n-hexane, n-heptane, mineral split, and cyclohexane; halogen solvents such as methyl chloride, methyl bromide, methyliodide, methylene dichloride, carbon tetrachloride, trichloroethylene, and perchloroethylne; ester or ester-ether solvents such as ethyl acetate, butyl acetate, methoxybutyl acetate, methylcellosolve acetate, and ethylcellosolve acetate; ether solvents such as diethylether, tetrahydrofuran, dioxane, ethylcellosolve, butylcellosolve, propylene glycol monomethyl ether; ketone solvents such as acetone, methylethylketone, methylisobutylketone, di-n-butylketone, and cyclohexanone; alcohol solvents such as methanol, ethanol, n-propanol, isopropanol, n-butanol, isobutanol, t-butanol, 2-ethylhexyl alcohol, benzyl alcohol; amide solvents such as dimethylformamide, and dimethylacetoamide; sulfooxide solvents such as diemthylsulfoxide; heterocyclic compound based solvents such as N-methylpyrollidone; and mixture solvents thereof in combination of two or more.

The plasticizer (v) may be added into an aqueous medium or an emulsified dispersion [an oil phase (O1) or (O2) containing the resin (b) or (b0)] at the time of emulsification dispersion, as necessary. The plasticizer (v) is not particularly limited, and the following are examples thereof:

(v1) phthalic ester [dibutyl phthalate, dioctyl phthalate, butylbenzyl phthalate, diisodecyl phthalate, etc.];

(v2) aliphatic dibasic ester [di-2-ethylhexyl adipate, 2-ethylhexyl sebacate, etc.];

(v3) trimellitic ester [tri-2-ethylhexyl trimellitate, trioctyl trimellitate, et.];

(v4) phosphoric ester [trimethyl phosphate, tri-2-ethylhexyl phosphate, tricresyl phosphate, etc.];

(v5) fatty acid ester [butyl oleate, etc.]; and (v6) mixtures thereof.

In the present invention, the particle diameter of the resin particles (A) is usually smaller than that of the resin particles (B) to be formed. From the viewpoint of uniformity of particle diameters, a value of the particle diameter ratio [volume average particle diameter of resin particles (A)]/[volume average particle diameter of resin particles (B)] is preferably within the range of 0.001 to 0.3. More preferably, the minimum limit value of the particle diameter ratio is 0.003, and the maximum limit value of the particle diameter ratio is 0.25. When the particle diameter ration is more than 0.3, the resin particles (A) are not efficiently adsorbed on the surfaces of the resin particles (B), and thus the particle size distribution of the resulting resin particles (C) tends to be large.

The volume average particle diameter of the resin particles (A) can be suitably adjusted so as to be suitable for obtaining resin particles (C) having a predetermined particle size. Generally, the volume average particle diameter of the resin particles (A) is preferably in the range of 0.0005 μm to 1 μm. The maximum limit value of the volume average particle diameter is more preferably 0.75 μm, and particularly preferably 0.5 μm. The minimum limit value is more preferably 0.01 μm, particularly preferably 0.02 μm, and most preferably 0.04 μm. Note that if it is desired to obtain resin particles (C) having a volume average particle diameter of 1 μm, the minimum limit value is preferably within the rage of 0.0005 μm to 0.30 μm, and particularly preferably within the range of 0.001 μm to 0.2 μm; and when if it is desired to obtain resin particles (C) having a volume average particle diameter of 10 μm, the minimum limit value is preferably within the range of 0.005 μm to 0.8 μm, and particularly preferably within the range of 0.05 μm to 1 μm. The volume average particle diameter can be measured by a laser particle size distribution measurement apparatus LA-920 (manufactured by HORIBA Ltd.), MULTISIZER III (manufactured by Coulter Co.), or ELS-800 (manufactured by Otsuka Electronics Co., Ltd.) which employs a Laser Dopplar Method, or the like. If a difference in measured value of particle size arises between these individual measurement apparatuses, a value measured by LS-800 is employed. Note that the volume average particle diameter of the after-mentioned resin particles (B) is preferably, in terms that the above-mentioned particle diameter ratio is easily obtained, 0.1 μm to 15 μm, more preferably 0.5 μm to 10 μm, and particularly preferably 1 μm to 8 μm.

As the precursor (b0), a combination of a prepolymer (α) having a reactive group with a curing agent (β) can also be used. Note that the term "reactive group" means a group capable of reacting with the curing agent (β). In this case, as a method of forming resin particles (B) containing a resin (b2), which can be obtained by a reaction with the precursor (b0) in the forming process of resin particles (C), the following methods are exemplified: a method in which an oil phase containing a reactive to group-containing prepolymer (α), a curing agent (β) and, when necessary, an organic solvent (u), is dispersed in an aqueous dispersion liquid of resin particles (A), and then heated so as to react the reactive group-containing prepolymer (α) with the curing agent (β), thereby forming resin particles (B) containing the resin (b2); a method in which a reactive group-containing prepolymer (α) or a organic solvent solution and/or dispersion liquid thereof is dispersed in an aqueous dispersion liquid of resin particles (A), followed by addition of a water-soluble curing agent (β) so as to be reacted, thereby forming resin particles (B) containing the resin (b2); and a method in which when a reactive group-containing prepolymer (α) is a material reactable with water to be cured, the prepolymer (α) or an organic solvent solution and/or dispersion liquid thereof is dispersed in an aqueous dispersion liquid (W) of resin particles (A) so as to react with each other, thereby forming resin particles (B) containing the resin (b2).

As a combination of a reactive group contained in the reactive group-containing prepolymer (α) with the curing agent (β), the following [1] and [2] are exemplified:

[1] a combination between a reactive group contained in the reactive group-containing prepolymer (α), which is a functional group (α1) capable of reacting with active hydrogen compounds and a curing agent (β) which is an active hydrogen group-containing compound (β2); and

[2] a combination between a reactive group contained in the reactive group-containing prepolymer (α), which is an active hydrogen-containing group (α2) and a curing agent (β) which is a compound (β2) reactable with the active hydrogen-containing group (α2).

Of these combinations, [1] is more preferable in terms of reaction rate in water. In the combination [1]. As a functional group (α1) reactable with active hydrogen compound, an isocyanate group (α1a), a blocked isocyanate group (α1b), an epoxy group (α1c), an acid anhydride group (α1d) and an acid hydride group (α1e) are exemplified. Among these, preferred are (α1a), (α1b) and (α1c), and particularly referred are (α1a) and (α1b). The term "blocked isocyanate group (α1b)" means an isocyanate group blocked by a blocking agent. Examples of the blocking agent include oximes [acetooxime, methylisobutylketoxime, diethylketoxime, cyclopentanone oxime, cyclohexanone oxime, methylethylketoxime, etc.]; lactames [γ-butyrolactame, ∈-caprolactame, γ-valerolactame, etc.]; aliphatic alcohols having 1 to 20 carbon atoms [ethanol, methanol, octanol, etc.]; phenols [phenol, cresol, xylenol, nonylphenol, etc.]; active methylene compounds [acetylacetone, ethyl malonate, ethyl acetoacetate, etc.]; basic nitrogen-containing compounds [N,N-diethylhydroxylamine, 2-hydroxypyridine, pyridine-N-oxide, 2-mercaptopyridine, etc.]; and mixtures thereof. Among these, preferred are oximes, and particularly preferred are methylethylketoxime.

As a skeleton of the reactive group-containing prepolymer (α), polyether (αw), polyester (αx), epoxy resin (αy) and polyurethane (αz) are exemplified. Among these, preferred are (αx), (αy) and (αz), and particularly preferred are (αx) and (αz). Examples of the polyether (αw) include polyethylene oxide, polypropylene oxide, polybutylene oxide, and polytetramethylene oxide. Examples of the polyester (αx) include polycondensation products between a diol (11) and a dicarboxylic acid (13), and polylactone (ring-opening polymer of ∈-caprolactone, etc.). Examples of the epoxy resin (αy) include addition condensation products between bisphenol (bisphenol A, bisphenol F, bisphenol S, etc.) and epichlorohydrin. Examples of the polyurethane (αz) include polyaddition products between a diol (11) and a polyisocyanate (15), and polyaddition products between the polyester (αx) and the polyisocyanate (15).

As a method of introducing a reactive group into the polyester (αx), epoxy resin (αy), polyurethane (αz) or the like, the following methods are exemplified:

[1] a method in which one of two or more components is excessively used in amount to make its functional group of the component present at the ends of the skeleton; and

[2] a method in which one of two or more components is excessively used in amount to make its functional group of the components reside at the ends of the skeleton, and further, a compound containing a functional group capable of reacting with the remaining functional group and a reactive group is added so as to react with each other.

In the method [1] described above, it is possible to obtain a hydroxyl group-containing polyester prepolymer, a carboxyl group-containing polyester prepolymer, an acid halide group-containing polyester prepolymer, a hydroxyl group-containing epoxy resin prepolymer, an epoxy group-containing epoxy resin prepolymer, a hydroxyl group-containing polyurethane prepolymer, an isocyanate group-containing polyurethane prepolymer, etc.

As for the ratio of constitutional components, for example, in the case of a hydroxyl group-containing polyester prepolymer, the mixing ratio of the polyol (1) to the polycarboxylic acid (2), as an equivalent ratio [OH]/[COOH] of hydroxyl group [OH] content relative to carboxyl group [COOH] content in the polyester resin, is preferably 2/1 to 1/1, more preferably 1.5/1 to 1/1, and particularly preferably 1.3/1 to 1.02/1. In the case of a prepolymer having a different skeleton and different end groups therefrom, the same applies to the mixing ratio, with only a change in their components.

In the method [2] described above, to a prepolymer obtained by the method [1], a polyisocyanate is reacted to thereby an isocyanate group-containing prepolymer can be obtained; a blocked polyisocyanate is reacted to thereby obtain a blocked isocyanate group-containing prepolymer; a polyepoxide is reacted to thereby obtain an epoxy group-containing prepolymer; and a polyacid anhydride is reacted to thereby obtain an acid anhydride group-containing prepolymer. As for the amount of a compound containing a functional group and a reactive group used, for example, when a polyisocyanate is reacted to a hydroxyl group-containing polyester to obtain an isocyanate group-containing polyester prepolymer, the mixing ratio of the polyisocyanate, as an equivalent ratio [NCO]/[OH] of isocyanate group [NCO] content in the polyisocyanate to hydroxyl group [OH] content in the hydroxyl group-containing polyester prepolymer, is preferably 5/1 to 1/1, more preferably 4/1 to 1.2/1, and particularly preferably 2.5/1 to 1.5/1. In the case of a prepolymer having a different skeleton and different end groups therefrom, the same applies to the mixing ratio, with only a change in their components.

The number of reactive groups per one molecule in the reactive group-containing prepolymer (α) is usually one or more, preferably 1.5 to 3 on average, and more preferably 1.8 to 2.5 on average.

Within the above range, the molecular weight of a cured product to be obtained by reacting with the curing agent (β) becomes higher. The Mn of the reactive group-containing prepolymer (α) is preferably 500 to 30,000, more preferably 1,000 to 20,000, and particularly preferably 2,000 to 10,000. The weight average molecular weight of the reactive group-containing prepolymer (α) is preferably 1,000 to 50,000, more preferably 2,000 to 40,000, and still more preferably 4,000 to 20,000. The viscosity of the reactive group-containing prepolymer (α) is preferably 2,000 poises or less, and more preferably 1,000 poises or less at 100° C. By setting the viscosity to 2,000 poises or less, it is preferable in that resin particles (C) having a sharp particle size distribution with a small amount of an organic solvent.

Examples of the active hydroxyl group-containing compound (β1) include polyamine (β1a) which may be blocked with a compound capable of desorbing it, polyol (β1b), polymarcaptane (β1c), and water (β1d). Among these, preferred are (β1a), (β1b) and (β1d), and more preferred are blocked polyamines and (β1d).

As the polyamine (β1a), the same as those described in the polyamine (16) are exemplified. Preferred example of the polyamine (β1a) are 4,4'-diaminodiphenylmethane, xylylenediamine, isophorondiamine, ethylenediamine, diethylenetriamine, triethylenetetramine, and mixtures thereof.

As an example of the case where (β1a) is a polyamine which is blocked with a desorbable compound, the following compounds are exemplified: ketimine compounds obtainable from the polyamines and ketones having 3 to 8 carbon atoms (acetone, methylethylketone, methylisobutylketone, etc.); aldimine compounds, obtainable from aldehyde compounds (formaldehyde, and acetoaldehyde) having 2 to 8 carbon atoms, enamine compounds, and oxazolidine compounds.

As the polyol (β1b), the same as those described in the diol (11) and polyol (12) are exemplified. A single use of the diol (11) or a combination with a small amount of the polyol (12) is preferable. As the polymercaptane (β1c), ethylenediol, 1,4-butanediol, 1,6-hexanediol are exemplified.

A reaction stopper (βs) may be used along with the active hydroxyl group-containing compound (β1) as necessary. The additional use of the reaction stopper (βs) at a given ratio makes it possible to adjust the molecular weight of the resin (b2) to a predetermined value. Examples of the reaction stopper (βs) include monoamines (diethylamine, dibutylamine, butylamine, laurylamine, monoethanolamine, diethanolamine, etc.); blocked monoamines (ketimine compounds, etc.); monools (methanol, ethanol, isopropanol, butanol, phenol, etc.); monomercaptanes (butyl mercaptane, lauryl mercaptane, etc.); monoisocyanates (lauryl isocyanate, phenyl isocyanate, etc.); and monoepoxides (butyl glycidyl ether, etc.).

Examples of the active hydrogen-containing group (α2) contained in the reactive group-containing prepolymer (α) in the above-mentioned combination [2] are an amino group (α2a), a hydroxyl group (alcoholic hydroxyl group, and phenolic hydroxyl group) (α2b), a mercapto group (α2c), a carboxyl group (α2d), and an organic group (α2e) which is blocked with a compound capable of desorbing these amino group. Among these, preferred are (α2a), (α2b) and an organic group (α2e) which is blocked with a compound capable of desorbing amino groups; and a hydroxyl group (α2b) is particularly preferable. As the organic group which is blocked with a compound capable of desorbing amino groups, the same as those described in (β1a) are exemplified.

Examples of the compound (β2) reactable with an active hydrogen-containing group include a polyisocyanate (β2a), a polyepoxide (β2b), a polycarboxylic acid (β2c), a polycarboxylic anhydride (β2d), and a polyacid hallide (β2e). Among these, preferred are (β2a) and (β2b); and a polyisocyanate (β2a) is more preferred.

As the polyisocyanate (β2a), the same as those described in the polyisocyanate (15) are exemplified, and preferred polyisocyanates are also the same. As the polyepoxide (β2b), the same as those described in the polyepoxide (19) are exemplified, and preferred ones are also the same.

As the polycarboxylic acid (β2c), dicarboxylic acid (β2c-1), and trivalent or higher polyvalent polycarboxylic acid (β2c-2) are exemplified. Examples of the polycarboxylic acid (β2c) include a dicarboxylic acid (β2c-1) and a trivalent or higher polyvalent polycarboxylic acid (β2c-2) are exemplified. A single use of the dicarboxylic acid (β2c-1), and mixtures of a dicarboxylic acid (β2c-1) with a smaller amount of the trivalent or higher polyvalent polycarboxylic acid (β2c-2) are preferable. As the dicarboxylic acid (β2c-1), the same as those described in the dicarboxylic acid (13) are exemplified, and preferred ones are also the same. As the polycarboxylic acid, the same as those described in the polycarboxylic acid (5) are exemplified, and preferred ones are also the same.

As the polycarboxylic anhydride (β2d), pyromerritic anhydrides are exemplified. As the polyacid halides (β2e), the halides of the polycarboxylic acid (β2c) (acid chlorides, acid bromides, and acid iodides, etc.) are exemplified. Further, the reaction stopper (βs) may be used along with the polycarboxylic anhydride (β2d) as necessary.

The mixing ratio of the curing agent (β), as an equivalent ratio [α]/[β] of reactive group [α] content in the reactive group-containing prepolymer (α) to hydroxyl group [β] content in the curing agent (β), is preferably 1/2 to 2/1, more preferably 1.5/1 to 1/1.5, and particularly preferably 1.2/1 to 1/1.2. When the curing agent (β) is water (β1d), it is regarded as a divalent active hydrogen compound.

The resin (b2) obtained by reacting the reactive group-containing prepolymer (α) with the precursor (b0) containing the curing agent (β) becomes a component of the resin particles (B) and the resin particles (C). The weight average molecular weight of the resin (b2) obtained by reacting the reactive group-containing prepolymer (α) with the curing agent (β) is preferably 3,000 or more, still more preferably 3,000 to 10,000,000, and particularly preferably 5,000 to 1,000,000.

In the reaction of the reactive group-containing prepolymer (α) and the curding agent (β) in an aqueous medium, by adding a reactive group-containing prepolymer (α) such as a leaner polyester resin (b1) and a polymer unreactive with the curing agent (β), a so-called "dead polymer" into the reaction system, the resin (b) becomes a mixture of a resin (b2) obtained by the reaction of the reactive group-containing prepolymer (α) with the curing agent (β) in the aqueous medium, and an unreacted resin such as the linear polyester resin (b1).

The amount of the aqueous dispersion (W) used to 100 parts by mass of the resin (b) is preferably 50 parts by mass to 2,000 parts by mass, and more preferably 100 parts by mass to 1,000 parts by mass. When the amount is 50 parts by mass, the dispersed state of the resin (b) is improved, and when the amount is less than 2,000 parts by mass, it is favorable in terms of cost efficiency.

The resin particles (C) can be obtained in the following steps. An aqueous dispersion liquid (W) of resin particles (A) containing a resin (a) is mixed with a resin (b) or an organic solvent solution and/or dispersion liquid (O1) of the resin (b), or a precursor (b0) of the resin (b) or an aqueous solvent solution and/or dispersion liquid (O2) of the precursor (b0), and the solution and/or dispersion liquid (O1) or (O2) is dispersed in the aqueous dispersion (W). When the precursor (b0) is employed, the precursor (b0) is reacted to form a resin (b2) and to obtain an aqueous dispersion (X) of resin particles (C) having a structure where the resin (a) is attached on the surfaces of the resin particles (B) containing the resin (b), followed by removing the aqueous medium from the aqueous resin dispersion (X). The resin (a) attached on the surfaces of the resin particles (B) may take a form of particles (A) or a coating layer (P). Whether the resin (a) becomes the particles (A) or the coating layer (P) is determined depending on the Tg of the resin (a) and the conditions for producing resin particles (C) (including solvent removing temperature).

The shape of particles and their surfaces of the resin particles (C) obtained in the production method (I) can be controlled by controlling the difference in sp value between the resin (a) and the resin (b), and the molecular weight of the resin (a). When the difference in sp value therebetween is small, smooth surfaced particles with indefinite shapes are easily obtained. When the difference is large, rough surfaced particles in spherical shape are easily obtained. When the molecular weight of the resin (a) is large, rough surfaced particles are easily obtained. In contrast, when the molecular weight is small, smooth surfaced particles are easily obtained. Note that if the difference in sp value between (a) and (b) is excessively low or excessively high, it becomes difficult to perform granulation. In view of this, the difference in sp value between (a) and (b) is preferably 0.01 to 5.0, more preferably 0.1 to 3.0, and still more preferably 0.2 to 2.0. The weight average molecular weight of the resin particles (a) is preferably 100 to 1,000,000, more preferably 1,000 to 500,000, still more preferably 2,000 to 200,000, and particularly preferably 3,000 to 100,000.

In the case of the production method (II), the shape of the resin particles (C) is greatly affected by the shape of the resin particles (B) which have been produced to beforehand, and the resin particles (C) will have a substantially similar shape to that of the resin particles (B). Note that when the resin particles (B) have an indefinite shape and a large amount of a coating agent (W') is used in the production method (II), the resulting resin particles (C) will be spherical in shape.

In the present invention, from the viewpoint of the uniformity of particle diameters and the storage stability of the resin particles (C), the resin particles (C) be preferably composed of resin particles (A) containing 0.01% by mass to 60% by mass of a resin (a) or a coating layer (P) containing the resin (a) within the same range, and resin particles (B) containing 40% by mass to 99.99% by mass of a resin (b); more preferably composed of resin particles (A) containing 0.1% by mass to 50% by mass of a resin (a) or a coating layer (P) containing the resin (a) within the same range, and resin particles (B) containing 50% by mass to 99.99% by mass of a resin (b); and particularly preferably composed of resin particles (A) containing 1% by mass to 45% by mass of a resin (a) or a coating layer (P) containing the resin (a) within the same range, and resin particles (B) containing 55% by mass to 99% by mass of a resin (b). When the amount of the resin particles (A) or the coating layer (P) is 0.01% by mass or more, the blocking resistance of the resulting toner becomes excellent, and when it is 60% by mass or less, the fixability, in particular, the low-temperature fixability becomes excellent.

In the resin particles (C), from the viewpoint of the uniformity of particle diameters, the powder flowability and the storage stability of the resin particles (C), 5% or more, preferably 30% or more, still more preferably 50% or more, particularly preferably 80% or more of the surface area of the resin particle (B) be coated with resin particles (A) containing the resin (a) or the coating layer (P) containing the resin (a). The surface coverage rate of the resin particles (C) can be determined by analysis of images obtained by a scanning electron microscope (SEM), based on the following equation.

Surface coverage rate (%)=[area of portions of resin particle (*B*) coated with (*A*) or (*P*)/area of portions of resin particle (*B*) coated with (*A*) or (*P*)+area of exposed portions of resin particles (*B*)]×100

From the viewpoint of the uniformity of particle diameters, the coefficient of variation in volume distribution of the resin particles (C) is preferably 30% or less, and more preferably 0.1% to 15%. Also, from the viewpoint of the uniformity of particle diameters, a value of [volume average particle diameter/number average particle diameter] of the resin particles (C) is preferably 1.0 to 1.4, and still more preferably 1.0 to 1.2. Although, the volume average particle diameter of the resin particles (C) varies depending on the application, in general, it is preferably 0.1 μm to 16 μm. The maximum limit of the volume average particle diameter is still more preferably 11 μm, and particularly preferably 9 μm. The minimum limit is still more preferably 0.5 μm, and particularly preferably 1 μm. Note that the volume average particle diameter and the number average particle diameter can be measured by a MULTISIZER III (manufactured by Coulter Co.) at a time.

In the present invention, it is possible to provide desired concavo-convexes or irregularities to surfaces of the resin particles (C) by changing the particle diameters of the resin particles (A) and resin particles (B) and by changing the surface coverage rate of the resin particles (B) coated with the coating layer (P) containing the resin (a). If it is desirable to improve the powder flowability, the specific surface area measured by BET method of the resin particles (C) is preferably 0.5 $m^2/g$ to 5.0 $m^2/g$. In the present invention, a value of BET specific surface area is measured by a specific surface area meter, for example, QUANTASORB (manufactured by Yuasa Ionics Inc.) (measurement gas: He/Kr=99.9/0.1 voL %, calibration gas: nitrogen).

Also, from the viewpoint of the powder flowability, the average-center line surface roughness (Ra) of the resin particles is preferably 0.01 μm to 0.8 μm. The average-center line surface roughness (Ra) is a value determined by averaging out an absolute deviation between the roughness curve and the center line and can be measured, for example, by a scanning probe microscope system (manufactured by Toyo Technica).

The resin particle (C) is preferably spherically shaped from the viewpoint of the powder flowability, the melt-leveling and the like. In this case, the resin particles (B) are also preferably spherically shaped. The average circularity of the resin particles (C) is preferably 0.95 to 1.00, more preferably 0.96 to 1.0, and particularly preferably 0.97 to 1.0. Note that the average circularity is a value determined by the following manner: Firstly, particles are optically detected to obtain an image thereof, and the circumferential length of the projected area of the image is divided by the circumferential length of a circle having an area corresponding to the projected area. Specifically, the average circularity is measured by a flow-type particle image analyzer (FPIA-2000, manufactured by Sysmex Corporation). More specifically, 100 mL to 150 mL of water with solid impurities has been removed beforehand is put in a given vessel, 0.1 mL to 0.5 mL of a surfactant (DRYWEL, produced by FUJIFILM Corporation) is added as a dispersant, and about 0.1 g to 9.5 g of a measurement sample is further added to thereby obtain a suspension liquid with the sample being dispersed therein. The suspension liquid is then subjected to a dispersion treatment in a supersonic dispersing machine (ULTRASONIC CLEANER MODEL VS-150, manufactured by Welvocria Co.) for about 1 minute to 3 minutes so that the concentration of the dispersion becomes 3,000/μL to 10,000/μL, followed by measurement of the shape and particle distribution of the resin particles.

The toner composition of the toner of the present invention preferably contains a layered inorganic mineral in which a part of interlayer ions is modified with organic ions. The modified layered inorganic mineral used in the present invention is preferably mineral having smectite-based basic crystal structure modified with organic cations. It is also possible to introduce metal anions into the layered inorganic mineral by substituting a part of divalent metal in the layered inorganic mineral with trivalent metal. However, when metal anions are introduced thereinto, the resulting mineral becomes highly hydrophilic. Therefore, preferred is a layered inorganic compound in which a part of metal anions is modified with organic anions.

As an organic cation modifier used for the layered inorganic mineral in which interlayer ions are partially modified with inorganic ions, quaternary alkyl ammonium salts, phosphonium salts and imidazole salts are exemplified. Among these, preferred are quaternary alkyl ammonium salts. Specific examples of the quaternary alkyl ammonium salts, trimethyl stearyl ammonium, dimethyl stearyl benzyl ammonium, and oleylbis(2-hydroxyethyl)methyl ammonium.

Specific examples of the organic anion modifier include sulfates, sulfonates, carboxylates or phosphates each further having a branched, unbranched or cyclic alkyl (C1-C44), alkenyl (C1-C22), alkoxy (C8-C32), hydroxyalkyl (C2-C22), ethylene oxide, propylene oxide, or the like. Carboxylic acids having an ethylene oxide skeleton are preferable.

By partially modifying interlayer ions of the layered inorganic mineral with organic ions, it is possible to moderately impart hydrophobicity to the resulting toner will have moderate hydrophobicity, an oil phase containing the toner composition and/or toner composition precursor will have a non-Newtonian viscosity, and the resulting toner can be made to have an indefinite shape. At that occasion, the amount of the layered inorganic mineral in which a part of the toner material is modified with the organic ions is preferably 0.05% by mass to 10% by mass, and more preferably 0.05% by mass to 5% by mass.

The layered inorganic mineral in which a part thereof is modified with organic ions may be suitably selected. Examples thereof include montmorillonite, bentonite, hectorite, attapulgite, sepiolite, and mixtures thereof. Among these, organically modified montmorillonite or bentonite is preferable in terms that they do not influence on toner properties, their viscosities can be easily adjusted, and the additive amount, and they are effective in a small amount.

Specific examples of commercially available layered inorganic mineral in which a part thereof is modified with organic ions include quaternium-18 bentonite such as BENTONE 3, BENTONE 38 and BENTONE 38V (produced by Rheox); TIXOGEL VP (produced by United Catalyst Inc.); CLAYTON 34, CLAYTON 40, and CLAYTON XL (produced by CLAYTON APA Southern Clay Product, Inc.); and stearalkonium bentonite such as BENTONE 27 (produced by Rheox), TIXOGEL LG (produced by United Catalyst Inc.), and CLAYTON AF and CLAYTON APA (produced by CLAYTON APA Southern Clay Product, Inc.); and quaternium-18 benzalkonium bentonite such as CLAYTON HT and CLAYTON PS (produced by Southern Clay Products, Inc.). Particularly preferred are CLAYTON AF and CLAYTON APA. Further, as a layered inorganic mineral in which a part thereof is modified with organic anions, layered inorganic minerals obtained by modification of DHT-4A (Kyowa Chemical Industry Co., Ltd.) with an organic anion represented by the following General Formula (1) are particularly preferable. As a compound represented by the following General Formula (1), for example, HITENOL 330T (produced by DAI-ICHI KOGYO SEIYAKU CO., LTD.) is exemplified.

$$R1(OR2)nOSO_3M \qquad \text{General Formula (1)}$$

In General Formula (1), R1 represents an alkyl group having 13 carbon atoms; R2 represents an alkylene group having 2 to 6 carbon atoms; n is an integer of 2 to 10; and M represents a monovalent metal element.

(Developer)

The developer contains at least the toner of the present invention and further contains other suitably selected components, such as carrier. The developer may be a one-component developer or two-component developer, however, when used in high-speed printers responding to recent enhancement in information processing speed, the two-component developer is preferable in terms of improvement of shelf-life.

(Carrier)

The carrier is not particularly limited and may be suitably selected in accordance with the intended use. Preferably, the carrier contains a core material and a resin layer for coating the core material.

The core material is not particularly limited and may be suitably selected from among conventionally known core materials. For example, manganese-strontium (Mn—Sr)-based materials and manganese-magnesium (Mn—Mg) based materials of 50 emu/g to 90 emu/g are preferable. In terms of securing high image density, high magnetization materials such as iron powder (100 emu/g or higher) and magnetite (75 emu/g to 120 emu/g) are preferable. In terms of being capable of easing up the contact pressure to a latent electrostatic image bearing member on which surface a toner stands like a brush and of the advantage in obtaining high-quality image, weak magnetization materials such as copper-zinc (Cu—Zn)-based materials (30 emu/g to 80 emu/g) are preferable. These may be used alone or in combination.

As for the particle diameter of the core material, the average particle diameter (weight average particle diameter (D50)) is preferably 10 μm to 200 μm, and more preferably 40 μm to 100 μm. When the average particle diameter (weight average particle diameter (D50) is smaller than 10 μm, the amount of fine powder particles is increased in a particle size distribution of carrier particles, and the magnetization per particle decreases, possibly causing carrier scattering. When the average particle diameter is larger than 200 μm, the specific area of the toner is reduced, possibly causing toner scattering; in the case of full-color having a large solid part area, the reproducibility, in particular, of solid parts may degrade.

The material of the resin layer is not particularly limited and may be suitably selected from among conventionally known resins. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers between vinylidene fluoride and acrylic monomer, copolymers between vinylidene fluoride and acrylic monomer, copolymers between vinylidene fluoride and vinyl fluoride; fluoroterpolymers (trifluoride (multiple fluoride) copolymers) such as terpolymer of tetrafluoroethylene, vinylidene fluoride and non-fluoro monomer; and silicone resins. These resins may be used alone or in combination. Among these, silicone resins are particularly preferable.

The silicone resin is not particularly limited and may be suitably selected from among generally known silicone resins in accordance with the intended use. Examples of the silicone resin include straight silicone resins made from only organosiloxane bond; and silicone resins modified with an alkyd resin, polyester resin, epoxy resin, acrylic resin, urethane resin or the like.

As the silicone resin, commercially available silicone resins may be used. As straight silicone resins, KR271, KR255, and KR152 produced by Shin-Etsu Chemical Co., Ltd.; and SR2400, SR2406, SR2410 produced by TORAY Dow Corning Silicone Co., Ltd. are exemplified.

As the modified silicone resins, commercially available products may be used. For example, KR206 (alkyd-modified), KR5208 (acryl-modified), ES1001N (epoxy-modified), and KR305 (urethane-modified) produced by Shin-Etsu Chemical Co., Ltd.; and SR2115 (epoxy-modified), and SR2110 (alkyd-modified) produced by TORAY Dow Corning Silicone Co., Ltd. are exemplified.

Note that silicone resin may be used alone, and a crosslinkable component, and a charge amount controlling component may be used with the silicone resin(s).

As necessary, the resin layer may contain conductive powder or the like. Examples of the conductive powder include iron powder, carbon black, titanium oxide powder, tin oxide powder, and zinc oxide powder. The average particle diameter of these conductive powders is preferably 1 μm or less. When the average particle diameter is larger than 1 μm, it may be difficult to control the electric resistance.

The resin layer can be formed, for example, by the following manner. The silicone resin or the like is dissolved in an organic solvent to prepare a coating solution, the coating solution is applied uniformly on the surface of the core material by a conventionally known coating method, then dried and baked, thereby forming a resin layer. Examples of the coating method include dip-coating method, spray-coating method, and brush-coating method.

The organic solvent is not particularly limited and may be suitably selected in accordance with the intended use. Examples thereof include toluene, xylylene, methylethylketone, methylisobutylketone, Cellosolve, and butyl acetate.

The baking is not particularly limited and may be external heating or internal heating. Examples thereof include methods using fixed electric furnace, fluid electric furnace, rotary electric furnace, burner furnace and methods using a microwave.

The amount of the resin layers in the carrier is preferably 0.01% by mass to 5.0% by mass. When the amount is less than 0.01% by mass, the resin layer may not be formed uniformly on the surface of the core material, and when the amount is more than 5.0% by mass, the resin layer becomes too thick and granulation between carriers occur and uniform carrier particles may not be obtained.

If the developer is a two-component developer, the carrier content in the two-component developer is not particularly limited and may be selected accordingly, and it is preferably 90% by mass to 98% by mass and more preferably 93% by mass to 97% by mass.

With regard to the mixing ratio of toner and carrier of the two-component developer, the toner is 1 part by mass to 10.0 parts by mass relative to 100 parts by mass of the carrier in general.

(Image Forming Apparatus and Image Forming Method)

The image forming apparatus of the present invention includes at least a latent electrostatic image bearing member, a charge controlling unit configured to charge a surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, and further includes a cleaning unit, and other units suitably selected in accordance with the necessity, for example, a charge eliminating unit, a recycling unit, and controlling unit and the like. Note that a combination of the charging unit and the exposing unit may be called a latent electrostatic image forming unit. The toner used in the developing unit is an image-forming toner according to the present invention.

The image forming method of the present invention includes at least a charging step for charging a surface of a latent electrostatic image bearing member, an exposing step for exposing the charged surface of the latent electrostatic image bearing member to form a latent electrostatic image, a developing step for developing the latent electrostatic image using a toner to form a visible image, a transferring step for transferring the visible image onto a recording medium, and a fixing step for fixing the transferred image on the recording medium, and further includes a cleaning step and other steps suitably selected in accordance with the necessity, for example, a charge eliminating step, a recycling step, a controlling step and the like. Note that a combination of the charging step and the exposing step may be called a latent electrostatic image forming step. The toner used in the developing step is an image-forming toner according to the present invention.

The image forming method of the present invention can be favorably carried out by the image forming apparatus of the present invention. Specifically, the charging step can be carried out by the charging unit; the exposing step can be carried out by the exposing unit; the developing step can be carried out by the developing unit; the transferring step can be carried out by the transfer unit; the fixing step can be carried out by the fixing unit; the cleaning step can be carried out by the cleaning unit; and the other steps can be carried out by the other units.

The image-forming toner of the present invention can also be used and housed in a process cartridge detachably mounted on a main body of an image forming apparatus, which includes at least the latent electrostatic image bearing member and the developing unit.

FIG. 1 is an illustration schematically showing a configuration of an image forming apparatus equipped with a process cartridge in which the image-forming toner of the present invention is used.

In FIG. 1, reference numeral 1 denotes the entire body of a process cartridge, reference numeral 2 denotes a photoconductor (may be referred to as "latent electrostatic image bearing member"), reference numeral 3 denotes a charging unit, reference numeral 4 denotes a developing unit, and reference numeral 5 denotes a cleaning unit.

In the present invention, a plurality of the configuration elements including the photoconductor 2, the charging unit 3, the developing unit 4 and the cleaning unit 5 are integrally combined into one unit as a process cartridge, and the process cartridge is detachably mounted on a main body of an image forming apparatus such as a copier and a printer.

The following description explains an operation of an image forming apparatus equipped with a process cartridge in which the image-forming toner of the present invention is provided.

The photoconductor 2 is driven to rotate at a predetermined circumferential speed. The photoconductor 2 receives uniform charge of positive or negative predetermined potential from the charging unit 3 in the rotating process, then is exposed to image exposure light from an image exposing unit (not shown) such as a slit exposure and laser beam, and thus latent electrostatic images are sequentially formed on the surface of the photoconductor 2. Thus formed latent electrostatic images are developed by toner with the developing unit 4, developed toner images are sequentially transferred onto a recording medium by a transfer unit (not shown), which is fed from a paper-feeding unit between the photoconductor and the transfer unit (not shown) so as to match the rotation of the photoconductor. The recording medium having transferred images is separated from the surface of the photoconductor, introduced to a fixing unit (not shown), and images are fixed and printed out as a copy or print to the outside of the apparatus. The surface of the photoconductor after image transfer is cleaned as a result of removal of untransferred toner residue remaining by the cleaning unit 5, discharged, and then is used for subsequent image formation repeatedly.

EXAMPLES

Hereinafter, Examples of the present invention will be described, which however shall not be construed as limiting the scope of the present invention. In the following description, "part" or "parts" represents "part by mass" or "parts by mass".

Production Example A-1

Production of Linear Polyester Resin (b1)

Into an autoclave reaction vessel equipped with a thermometer, a stirrer and a nitrogen inlet tube, 3 parts of 1,3-propanediol, 450 parts of L-lactic acid lactide, 50 parts of D-lactic acid lactide, and 2 parts of 2-ethylhexyltin were charged, the mixture was subjected to ring-opening polymerization under normal pressure at a temperature of 160° C. for 3 hours and further reacted under normal pressure at a temperature of 130° C. to yield a resin. The resin taken out from the autoclave was cooled to room temperature, and then pulverized to form particles to thereby obtain a polyester diol having a polyhydroxycarboxylic acid skeleton (optical purity: 80%). Subsequently, 400 parts of thus obtained polyester diol having polyhydroxycarboxylic acid skeleton (hydroxyl value: 11.2) and 100 parts of polyester diol (hydroxyl value: 56) [which had been obtained by dehydration condensation of a bisphenol A-EO (2 moles) adduct and a terephthalic acid at a molar ratio of 1:1 to be synthesized] were dissolved in methylethylketone to prepare a solution, 20 parts of IPDI as a chain extending agent were added to the solution, and the solution was subjected to an elongation reaction at 50° C. for 6 hours, followed by distilling the solvent away to thereby obtain [Polyester b1-1]. [Polyester b1-1] was found to have a Tg of 43° C.

Production Example A-2

Production of Linear Polyester Resin (b1)

Into an autoclave reaction vessel equipped with a thermometer, a stirrer and a nitrogen inlet tube, 3 parts of 1,4-butanediol, 400 parts of L-lactic acid lactide, 100 parts of D-lactic acid lactide, and 2 parts of 2-ethylhexyltin were charged, the mixture was subjected to ring-opening polymerization under normal pressure at a temperature of 160° C. for 3 hours and further reacted under normal pressure at a temperature of 130° C. to yield a resin. The resin taken out from the autoclave was cooled to room temperature, and then pulverized to form particles to thereby obtain a polyester diol having a polyhydroxycarboxylic acid skeleton (optical purity: 60%). Subsequently, 200 parts of thus obtained polyester diol having polyhydroxycarboxylic acid skeleton (hydroxyl value: 11.2) and 300 parts of polyester diol (hydroxyl value: 56) [which had been obtained by dehydration condensation of a bisphenol A-EO (2 moles) adduct and a terephthalic acid at a molar ratio of 1:1 to be synthesized] were dissolved in methylethylketone to prepare a solution, 38 parts of IPDI as a chain extending agent were added to the solution, and the solution was subjected to an elongation reaction at 50° C. for 6 hours, followed by distilling the solvent away to thereby obtain [Polyester b1-2]. [Polyester b1-2] was found to have a Tg of 46° C.

Production Example A-3

Production of Linear Polyester Resin (b1)

Into an autoclave reaction vessel equipped with a thermometer, a stirrer and a nitrogen inlet tube, 3 parts of 1,3-propanediol, 400 parts of L-lactic acid lactide, 100 parts of glycoside, and 2 parts of 2-ethylhexyltin were charged, the mixture was subjected to ring-opening polymerization under normal pressure at a temperature of 160° C. for 3 hours and further reacted under normal pressure at a temperature of 130° C. to yield a resin. The resin taken out from the autoclave was cooled to room temperature, and then pulverized to form particles to thereby obtain a polyester diol having a polyhydroxycarboxylic acid skeleton (optical purity: 100%). Subsequently, 250 parts of thus obtained polyester diol having polyhydroxycarboxylic acid skeleton (hydroxyl value: 11.2) and 250 parts of polyester diol (hydroxyl value: 56) [which had been obtained by dehydration condensation of a bisphenol A-EO (2 moles) adduct and a terephthalic acid at a molar ratio of 1:1 to be synthesized] were melted to prepare a solution, 25 parts of adipic acid as a chain extending agent were added to the solution, and the solution was reacted under reduced pressure of 10 mmHg to 15 mmHg for 5 hours to thereby obtain [Polyester b1-3]. [Polyester b1-3] was found to have a Tg of 49° C.

Production Example A-4

Production of Linear Polyester Resin (b1)

Into an autoclave reaction vessel equipped with a thermometer, a stirrer and a nitrogen inlet tube, 3 parts of 1,4-butanediol, 450 parts of L-lactic acid lactide, 50 parts of D-lactic acid lactide, and 2 parts of tetrabutoxy titanate were charged, the mixture was dehydration-condensed under normal pressure at a temperature of 160° C. for 3 hours and further dehydration-condensed under reduced pressure of 10 mmHg to 15 mmHg at a temperature of 160° C. to yield a resin. The resin taken out from the autoclave was cooled to room temperature, and then pulverized to form particles to thereby obtain a polyester diol having a polyhydroxycarboxylic acid skeleton (optical purity: 80%). Subsequently, 400 parts of thus obtained polyester diol having polyhydroxycarboxylic acid skeleton (hydroxyl value: 11.2) and 100 parts of polyester diol (hydroxyl value: 56) [which had been obtained by dehydration condensation of a bisphenol A-EO (2 moles) adduct and a terephthalic acid at a molar ratio of 1:1 to be synthesized] were dissolved in methylethylketone to prepare a solution, 20 parts of IPDI as a chain extending agent were added to the solution, and the solution was subjected to an elongation reaction at 50° C. for 6 hours, followed by distilling the solvent away to thereby obtain [Polyester b1-4]. [Polyester b1-4] was found to have a Tg of 48° C.

Production Example A-5

Production of Linear Polyester Resin (b1)

Into an autoclave reaction vessel equipped with a thermometer, a stirrer and a nitrogen inlet tube, 3 parts of 1,4-butanediol, 450 parts of L-lactic acid lactide, 50 parts of D-lactic acid lactide, and 2 parts of tetrabutoxy titanate were charged, the mixture was dehydration-condensed under normal pressure at a temperature of 160° C. for 3 hours and further dehydration-condensed under reduced pressure of 10 mmHg to 15 mmHg at a temperature of 160° C. to yield a resin. The resin taken out from the autoclave was cooled to room temperature, and then pulverized to form particles to thereby obtain a polyester diol having a polyhydroxycarboxylic acid skeleton (optical purity: 80%). Subsequently, 400 parts of thus obtained polyester diol having polyhydroxycarboxylic acid skeleton (hydroxyl value: 11.2) and 100 parts of polyester diol (hydroxyl value: 56) [which had been obtained by dehydration condensation of 1,2-propylene glycol and a terephthalic acid at a molar ratio of 1:1 to be synthesized] were dissolved in methylethylketone to prepare a solution, 20 parts of IPDI as a chain extending agent were added to the solution, and the solution was subjected to an elongation reaction at 50° C. for 6 hours, followed by distilling the solvent away to thereby obtain [Polyester b1-5]. [Polyester b1-5] was found to have a Tg of 48° C.

Production Example A-6

Production of Polyester Resin

Into an autoclave reaction vessel equipped with a thermometer and a stirrer, 9 parts of glycerine, 288 parts of L-lactic acid lactide, and 2 parts of dibutyltin oxide were charged, and the reaction vessel was substituted with nitrogen gas. Subsequently the mixture was subjected to ring-opening polymerization under normal pressure at a temperature of 160° C. for 6 hours and further reacted under reduced pressure of 10 mmHg to 15 mmHg for 5 hours. The reaction mixture was cooled to 110° C., 18 parts of IPDI were added thereto, and the mixture was further reacted at 110° C. for 5 hours, followed by distilling the solvent away to thereby obtain [urethane-modified polyester] having a weight average molecular weight Mw of 70,000 and having a free isocyanate content of 0.5% (optical purity: 100%).

Production Example A-7

Production of Polyester Resin

Into an autoclave reaction vessel equipped with a thermometer and a stirrer, 6 parts of ethylene glycol, 400 parts of L-lactic acid lactide, and 2 parts of dibutyltin oxide were charged, and the reaction vessel was substituted with nitrogen gas. Subsequently the mixture was subjected to ring-opening polymerization under normal pressure at a temperature of 160° C. for 8 hours and further reacted under reduced pressure of 10 mmHg to 15 mmHg for 5 hours to thereby obtain [polyester 1] (optical purity: 100%). [polyester 1] was found to have a Tg of 40° C.

Production Example A-8

Production of Polyester Resin

Into a reaction vessel equipped with a thermometer, a stirrer and a nitrogen inlet tube, 701 parts of 1,2-propylene glycol, 716 parts of dimethyl terephthalate, 180 parts of adipic acid, and 3 parts of tetrabutoxy titanate as a condensation catalyst, were charged, and the mixture was reacted at 180° C. under a nitrogen gas stream for 8 hours while distilling generated methanol away. Subsequently, while gradually increasing the temperature to 230° C., the mixture was reacted under a nitrogen gas stream for 4 hours with generated 1,2-propylene glycol and water being distilled away, further reacted under reduced pressure of 5 mmHg to 20 mmHg, and the reaction product was taken out when the softening point thereof reached 150° C. Into an autoclave reaction vessel equipped with a thermometer and a stirrer, 100 parts of the resulting resin, 400 parts of L-lactic acid lactide, 100 parts of racemate lactide and 1 part of titanium terephthalate were charged, and the reaction vessel was substituted with nitrogen gas, followed by polymerization at 160° C. for 6 hours, thereby obtaining [polyester 2] (optical purity: 80%). [polyester 2] was found to have a Tg of 47° C.

Production Example A-9

Production of Polyester Resin

Into a reaction vessel equipped with a thermometer, a stirrer and a nitrogen inlet tube, 781 parts of 1,2-propylene glycol, 794 parts of dimethyl terephthalate, 66 parts of adipic acid, 38 parts of trimellitic anhydride, and 1 part of titanium terephthalate as a polymerization catalyst, were charged, and the mixture was reacted at 180° C. under a nitrogen gas stream for 8 hours while distilling generated methanol away. Subsequently, while gradually increasing the temperature to 230° C., the mixture was reacted under a nitrogen gas stream for 4 hours with generated 1,2-propylene glycol and water being distilled away, further reacted under reduced pressure of 5 mmHg to 20 mmHg for 1 hour, and the reaction product was taken out when the softening point thereof reached 160° C., thereby obtaining [polyester 3]. [polyester 3] was found to have a Tg of 61° C.

Production Example A-10

Production of Modified Wax

Into an autoclave reaction vessel equipped with a thermometer and a stirrer, 454 parts of xylene, and 150 parts of low-molecular weight polyethylene (SANWAX LEL-400, softening point: 128° C., produced by Sanyo Chemical Industries, Ltd.) were charged, and the reaction vessel was substituted with nitrogen gas. Then, the temperature was increased to 170° C. so that the components were adequately dissolved. Subsequently, a mixture solution containing 595 parts of styrene, 255 parts of methyl methacrylate, 34 parts of di-t-butylperoxy-hexahydroteraphthalate, and 119 parts of xylene was delivered by drops into the reaction vessel in 3 hours at a temperature of 170° C. so as to polymerize the components, and further, and the reaction temperature was maintained for 30 minutes, followed by removal of the solvent, thereby obtaining [modified wax 1]. [modified wax 1] was found to have an sp value of grafted chains of 10.35 $(cal/cm^3)^{1/2}$, an Mn of 1,872, an Mw of 5,194, and a Tg of 56.9° C.

Production Example A-11

Production of Resin

[Polyester 3] (200 parts) and [polyester b1-2] (800 parts) were melt-kneaded at a temperature of 100° C. to 130° C. using a biaxial kneader (PCM-30, manufactured by IKEGAI, LTD.) to obtain a kneaded product. Then, the kneaded product was cooled to room temperature, and then coarsely crushed to particle size of 200 μm to 300 μm using a hammer mill, thereby obtaining [resin 1] ((b1) content in the resin: 80%; optical purity of (b1): 60%).

Production Example A-12

Production of Resin

[Polyester b1-1] (1,000 parts) was coarsely crushed to particle size of 200 μm to 300 μm to obtain [resin 2] ((b1) content in the resin: 100%; optical purity of (b1): 80%).

Production Example A-13

Production of Resin

[Polyester 3] (200 parts) and [polyester b1-3] (800 parts) were melt-kneaded, and then pulverized in a similar manner as that described in Production Example 11, thereby obtaining [resin 3] ((b1) content in the resin: 80%; optical purity of (b1): 100%).

Example A-14

Production of Resin

[Urethane-modified polyester] (200 parts) and [polyester b1-4] (800 parts) were melt-kneaded, and then pulverized in a similar manner as that described in Production Example 11, thereby obtaining [resin 4] ((b1) content in the resin: 80%; optical purity of (b1): 80%).

Production Example A-15

Production of Resin

[Urethane-modified polyester] (200 parts) and [polyester b1-5] (800 parts) were melt-kneaded, and then pulverized in a similar manner as that described in Production Example 11, thereby obtaining [resin 5] ((b1) content in the resin: 80%; optical purity of (b1): 80%).

Production Example A-16

Production of Resin

[Polyester 3] (350 parts) and [polyester b1-3] (650 parts) were melt-kneaded, and then pulverized in a similar manner as that described in Production Example 11, thereby obtaining [resin 6] ((b1) content in the resin: 65%; optical purity of (b1): 100%).

Production Example A-17

Production of Resin

[Urethane-modified polyester] (200 parts) and [polyester 1] (800 parts) were melt-kneaded, and then pulverized in a similar manner as that described in Production Example 11, thereby obtaining [resin 7] ((b1) content in the resin: 0%; optical purity of (b1): 0%).

Production Example A-18

Production of Resin

[Urethane-modified polyester] (200 parts) and [polyester 2] (800 parts) were melt-kneaded, and then pulverized in a similar manner as that described in Production Example 11, thereby obtaining [resin 8] ((b1) content in the resin: 0%; optical purity of (b1): 0%).

[Measurement Method of Weight Average Particle Diameter of Toner]

- measuring machine: COULTER MULTISIZER III (manufactured by Beckman Coulter Co.)
- aperture diameter: 100 μm
- analysis software: COULTER MULTISIZER ACCUCOMP Ver. 1.19 (produced by Beckman Coulter Co.)
- electrolyte: ISOTON II (produced by Beckman Coulter Co.)
- dispersion liquid: EMULGEN 109P-5% electrolyte (polyoxyethylene lauryl ether; HLB 13.6, produced by KAO Corporation)
- dispersion conditions: 10 mg of a measurement sample was added to 5 mL of the dispersion liquid and dispersed in a supersonic dispersing machine for 1 minute. Then, 25 mL of the electrolyte was added the dispersed product, followed by dispersion treatment in the supersonic dispersing machine for 1 minute.
- measurement conditions: 100 mL of the electrolyte and the dispersion liquid were added into a beaker, and 30,000 particles were measured at a concentration whereby particle diameters of 30,000 particles can be measured in 20 seconds to obtain a particle size distribution, so that the weight average particle diameter of the sample was determined from the particle size distribution.

Example A-1

| (Toner formulation) | |
|---|---|
| resin 1 | 84 parts |
| paraffin wax (melting point: 73° C.) | 5 parts |
| modified wax 1 | 1 part |
| carbon black (#44, produced by Mitsubishi Chemical Co., Ltd.) | 10 parts |

The toner starting material described above was premixed by HENSCHEL MIXER (FM10B, manufactured by Mitsui Miike Kakouki Co., Ltd.), and then melt-kneaded at a temperature of 100° C. to 130° C. by a biaxial kneader (PCM-30, manufactured by IKEGAI, LTD.). The resulting kneaded product was cooled to room temperature, and then coarsely crushed to particle size of 200 μm to 300 μm using a hammer mill. Subsequently, the crushed product was finely pulverized by a supersonic jet pulverizer, LABOJET, (manufactured by Nihon Pneumatic Industry Co., Ltd.) while appropriately controlling the pulverization air pressure so that its weight average particle diameter was 6.2 μm±0.3 μm and then classified using an airflow classifier (MDS-I, manufactured by Nihon Pneumatic Industry Co., Ltd.) while appropriately controlling the louver opening width so that the amount of fine particles having a weight average particle diameter of 7.0 μm±0.2 μm and 4 μm or smaller was 10% by number or less to thereby obtain a toner base particle. Subsequently, 1.0 part by mass of an additive (silica, HDK-2000, produced by Clariant Co.) was mixed with 100 parts by mass of the toner base particle while stirring by means of HENSCHEL MIXER, thereby producing Toner A-1.

Example A-2

| (Toner formulation) | |
|---|---|
| resin 2 | 58.8 parts |
| resin 4 | 25.2 parts |
| paraffin wax (melting point: 73° C.) | 5 parts |
| modified wax 1 | 1 part |
| carbon black (#44, produced by Mitsubishi Chemical Co., Ltd.) | 10 parts |

Toner A-2 was produced in a similar manner to that described in Example A-1 except that the toner formulation was changed to the formulation described above.

Example A-3

| (Toner formulation) | |
|---|---|
| resin 2 | 42 parts |
| resin 3 | 42 parts |
| paraffin wax (melting point: 73° C.) | 5 parts |

-continued

| (Toner formulation) | |
|---|---|
| modified wax 1 | 1 part |
| carbon black (#44, produced by Mitsubishi Chemical Co., Ltd.) | 10 parts |

Toner A-3 was produced in a similar manner to that described in Example A-1 except that the toner formulation was changed to the formulation described above.

Example A-4

| (Toner formulation) | |
|---|---|
| resin 3 | 84 parts |
| paraffin wax (melting point: 73° C.) | 5 parts |
| modified wax 1 | 1 part |
| carbon black (#44, produced by Mitsubishi Chemical Co., Ltd.) | 10 parts |

Toner A-4 was produced in a similar manner to that described in Example A-1 except that the toner formulation was changed to the formulation described above.

Example A-5

| (Toner formulation) | |
|---|---|
| resin 4 | 42 parts |
| resin 3 | 42 parts |
| carnauba wax (melting point: 80° C.) | 5 parts |
| modified wax 1 | 1 part |
| carbon black (#44, produced by Mitsubishi Chemical Co., Ltd.) | 10 parts |

Toner A-5 was produced in a similar manner to that described in Example A-1 except that the toner formulation was changed to the formulation described above.

Example A-6

| (Toner formulation) | |
|---|---|
| resin 5 | 84 parts |
| paraffin wax (melting point: 73° C.) | 5 parts |
| modified wax 1 | 1 part |
| carbon black (#44, produced by Mitsubishi Chemical Co., Ltd.) | 10 parts |

Toner A-6 was produced in a similar manner to that described in Example A-1 except that the toner formulation was changed to the formulation described above.

Example A-7

| (Toner formulation) | |
|---|---|
| resin 6 | 84 parts |
| carnauba wax (melting point: 80° C.) | 5 parts |
| modified wax | 1 part |
| carbon black (#44, produced by Mitsubishi Chemical Co., Ltd.) | 10 parts |

Toner A-7 was produced in a similar manner to that described in Example A-1 except that the toner formulation was changed to the formulation described above.

Comparative Example A-1

| (Toner formulation) | |
|---|---|
| resin 7 | 84 parts |
| paraffin wax (melting point: 73° C.) | 5 parts |
| modified wax 1 | 1 part |
| carbon black (#44, produced by Mitsubishi Chemical Co., Ltd.) | 10 parts |

Toner A-8 was produced in a similar manner to that described in Example A-1 except that the toner formulation was changed to the formulation described above.

Comparative Example A-2

| (Toner formulation) | |
|---|---|
| resin 8 | 84 parts |
| paraffin wax (melting point: 73° C.) | 5 parts |
| modified wax 1 | 1 part |
| carbon black (#44, produced by Mitsubishi Chemical Co., Ltd.) | 10 parts |

Toner A-9 was produced in a similar manner to that described in Example A-1 except that the toner formulation was changed to the formulation described above.

The toners of Examples A-1 to A-7 and Comparative Examples A-1 to A-2 were measured for their chargeability, heat-resistant storage stability, fusibility, and haze degree in accordance with the following measurement methods, and then evaluated. The evaluation results are shown in Table A-1.

[Chargeability (Charged Amount)]

In a 50 cc glass bottle with ground-in stopper, each toner produced and iron powder ("F-150" produced by to Japan-Iron-Powder Co., Ltd.) were each precisely weighed in an amount of 10 g and placed in a turbula shaker mixer (manufactured by Willy A Bachofen AG) in an atmosphere of 23° C. and RH 50% and stirred at 90 rpm for 2 minutes. After stirring, 0.2 g of the mixed powder was charged to a blow off powder charge measuring apparatus (TB-203, manufactured by KYOCERA Corporation) equipped with a stainless steel mesh having an aperture size of 20 μm, and the charged amount of iron residue was measured to thereby determining the charged amount of resin particles, under a blow pressure of 10 Kpa and suction pressure of 5 Kpa by calculation in accordance with the common method. Note that as a toner powder, the higher the negative charge amount, the more excellent the chargeability is. The evaluation criteria are as follows:

A: −25 μC/g or less

B: more than −25 μC/g

C: −20 μC/g or less

D: more than −20 μC/g

[Heat-Resistant Storage Stability]

Each produced toner was left at rest for 15 hours in a drying machine whose inside temperature was controlled at 50° C. and then evaluated depending on the blocking degree, based on the following criteria.

A: No blocking occurred.

B: Blocking slightly occurred, but under application of force, the toner was easily dispersed.

C: Blocking occurred, and the toner was not dispersed even under application of force.

[Fusibility]

Each produced toner was placed in uniform thickness on a paper surface so that the amount was 0.6 mg/cm$^2$, (on that occasion, as a method of placing a toner powder on a paper surface, a printer was used from which the heat-fixing device has been removed, however, other method may be employed provided that toner powder can be placed in uniform thickness with the above weight density). A temperature at which cold offset occurred when the paper passed the pressurizing roller at a fixing speed (circumferential speed of heating roller) of 213 mm/sec, and a fixing pressure (pressure of pressuring roller) of 10 kg/cm$^2$ was measured. The evaluation criteria are as follows:

A: 120° C. or lower; B: higher than 120° C. and 140° C. or lower; C: higher than 140° C.

[Haze Degree]

An image was formed on an OHP sheet in a similar manner as that described above in "fusibility" test, and the haze degree of each produced toner was measured in compliance with JISK7136, using a haze meter ("NDH 2000, manufactured by Nippon Denshoku Industries Co., Ltd.). Haze degree is also called "degree of cloudiness" and measured as an indicator showing the transparency of resin film. The lower the haze value, the higher the transparency is. The evaluation criteria are as follows:

A: 20% or lower; B: higher than 20% and 30% or lower; C: higher than 30%

[Volume Specific Resistance]

Measurement of the volume specific resistance Log R of each produced toner was measured according to the following method. Firstly, 3 g of toner was molded in the form of a pellet of 2 mm in thickness to prepare a measurement toner sample. Then, the sample was placed at electrodes for solid, SE-70 (manufactured by Ando Electric Co., Ltd.). Then, a volume specific resistance Log R when 1 kHz of alternating current was applied to the electrodes was measured by a measuring device composed of a TR-10C Model dielectric loss measurement meter, a WBG-9 oscillator and a BDA-9 equilibrium position detector (all manufactured by Ando Electric Co., Ltd.), whereby the volume specific resistance value Log R was determined. The higher the Log R value, the more easily charge can be held, and preferably, the smaller in variation of charge amount. The evaluation criteria are as follows:

A: 11.0 Log Ω·cm or higher

B: 10.0 Log Ω·cm or higher and lower than 11.0 Log Ω·cm

C: lower than 10.0 Log Ω·cm

[Image Density]

In a similar manner as that described above in "fusibility" test, each produced toner was placed in uniform thickness on a paper surface so that the amount was 0.4 mg/cm$^2$, and an image density of the toner sample when the paper passed the pressurizing roller at a fixing speed (circumferential speed of heating roller) of 213 mm/sec, and a fixing pressure (pressure of pressuring roller) of 10 kg/cm$^2$ was measured using an X-Rite 938 (manufactured by X-Rite Corp.). The image density of each toner was evaluated by measuring the visual density. The evaluation criteria are as follows:

A: visual density: 1.4 or higher

B: visual density: 1.2 or higher and lower than 1.4

C: visual density: lower than 1.2

TABLE A-1

| | Example | | | | | | | Comparative Example | |
|---|---|---|---|---|---|---|---|---|---|
| | A-1 | A-2 | A-3 | A-4 | A-5 | A-6 | A-7 | A-1 | A-2 |
| (b1) content | 80 | 94 | 90 | 80 | 80 | 80 | 65 | 0 | 0 |
| Optical purity of (b1) | 60 | 80 | 90 | 100 | 90 | 80 | 100 | — | — |
| Charged amount | A | A | B | A | A | A | A | B | C |
| Fusibility | A | A | A | A | A | A | A | C | C |
| Heat resistant-storage stability | A | A | A | A | A | A | A | B | B |
| Image density | A | A | B | B | A | A | A | C | C |
| Volume specific resistance | A | A | B | B | A | A | A | C | C |
| Haze degree | A | A | B | B | A | A | A | C | C |

Production Example B-A

Production of Aqueous Dispersion Liquid for Resin Particle (A)

Into a reaction vessel equipped with a stirrer and a thermometer, 680 parts of water, 139 parts of styrene, 99 parts of methacrylic acid, 49 parts of butyl acrylate, 11 parts of sodium alkyl allyl sulfosuccinate (ELEMINOL JS-2, manufactured by Sanyo Chemical Industries, Ltd.), 1 part of ammonium persulfate were charged, and stirred at 400 rpm for 15 minutes to thereby obtain a white liquid emulsion. Then, the temperature of the system was raised to 75° C. by heating and reacted for 5 hours. Further, 30 parts of 1% ammonium persulfate aqueous solution was added to the system and aged at 75° C. for 5 hours to thereby obtain an aqueous dispersion liquid of vinyl resin (copolymer of styrene methacrylate-butyl methacrylate-sodium alkyl allyl sulfosuccinate) [fine particle dispersion liquid W1]. The volume average particle diameter measured by ELS-800 was 0.09 μm. A part of [fine particle dispersion liquid W1]. was dried so that resin parts were isolated. The glass transition temperature of the resin parts measured by a flow tester was 76° C.

Production Examples B1 to B13

Production of Resin (b1) and (b01)

Into an autoclave equipped with a stirrer and a nitrogen inlet tube, the starting material described in "polyester diol (b11)" in Table B-1 and 2 parts of 2-ethylhexyl tin were charged and subjected to ring-opening reaction under normal pressure at 160° C. for 3 hours, and further reacted under normal pressure at 130° C. The resin taken out from the autoclave was cooled to room temperature, and then pulverized to form particles to thereby obtain 12 types of polyester diol (b11) having a polyhydroxycarboxylic acid skeleton. Each polyester diol (12), which had been obtained by dehydration of a starting material shown in "polyester diol (b12) in Table 1 and each of the 12 types of polyester diol (b11) were used in a combination as described in Table B1 and dissolved in methylethylketone. Subsequently, IPDI as a chain extending agent was added and subjected to elongation reaction at 50° C. for 6 hours, followed by distilling the solvent away, thereby obtaining [Polyester b1-11 to b1-19] of Production Examples B-1 to B-13 and [Polyester b01-1 to b01-3].

TABLE B-1

| | Polyester (b1) (b01) | | | | | |
|---|---|---|---|---|---|---|
| | | | | | Polyester diol (b12) | |
| | Polyester diol (b11) | | | | bisphenol A | |
| | 1,3-propane diol (part by mass) | 1,4-butane diol (part by mass) | L-lactic acid lactide (part by mass) | D-lactic acid lactide (part by mass) | EO-dimer adduct (part by mass) | terephthalic acid (part by mass) |
| Polyester b1-11 | 2 | 0 | 66 | 12 | 10 | 10 |
| Polyester b1-12 | 0 | 2 | 62 | 11 | 12.5 | 12.5 |
| Polyester b1-13 | 2 | 0 | 41 | 7 | 25 | 25 |
| Polyester b1-14 | 0 | 2 | 58 | 15 | 12.5 | 12.5 |
| Polyester b1-15 | 2 | 0 | 51 | 22 | 12.5 | 12.5 |
| Polyester b1-16 | 0 | 2 | 44 | 29 | 12.5 | 12.5 |
| Polyester b1-17 | 2 | 0 | 73 | 0 | 12.5 | 12.5 |
| Polyester b1-18 | 0 | 2 | 67 | 6 | 12.5 | 12.5 |
| Polyester b1-19 | 2 | 0 | 69 | 4 | 12.5 | 12.5 |
| Polyester b01-1 | 2 | 0 | 74 | 25 | 0 | 0 |
| Polyester b01-2 | 0 | 2 | 93 | 5 | 0 | 0 |
| Polyester b01-3 | 2 | 0 | 98 | 0 | 0 | 0 |

—Preparation of Aqueous Medium—

Ion exchanged water (300 parts by mass), [fine particle dispersion liquid W1] (300 parts by mass), and sodium dodecylbenzene sulfonate (0.2 parts by mass) were mixed with stirring so as to be uniformly dissolved to prepare an aqueous medium phase.

—Synthesis of Polyester Prepolymer—

Into a reaction vessel equipped with a condenser, a stirrer and a nitrogen inlet tube, 680 parts by mass of ethylene oxide dimer adduct of bisphenol A, 80 parts by mass of propylene oxide dimer adduct of bisphenol A, 282 parts by mass of terephthalic acid, 22 parts by mass of trimellitic anhydride, and 2 parts by mass of dibutyltin oxide were charged, and reacted under normal pressure at 230° C. for 7 hours, further reacted under reduced pressure of 10 mmH to 15 mmHg for 5 hours to thereby synthesize an intermediate polyester resin 2. The resulting intermediate polyester resin 2 was found to have a number average molecular weight (Mn) of 2,300, a weight average molecular weight (Mw) of 9,900, a peak molecular weight of 3,100, a glass transition temperature (Tg) of 55° C., an acid value of 0.4 mgKOH/g, and a hydroxyl value of 51 mgKOH/g.

Next, into a reaction vessel equipped with a condenser, a stirrer, and a nitrogen inlet tube, 395 parts by mass of the intermediate polyester resin 2, 91 parts by mass of isophoronediisocyanate, and 550 parts by mass of ethyl acetate were charged, and reacted at 100° C. for 6 hours to thereby synthesize [polyester prepolymer]. The resulting polyester prepolymer was found to have a free isocyanate content of 1.47% by mass.

—Preparation of Masterbatch—

Water (1,000 parts by mass), carbon black (530 parts by mass) having a DBP oil absorption of 42 mL/100 g and pH of 9.5 (PRINTEX 35, produced by Degusa AG) and 1,200 parts by mass of the resin were mixed by means of a HENSCHEL MIXER (manufactured by Mitsui Mining Co., Ltd.). The resulting mixture was kneaded using a two-roll at 150° C. for 30 minutes, then rolled and cooled, and pulverized using a pulverizer (manufactured by Hosokawa Micron Co., Ltd.) to thereby prepare a masterbatch.

—Synthesis of Ketimine Compound—

In a reaction vessel equipped with a stirrer and a thermometer, 30 parts by mass of isophoronediamine, and 70 parts by mass of methylethylketone were charged and reacted at 50° C. for 5 hours to thereby synthesize a ketimine compound. The resulting ketimine compound was found to have an amine value of 423 mgKOH/g.

Examples B-1 to B-9 and Comparative Examples B-1 to B-4

Production of Toner B-1 to B-13

In a reaction vessel, [polyester b1-11 to b1-19] and [polyester b01-1 to b01-3], [polyester prepolymer] each in an amount of parts shown in Table B-2 and 80 parts by mass of ethyl acetate were added and stirred to thereby prepare resin solution B-1 to B-13.

TABLE B-2

| | | Composition of resin solution | | |
|---|---|---|---|---|
| | Resin solution No. | Polyester (b1) (b01) (part by mass) | | Polyester prepolymer (b0) (part by mass) |
| Toner B-1 | Resin solution B-1 | Polyester b1-11 | 100 | 25 |
| Toner B-2 | Resin solution B-2 | Polyester b1-12 | 100 | 25 |
| Toner B-3 | Resin solution B-3 | Polyester b1-13 | 100 | 40 |
| Toner B-4 | Resin solution B-4 | Polyester b1-14 | 100 | 25 |
| Toner B-5 | Resin solution B-5 | Polyester b1-15 | 100 | 25 |
| Toner B-6 | Resin solution B-6 | Polyester b1-16 | 100 | 25 |
| Toner B-7 | Resin solution B-7 | Polyester b1-17 | 100 | 25 |

TABLE B-2-continued

| | Resin solution No. | Composition of resin solution: Polyester (b1) (b01) (part by mass) | | Polyester prepolymer (b0) (part by mass) |
|---|---|---|---|---|
| Toner B-8 | Resin solution B-8 | Polyester b1-18 | 100 | 25 |
| Toner B-9 | Resin solution B-9 | Polyester b1-19 | 100 | 25 |
| Toner B-10 | Resin solution B-10 | | | 100 |
| Toner B-11 | Resin solution B-11 | Polyester b0-2 | 100 | 5 |
| Toner B-12 | Resin solution B-12 | Polyester b0-3 | 100 | 20 |
| Toner B-13 | Resin solution B-13 | Polyester b0-4 | 100 | 20 |

Next, into each of the resin solution B-1 to B-13, 5 parts by mass of carnauba wax (molecular weight: 1,700; acid value: 2.8 mgKOH/g, penetration: 1.6 mm (40° C.), and 5 parts by mass of the masterbatch were added, and passed three times through a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume. Further, 2.5 parts by mass of the ketimine compound was added thereto and dissolved therein to thereby obtain a toner material liquid.

Next, into a vessel, 150 parts by mass of an aqueous medium was poured, and while the medium being stirred at 12,000 rpm by a TK-type homomixer (manufactured by Tokush Kikan Kogyo K.K.), 100 parts by mass of the toner starting material liquid was added thereto and mixed for 10 minutes to obtain an emulsion slurry. Further, into a kolben equipped with a stirrer and a thermometer, 100 parts by mass of the emulsion-slurry were introduced, and the solvent was removed at 30° C. for 12 hours while stirring at a stirring circumferential speed of 20 m/min to thereby obtain a dispersion slurry.

Next, 100 parts by mass of the dispersion slurry were filtered under reduced pressure, and 100 parts by mass of ion exchanged water were added to the resulting filtration cake and mixed at 12,000 rpm for 10 minutes using a TK homomixer, followed by a filtration treatment. To the resulting filtration cake, 300 parts by mass of ion exchanged water were added, mixed at 12,000 rpm for 10 minutes using a TK homomixer and filtered. The above process was repeated two times. To the resulting filtration cake, 20 parts by mass of 10% by mass sodium hydroxide aqueous liquid were added, mixed at 12,000 rpm for 30 minutes using a TK homomixer, and filtered under reduced pressure. To the resulting filtration cake, 300 parts by mass of ion exchanged water were added, mixed at 12,000 rpm for 10 minutes using a TK homomixer. To the resulting filtration cake, 300 parts by mass of ion exchanged water were added, mixed at 12,000 rpm for 10 minutes using a TK homomixer and filtered. The above process was repeated two times. To the resulting filtration cake, 20 parts by mass of 10% by mass hydrochloric acid were added, mixed at 12,000 rpm for 10 minutes using a TK homomixer and then filtered. To the resulting filtration cake, 300 parts by mass of ion exchanged water were added, mixed at 12,000 rpm for 10 minutes using a TK homomixer, and then filtered. The above process was repeated two times, thereby obtaining a final filtration cake. The final filtration cake was dried with a circular air-drier at 45° C. for 48 hours and sieved with a mesh with openings of 75 μm to produce toner base particles B-1 to B-13.

—Production of Toner—

Each of the resulting toner base particles B-1 to B-13 (100 parts by mass) and a hydrophobic silica (1.0 part by mass) as an external additive (H2000, produced by Clariant Japan K.K.) were mixed by a HENSCHEL MIXER (manufactured by Mitsui Mining Co., Ltd.) at a circumferential speed of 30 m/sec for 30 seconds and the mixing was stopped for 1 minute, this process was repeated 5 times. After that, the mixed product was then sieved with a mesh with openings of 35 μm, thereby producing Toner B-1 to B-13. The charged amount, fusibility, volume specific resistance, and image density of the thus produced toner were measured according to the respective measurement methods described above, and evaluated. The evaluation results are shown in Table B-4.

—Production of Carrier—

To 100 parts by mass of toluene, 100 parts by mass of a silicone resin (organo straight silicone), 5 parts by mass of γ-(2-aminoethyl)aminopropyl trimethoxysilane, and 10 parts by mass of carbon black were added, dispersed for 20 minutes using a homomixer to prepare a resin layer coating liquid. The resin layer coating liquid was applied on a surface of a spherically shaped magnetite (1,000 parts by mass) with a volume average particle diameter of 50 μm to thereby produce a carrier.

—Production of Developer—

Each Toner B-1 to B-13 (5 parts by mass) and the carrier (95 parts by mass) were mixed to prepare each developer of Examples B-1 to B-9 and Comparative Examples B-1 to B-4.

Next, each of the resultant developers were evaluated for their fixability, heat-resistant storage stability and haze degree. The evaluation results are shown in Table B-3.

[Polyester b1-20 to b1-21] of Examples B-14 and B-15 were respectively obtained in a similar manner to that described in Production Examples B-1 and B-2, except that 3 parts by mass of a layered inorganic mineral montmorillonite (produced by CLAYTON APA Southern Clay Product, Inc.), which had been modified with quaternary ammonium salt having a benzyl group in at least a part thereof, were added to each of the resin solutions B-1 and B-2 of Production Examples B-1 and B-2 and stirred by means of a TK homomixer (manufactured by Tokushu Kikai Kogyo K.K.) for 30 minutes. The polyester b1-20 and b1-21 were used and processed in a similar manner to that described in Production Examples B-1 and B-2, thereby producing Toner B-14 and B-15.

The evaluation results on the toners are regarded as "Examples B-10 and B-11" and shown in Tables B-3 and B-4.

TABLE B-3

| | Toner No. | Dv (μm) | Dn (μm) | Dv/Dn | Minimum limit fixing temperature | Maximum limit fixing temperature | Heat resistant-storage stability | Haze degree |
|---|---|---|---|---|---|---|---|---|
| Ex. B-1 | Toner B-1 | 5.3 | 4.6 | 1.18 | A | B | B | A |
| Ex. B-2 | Toner B-2 | 5.6 | 4.7 | 1.19 | A | A | A | A |
| Ex. B-3 | Toner B-3 | 5.8 | 4.9 | 1.18 | A | B | A | A |

TABLE B-3-continued

| | Toner No. | Dv (μm) | Dn (μm) | Dv/Dn | Minimum limit fixing temperature | Maximum limit fixing temperature | Heat resistant-storage stability | Haze degree |
|---|---|---|---|---|---|---|---|---|
| Ex. B-4 | Toner B-4 | 5.9 | 4.8 | 1.23 | A | B | A | A |
| Ex. B-5 | Toner B-5 | 5.4 | 4.5 | 1.20 | A | A | B | A |
| Ex. B-6 | Toner B-6 | 5.3 | 4.5 | 1.18 | A | B | B | A |
| Ex. B-7 | Toner B-7 | 5.8 | 4.8 | 1.21 | B | A | A | A |
| Ex. B-8 | Toner B-8 | 5.5 | 4.6 | 1.20 | B | B | B | A |
| Ex. B-9 | Toner B-9 | 5.8 | 4.8 | 1.21 | B | A | A | A |
| Ex. B-10 | Toner B-14 | 5.5 | 4.7 | 1.17 | B | A | A | A |
| Ex. B-11 | Toner B-15 | 5.9 | 4.9 | 1.20 | B | A | A | A |
| Comp. B-1 | Toner B-10 | 5.8 | 4.9 | 1.18 | D | B | B | B |
| Comp. B-2 | Toner B-11 | 5.4 | 4.4 | 1.23 | C | C | C | A |
| Comp. B-3 | Toner B-12 | 5.6 | 4.3 | 1.30 | D | B | B | C |
| Comp. B-4 | Toner B-13 | 6.5 | 5.3 | 1.23 | D | D | C | C |

TABLE B-4

| | Toner No. | b1 content in total amount of resin (%) | Optical purity of b1 (%) | Charged amount | Fusibility | Image density | Volume specific resistance |
|---|---|---|---|---|---|---|---|
| Ex. B-1 | Toner B-1 | 80 | 70 | A | A | A | A |
| Ex. B-2 | Toner B-2 | 80 | 70 | A | A | A | A |
| Ex. B-3 | Toner B-3 | 71.4 | 70 | A | A | A | A |
| Ex. B-4 | Toner B-4 | 80 | 60 | A | B | A | A |
| Ex. B-5 | Toner B-5 | 80 | 40 | A | B | A | A |
| Ex. B-6 | Toner B-6 | 80 | 20 | A | B | A | A |
| Ex. B-7 | Toner B-7 | 80 | 100 | A | A | B | B |
| Ex. B-8 | Toner B-8 | 80 | 84 | A | A | B | B |
| Ex. B-9 | Toner B-9 | 80 | 90 | A | A | B | B |
| Ex. B-10 | Toner B-14 | 80 | 70 | A | A | A | A |
| Ex. B-11 | Toner B-15 | 80 | 70 | A | A | A | A |
| Comp. B-1 | Toner B-10 | 0 | — | C | C | B | B |
| Comp. B-2 | Toner B-11 | 95.2 | 50 | C | C | B | B |
| Comp. B-3 | Toner B-12 | 83.3 | 90 | C | B | C | C |
| Comp. B-4 | Toner B-13 | 83.3 | 100 | C | B | C | C |

<Fixability.>

In an electrophotographic copier (MF-200, manufactured by Ricoh Company Ltd.) using a Teflon™ roller as a fixing roller, its fixing unit was remolded for use in evaluation on fixability of toner. A solid image with an attached amount of toner of 0.85 mg/cm$^2$±0.1 mg/cm$^2$ was formed on regular paper and heavy paper, transfer paper Type 6200 (produced by Ricoh Company Ltd.), and copy-printing paper <135> (produced by NBS Ricoh Co., Ltd.). On that occasion, a maximum limit temperature at which no hot offset had occurred on the regular paper was determined as a maximum limit fixing temperature. A minimum limit temperature at which the residual ratio of the image density after the solid image formed on the heavy paper been rubbed with a pad became 70% or more was determined as a minimum limit fixing temperature.

[Evaluation Criteria of Maximum Limit Fixing Temperature]

A: Maximum limit fixing temperature was 190° C. or higher.

B: Maximum limit fixing temperature was equal to or higher than 180° C. and lower than 190° C.

C: Maximum limit fixing temperature was equal to or higher than 170° C. and lower than 180° C.

D: Maximum limit fixing temperature was lower than 170° C.

[Evaluation Criteria of Minimum Limit Fixing Temperature]

A: Minimum limit fixing temperature was lower than 135° C.

B: Minimum limit fixing temperature was equal to or higher than 135° C. and lower than 145° C.

C: Minimum limit fixing temperature was equal to or higher than 145° C. and lower than 155° C.

D: Minimum limit fixing temperature was equal to or higher than 155° C.

<Heat Resistant-Storage Stability (Penetration)>

A 50 mL glass bottle was charged with toner, and the bottle was left at rest in a thermostatic bath in which the temperature was controlled at 50° C. for 24 hours. Then, the resulting toner was cooled to 24° C. and subjected to a penetration test (in accordance with JIS K2235-1991, where the penetration (mm) was measured. The, the toner was evaluated for its heat resistant-storage stability based on the following criteria.

Note that the greater the penetration means the more excellent in heat resistant-storage stability. A toner with a penetration degree of less than 5 mm have a high probability of causing a trouble in practical use.

[Evaluation Criteria]

A: Penetration degree was 25 mm or more.

B: Penetration degree was equal to or more than 15 mm and less than 25 mm

C: Penetration degree was equal to or more than 5 mm and less than 15 mm.

D: Penetration degree was less than 5 mm.

<Haze Degree>

As image samples for use in evaluation of fixability of toner, monochrome image samples were developed on OHP sheets, Type PPC-DX (produced by Ricoh Company Ltd.) with the temperature of the fixing belt being set at 160° C. The haze degree of each of the monochrome image samples was read and measured by a direct-reading haze measuring computer (Model HGM-2DP, manufactured by Suga Tester Co., Ltd.). Haze degree is also called "degree of cloudiness" and measured as an indicator showing the transparency of toner. The lower the haze value, the higher the transparency of the toner is, and when OHP sheet is used, excellent color developing ability is exhibited.

[Evaluation Criteria]

A: Haze degree was lower than 20%.

B: Haze degree was equal to or higher than 20% and lower than 30%.

C: Haze degree was higher than 30%.

Toners all using a polyester diol having a polyhydroxycarboxylic acid skeleton and a diol or diols having no polyhydroxycarboxylic acid skeleton at an appropriate ratio exhibited their superior fixability, heat resistant-storage stability and haze degree (Examples B-1 to B-9). When the optical purity was high (Examples B-7 to B-9), the minimum limit fixing temperature became slightly high, however, when the polyester diol and the prepolymer were used at an appropriate ratio, significant failure did not occur. In the case of toner using no diol having a polyhydroxycarboxylic acid skeleton (Comparative Example B-1); and in the case of toner using diol having a polyhydroxycarboxylic acid skeleton, but the mixing ratio of the diol with other components was not appropriate (Comparative Examples B-2 to B-4), mainly, the low-temperature fixability degraded, resulting in impossibility of forming high-quality images.

INDUSTRIAL APPLICABILITY

The image-forming toner of the present invention is superior in all of thermal properties (in particular, low-temperature fixability), heat-resistant storage stability and transparency, and can be obtained by dispersion in water, thus making it possible to produce the toner at low costs. Thus, the toner can be favorably used in electrophotographic image formation such as copiers, electrostatic printing, printers, facsimiles, and electrostatic recording.

The invention claimed is:

1. An image forming toner, comprising a linear polyester resin (b1) comprising, in a reacted form:

a polyester diol (b11) comprising a polyhydroxycarboxylic acid skeleton; and a polyester diol (b12) other than the polyester diol (b11), wherein:

the polyester diol (b12) is a reaction product of a diol with a dicarboxylic acid; and the linear polyester resin (b1) is prepared in the presence of a chain extending agent which is a diisocyanate or a dicarboxylic acid.

2. The image forming toner according to claim 1, wherein a monomer forming the polyhydroxycarboxylic acid skeleton of the polyester diol (b11) is an optically active monomer having an optical purity X, in terms of a monomer converted amount, of 80% or less, wherein:

X represents an optical purity (%) at an optically active monomer conversion, which is determined from the following equation:

$$\text{Optical Purity } X(\%) = |X(L\text{-body}) - X(D\text{-body})|;$$

"X (L-body)" represents an L-body content ratio (mole %) at an optically active monomer conversion; and "X (D-body)" represents a D-body content ratio (mole %) at an optically active monomer conversion.

3. The image forming toner according to claim 1, wherein a mass ratio of the polyester diol (b11) to the polyester diol (b12) is 31:69 to 90:10.

4. The image forming toner according to claim 1, wherein the polyhydroxycarboxylic acid skeleton of the polyester diol (b11) is polymerized or copolymerized with a hydroxycarboxylic acid having 2 to 6 carbon atoms.

5. The image forming toner according to claim 1, wherein the polyhydroxycarboxylic acid skeleton of the polyester diol (b11) is a polymer or copolymer obtained by ring-opening polymerization of cyclic ester.

6. The image forming toner according to claim 1, wherein the polyhydroxycarboxylic acid skeleton of the polyester diol (b11) is a polymer or copolymer obtained by direct dehydration condensation of a hydroxy carboxylic acid.

7. The image forming toner according to claim 1, further comprising at least one selected from the group consisting of a vinyl resin, a polyurethane resin, an epoxy resin and an additional polyester resin.

8. The image forming toner according to claim 1, further comprising a wax (c) and a modified wax (d) which is modified so that vinyl polymer chains are grafted onto the wax (c).

9. The image forming toner according to claim 1, comprising particles obtained by:

melt kneading the toner and a colorant to form a melt-kneaded product; and pulverizing the melt-kneaded product, to form the particles.

10. The image forming toner according to claim 1, further comprising a plurality resin particles (C) comprising:

a plurality of resin particles (A) or a coating layer (P);

a plurality of resin particles (B);

a first resin (a); and a second resin (b), wherein:

the resin particles (A) and the coating layer (P) comprise the first resin (a);

the resin particles (B) comprise the second resin (b);

the second resin (b) comprises the linear polyester resin (b1); and the resin particles (A) or the coating layer (P) are attached on a surface of the resin particle (B).

11. The image forming toner according to claim 10, wherein the first resin (a) is selected from the group consisting of a vinyl resin, a polyester resin, a polyurethane resin, and an epoxy resin.

12. The image forming toner according to claim 1, further comprising a resin (b2) which is obtained from a precursor (b0).

13. The image forming toner according to claim 1, further comprising a colorant.

14. An image forming method, comprising:

charging a surface of a latent electrostatic image bearing member;

exposing the charged surface of the latent electrostatic image bearing member to form a latent electrostatic image;

developing the latent electrostatic image using a toner to form a visible image, transferring the visible image onto a recording medium; and fixing the transferred image on the recording medium, wherein the toner is the image forming toner according to claim 1.

15. The image forming toner according to claim 1, wherein a monomer forming the polyhydroxycarboxylic acid skeleton of the polyester diol (b11) is an optically active monomer having a relationship between Y and X that satisfies the following equations:

$$\text{Optical Purity } X(\text{mole }\%)=|X(L\text{-body})-X(D\text{-body})|, \text{ and}$$

$$Y \leq -1.5X+220 \ (80<X\leq 100),$$

wherein:

Y represents a linear polyester resin (b1) content (% by mass);

X represents an optical purity (mole %) in terms of a monomer converted amount;

"X (L-body)" represents an L-body content ratio (mole %) at an optically active monomer conversion; and "X (D-body)" represents a D-body content ratio (mole %) at an optically active monomer conversion.

* * * * *